US007551157B2

(12) United States Patent
Tanaka et al.

(10) Patent No.: US 7,551,157 B2
(45) Date of Patent: Jun. 23, 2009

(54) DISPLAY DEVICE AND DRIVING METHOD THEREOF

(75) Inventors: Masahiro Tanaka, Yotsukaido (JP); Hiroyuki Nitta, Fujisawa (JP); Nobuhiro Takeda, Mobara (JP); Masashi Nakamura, Chosei (JP)

(73) Assignees: Hitachi Displays, Ltd, Chiba-ken (JP); Hitachi Device Engineering Co., Ltd., Chiba-ken (JP)

( * ) Notice: Subject to any disclaimer, the term of this patent is extended or adjusted under 35 U.S.C. 154(b) by 660 days.

(21) Appl. No.: 11/360,692

(22) Filed: Feb. 24, 2006

(65) Prior Publication Data

US 2006/0139294 A1 Jun. 29, 2006

Related U.S. Application Data

(63) Continuation of application No. 10/606,223, filed on Jun. 26, 2003, now Pat. No. 7,006,069.

(30) Foreign Application Priority Data

Jun. 27, 2002 (JP) ..... 2002-187448
Jun. 27, 2002 (JP) ..... 2002-188013

(51) Int. Cl.
*G09G 3/36* (2006.01)
*G09G 5/00* (2006.01)

(52) U.S. Cl. ..... 345/98; 345/96; 345/100; 345/209

(58) Field of Classification Search ..... 345/87–100, 345/204–215, 690; 315/169.1, 169.4
See application file for complete search history.

(56) References Cited

U.S. PATENT DOCUMENTS 5,510,805 A 4/1996 Lee
5,648,790 A 7/1997 Lee
6,448,718 B1 9/2002 Battersby
6,473,077 B1 10/2002 Takenaka et al.
6,819,311 B2 11/2004 Nose et al.
6,882,103 B2 4/2005 Kim
6,937,224 B1 8/2005 Miyachi
6,989,812 B2 1/2006 Arimoto et al.
7,006,069 B2 * 2/2006 Tanaka et al. ..... 345/98

(Continued)

FOREIGN PATENT DOCUMENTS

JP 2000-122596 4/2000

(Continued)

*Primary Examiner*—Vijay Shankar
(74) *Attorney, Agent, or Firm*—Antonelli, Terry, Stout & Kraus, LLP.

(57) ABSTRACT

A display device includes a plurality of gate lines, at least one data line, and a plurality of pixels connected to the plurality of gate lines and the at least one data line. The display device is configured to perform a first step of sequentially selecting N lines of the plurality of gate lines, and sequentially outputting N times display signals to the data line, and to perform a second step of selecting Z lines of the plurality of gate lines at one time, and outputting one time a blanking signal, where N and Z are natural numbers at least equal to 2. The Z lines are separate from the N lines, and the first step and the second step are repeatedly performed.

18 Claims, 38 Drawing Sheets

U.S. PATENT DOCUMENTS

| | | | |
|---|---|---|---|
| 7,027,018 | B2 | 4/2006 | Nitta et al. |
| 7,098,934 | B2 | 8/2006 | Arimoto et al. |
| 2002/0044117 | A1 | 4/2002 | Matsumura et al. |

FOREIGN PATENT DOCUMENTS

| | | |
|---|---|---|
| JP | 2001-060078 | 3/2001 |
| JP | 2001-166280 | 6/2001 |
| JP | 2002-072968 | 3/2002 |
| JP | 2002-328654 | 11/2002 |
| JP | 2003-215542 | 7/2003 |
| JP | 2003-271110 | 9/2003 |
| JP | 2003-280599 | 10/2003 |
| JP | 2004-029539 | 1/2004 |

* cited by examiner

DISPLAY DEVICE AND DRIVING METHOD THEREOF

CROSS REFERENCE TO RELATED APPLICATION

This application is a continuation of U.S. application Ser. No. 10/606,223, filed Jun. 26, 2003 now U.S. Pat. No. 7,006,069, the contents of which are incorporated herein by reference.

BACKGROUND OF THE INVENTION

1. Field of the Invention

The present invention relates to a display device (liquid crystal display device or the like) and a driving method thereof, and more particularly to a so-called active matrix type liquid crystal display device and a driving method thereof.

2. Description of the Related Art

With respect to the active matrix type display device, on a surface of a substrate, respective regions which are surrounded by a plurality of gate signal lines which extend in the x direction and are juxtaposed in the y direction (crossing the x direction) and a plurality of drain signal lines which extend in the y direction and are juxtaposed in the x direction constitute pixel regions and a mass of these respective pixel regions form a display part. In a display device using a liquid crystal display panel, on a surface which faces liquid crystal of one of a pair of substrates which are arranged to face each other with liquid crystal therebetween (a liquid-crystal-side substrate surface), the gate signal lines and the drain signal lines are formed. The gate signal lines are also referred to as scanning signal lines, while the drain signal lines are also referred to as source signal lines, data signal lines or video signal lines.

On each pixel region, at least, a switching element which is driven in response to a scanning signal from the gate signal line and a pixel electrode to which a video signal is supplied from the drain signal line through the switching element are formed thus constituting a pixel.

The pixel electrode forms a pair with a counter electrode and an optical material is interposed between the pixel electrode and the counter electrode. In each pixel region, by controlling the optical transmissivity or light emitting of the optical material using an electric field or current which is generated between the pixel electrode and the counter electrode, the display device performs a display of a desired image. In case of the liquid crystal display device, the counter electrode is formed on one of the above-mentioned pair of substrates on which the pixel electrode is formed or another substrate which faces the above substrate in an opposed manner, and the optical transmissivity of liquid crystal is controlled in response to an electric field generated between the pixel electrode and the counter electrode.

By sequentially supplying the scanning signal to each gate signal line, respective pixels of a group of pixels which are arranged in parallel along the gate signal line to which the scanning signal line is supplied are selected. In conformity with this selection timing, the video signal which is supplied to each drain signal line is supplied to the pixel electrode of each pixel.

In the display device having such a constitution, to make images clear at the time of making the display device visualize animated images, efforts have been made to provide the black display on the whole region of a screen over a plurality of frames.

SUMMARY OF THE INVENTION

However, in the above-mentioned display operation in which the whole region of the display screen of the display device is divided into a plurality of sections along the drain signal one after anothers which extend along the gate signal line and these sections are respectively sequentially displayed in black for every frame period of image data inputted to the display device, inventors of the present inventions have found following technical problems.

Problem 1: On the display screen, at portions corresponding to boundaries which divide the display screen into the above-mentioned plurality of sections, lateral stripes which extend along the above-mentioned gate signal lines and are displayed relatively brightly appear.

Problem 2: Relatively bright brightness lines with respect to other sections of the display screen are displayed such that they flow while traversing the display screen obliquely in response to the changeover of the above-mentioned frame periods.

Problem 3: Along with the sequential changeover of the above-mentioned frame periods, a phenomenon in which the black display is not performed at a portion of the display screen along the above-mentioned gate signal line or a phenomenon in which a portion of the display screen is displayed darker than desired brightness appears.

The present invention has been made in view of such circumstances and objects of the present inventions are as follows.

Object 1: To provide a display device and a driving method thereof which can prevent the generation of lateral stripes displayed on a display screen of a display device (particularly, a liquid crystal display device which reverses the polarities of the video signals between the pixels).

Object 2: To provide a display device and a driving method thereof which prevent the generation of brightness lines which are displayed such that the brightness lines flow on a display screen.

Object 3: To provide a display device and a driving method thereof which make the above-mentioned pixel array perform the uniform (no irregularities) black display operation for every frame period of the image data (that is, every inputting of video signal over the whole region of the display panel).

To briefly explain the summary of typical inventions among inventions disclosed in the present application, they are as follows.

Display Device 1:

In a display device comprising:

(A) a pixel array having a plurality of pixels arranged two-dimensionally along a first direction and a second direction, each of the plurality of pixels includes a pair of electrodes applying a voltage to liquid crystals, respective groups of the plurality of pixels arranged along the first direction form a plurality of pixel-rows juxtaposed along the second direction, and respective groups of the plurality of pixels arranged along the second direction form a plurality of pixel-columns juxtaposed along the first direction;

(B) a scanning driver circuit selecting the plurality of pixel-rows by outputting scanning signals;

(C) a data driver circuit outputting a display signals to each of the plurality of pixel-columns and applying the display signal to each of the pixels belonging to any one of the plurality of pixel-columns and at least one of the plurality of pixel-rows selected by the scanning signal; and (D) a display control circuit controlling display operation of the pixel array, (E) one line of image data is inputted to the data driver circuit for every vertical scanning period of the image data, (F) the data driver circuit repeats, (i) a first step for generating a first display signal corresponding to respective one of the lines of the image data one after another and outputting the first display signals N-times (N is a natural number equal to or greater than 2) to each of the plurality of pixel-columns, and (ii) a second step for generating a second display signal (a blanking signal) making brightness of the pixel thereby equal to or darker than that before the second display is applied and outputting the second display signals M-times (M is a natural number smaller than the M) to each of the plurality of pixel-columns, alternately, (G) the scanning driver circuit repeats, (i) a first selection step for selecting every Y rows (Y is a natural number smaller than the N/M) of the plurality of pixel-rows in response to every one of the N-times outputs of the first display signals in the first step sequentially from one end of the pixel array to another end of the along the pixel array along the second direction, and (ii) a second selection step for selecting every Z rows (Z is a natural number not smaller than the N/M) of the plurality of pixel-rows other than those selected in the first selection step in response to every one of the M-times outputs of the second display signals in the second step sequentially from the one end to the another end of the pixel array along the second direction, alternately, (H) a polarity of one of the pair of electrodes provided for each of the plurality of pixels against another thereof is (i) different from one another among ones of the plurality of pixels adjacent to one another along at least one of the first direction and the second direction by the first signals applied thereto during the first step, and (ii) different from each other between one of the plurality of pixels selected in the second selection step and another of the plurality of pixels selected subsequently to the second selection step by the second signals applied to the one of the plurality of pixels wherever the one and the another of the plurality of pixels belong to the same one of the plurality of pixel-columns.

Display Device 2:

In the display device 1, the scanning driver circuit starts to output the scanning signals for every frame period of the image data, and an output timing of the second display signal in the second step against the start of the scanning signal output during one of the frames is different from that during another of the frames subsequently to the one of the frames.

Display Device 3:

In the display device 1, the number Y of the respective rows of the plurality of pixel-rows being selected in response to each output of the first display signal is 1, the number N of the first display signal outputs in the first step is equal to or greater than 4, the number Z of the respective rows of the plurality of pixel-rows being selected in response to each output of the second display signal is equal to or greater than 4, and the number N of the second display signal outputs in the second step is equal to 1.

Driving Method for a Display Device 1:

(A') In a driving method for a display device having a pixel array in which a plurality of pixels are arranged two-dimensionally along a first direction and a second direction, each of the plurality of pixels includes a pair of electrodes applying a voltage to liquid crystals, respective groups of the plurality of pixels arranged along the first direction form a plurality of pixel-rows juxtaposed along the second direction, and respective groups of the plurality of pixels arranged along the second direction form a plurality of pixel-columns juxtaposed along the first direction, (B') the plurality of pixel-rows are selected respectively in response to every scanning signal, (I) the plurality of pixel-columns receive a display signal each, and the display signal is applied to one of the pair of electrodes of each of the plurality of pixels belonging to each one of the plurality of pixel-rows selected by the scanning signal while a reference voltage is applied to another of the pair of electrodes provided in the each of the plurality of pixels, (F'+G') (i) a first step for selecting every Y rows (Y is a natural number) of the plurality of pixel-rows N-times (N is a natural number equal to or greater than 2) sequentially from one end of the pixel array to another end of the along the pixel array along the second direction, and applying first display signals generated in accordance with every line component of image data which is inputted to the display device sequentially in response to a vertical synchronizing signal of the image data to the one of the pair of electrodes provided in each of the pixels belonging to the every Y pixel-rows as selected sequentially; and (ii) a second step for selecting every Z rows (Z is a natural number) of the plurality of pixel-rows other than those selected during the first step M-times (M is a natural number satisfying relationship of $M<N$, $Y<N/M\leqq Z$) sequentially from the one end to the another end, and applying a second display signal to the one of the pair of electrodes provided in each of the pixels belonging to the Z pixel-rows as selected sequentially so that brightness of the Z pixel-rows becomes equal to or lower than that before the second display signal is supplied thereto, are repeated alternately, wherein (H') (i) polarity of the first display signals against the reference voltage is different from one another between one of the N-times of the every Y pixel-rows selections and another thereof subsequent to the one thereof, and (ii) the second display signal inputted in the Z pixel-rows selected in the second step has different polarity against the reference voltage from that of the display signal other than the second display signal which is inputted to at least one of the pixel-rows being selected subsequently to the second step in every one of the plurality of pixel-columns.

Driving Method for a Display Device 2:

(A') In a driving method for a display device having a pixel array in which a plurality of pixels are arranged two-dimensionally along a first direction and a second direction, each of the plurality of pixels includes a pair of electrodes applying a voltage to liquid crystals, respective groups of the plurality of pixels arranged along the first direction form a plurality of pixel-rows juxtaposed along the second direction, and respective groups of the plurality of pixels arranged along the second direction form a plurality of pixel-columns juxtaposed along the first direction, (B') the plurality of pixel-rows are selected respectively in response to every scanning signal, (I) the plurality of pixel-columns receive a display signal each, and the display signal is applied to one of the pair of electrodes of each of the plurality of pixels belonging to each one of the plurality of pixel-rows selected by the scanning signal while a reference voltage is applied to another of the pair of electrodes provided in the each of the plurality of pixels, (F'+G') (i) a first step for selecting every Y rows (Y is a natural number) of the plurality of pixel-rows N-times (N is a natural number equal to or greater than 2) sequentially from one end of the pixel array to another end of the along the pixel array along the second direction, and applying first display signals generated in accordance with every line component of image data which is inputted to the display device sequentially in response to a vertical synchronizing signal of the image data to the one of the pair of electrodes provided in each of the pixels belonging to the every Y pixel-rows as selected sequentially; and (ii) a second step for selecting every Z rows (Z is a natural number) of the plurality of pixel-rows other than those selected during the first step M-times (M is a natural number satisfying relationship of $M<N$, $Y<N/M\leqq Z$) sequentially from the one end to the another end, and applying a second display signal to the one of the pair of electrodes provided in each of the pixels belonging to the Z pixel-rows as selected sequentially so that brightness of the Z pixel-rows becomes equal to or lower than that before the second display signal is supplied thereto, are repeated alternately, wherein (H") (i) polarity of the first display signals against the reference voltage is different from one another among mutually adjacent columns of the pixel-columns, and (ii) the second display signal inputted in the Z pixel-rows selected in the second step has different polarity against the reference voltage from that of the display signal other than the second display signal which is inputted to at least one of the pixel-rows being selected subsequently to the second step in every one of the plurality of pixel-columns.

Driving Method for a Display Device 3:

In any one of the driving methods for the display devices 1 and 2, the image data are inputted to the display device every frame period thereof, a selection operation of the plurality of pixel-rows is started for the every frame period, and a timing of the second step with respect to the start of the selection operation of the plurality of pixel-rows in one of the frames is different from that in another of the frames subsequently to the one of the frames.

Driving Method for a Display Device 4:

In the driving method for the display device 1 or 2, wherein the first step is performed by setting the number Y of the respective pixel-rows selected in response to each output of the first display signal to 1 and the number N of the first display signal outputs to not smaller than 4, and the second step is performed by setting the number Z of the respective pixel-rows being selected in response to each output of the second display signal to not smaller than 4 and the number N of the second display signal outputs to 1.

Display Device 4:

(J) In a display device, comprising:

a pixel array having a plurality of pixels arranged two-dimensionally along a first direction and a second direction, respective groups of the plurality of pixels arranged along the first direction form a plurality of pixel-rows juxtaposed along the second direction, and respective groups of the plurality of pixels arranged along the second direction form a plurality of pixel-columns juxtaposed along the first direction;

(B) a scanning driver circuit selecting the plurality of pixel-rows by outputting scanning signals;

(C) a data driver circuit outputting a display signals to each of the plurality of pixel-columns and applying the display signal to each of the pixels belonging to any one of the plurality of pixel-columns and at least one of the plurality of pixel-rows selected by the scanning signal; and (D) a display control circuit controlling display operation of the pixel array, (E) one line of image data is inputted to the data driver circuit for every vertical scanning period of the image data;

(K) the data driver circuit repeats (i) a first step for performing an operation to generate a first display signal corresponding to respective one of the lines of the image data one after another and to output the first display signals to each of the plurality of pixel-columns in every certain period N-times (N is a natural number equal to or greater than 2), and (ii) a second step for performing an operation to generate a second display signal (a blanking signal) making brightness of the pixel thereby equal to or darker than that before the second display is applied and to output the second display signals to each of the plurality of pixel-columns, alternately in the every certain period M-times (M is a natural number smaller than the M), alternately;

(G) the scanning driver circuit repeats (i) a first selection step for selecting every Y rows (Y is a natural number smaller than the N/M) of the plurality of pixel-rows in response to every one of the N-times outputs of the first display signals in the first step sequentially from one end of the pixel array to another end of the along the pixel array along the second direction, and (ii) a second selection step for selecting every Z rows (Z is a natural number not smaller than the N/M) of the plurality of pixel-rows other than those selected in the first selection step in response to every one of the M-times outputs of the second display signals in the second step sequentially from the one end to the another end of the pixel array along the second direction, alternately;

(L) the scanning driver circuit repeats a selection operation of the plurality of pixel-rows throughout the pixel array during every frame period of the image data;

(M) a deviation of the certain period of the second step from a starting time of the pixel-rows selection operation throughout the pixel array is different between each one of the frame periods and another of the frame periods subsequent thereto; and (N) a time difference between the deviation of the certain period of the second step from the starting time of the pixel-rows selection operation in the each one of the frame periods and that in the another of the frame periods subsequent thereto are regulated to be shorter than (N−2) times as long as the certain period.

Driving Method for a Display Device 5:

In a display device, comprising:

(J) a pixel array having a plurality of pixels arranged two-dimensionally along a first direction and a second direction, respective groups of the plurality of pixels arranged along the first direction form a plurality of pixel-rows juxtaposed along the second direction, and respective groups of the plurality of pixels arranged along the second direction form a plurality of pixel-columns juxtaposed along the first direction;

(B) a scanning driver circuit selecting the plurality of pixel-rows by outputting scanning signals;

(C) a data driver circuit outputting a display signals to each of the plurality of pixel-columns and applying the display signal to each of the pixels belonging to any one of the plurality of pixel-columns and at least one of the plurality of pixel-rows selected by the scanning signal; and (D) a display control circuit controlling display operation of the pixel array, (E) one line of image data is inputted to the data driver circuit for every vertical scanning period of the image data;

(F) the data driver circuit repeats (i) a first step for performing an operation to generate a first display signal corresponding to respective one of the lines of the image data one after another and to output the first display signals to each of the plurality of pixel-columns N-times (N is a natural number equal to or greater than 2), and (ii) a second step for performing an operation to generate a second display signal (a blanking signal) making brightness of the pixel thereby equal to or darker than that before the second display is applied and to output the second display signals to each of the plurality of pixel-columns, M-times (M is a natural number smaller than the M), alternately;

(O) the scanning driver circuit repeats (i) a first selection step for selecting every Y rows (Y is a natural number smaller than the N/M) of the plurality of pixel-rows in response to every one of the N-times outputs of the first display signals in the first step sequentially from one end of the pixel array to another end of the along the pixel array along the second direction on a basis of scanning clock signals inputted to the scanning driver circuit, and (ii) a second selection step for selecting every Z rows (Z is a natural number not smaller than the N/M) of the plurality of pixel-rows other than those selected in the first selection step in response to every one of the M-times outputs of the second display signals in the second step sequentially from the one end to the another end of the pixel array along the second direction, alternately; and (P) the scanning driver circuit repeats a selection operation of the plurality of pixel-rows throughout the pixel array during every frame period of the image data and has means for adjusting a number of the scanning clock signals generated between the last output of the second display signals in one of the frame periods and the first output of the second display signals in another of the frame periods subsequent to the one of the frame periods to N while the one of the frame periods is replaced by the another of the frame periods.

Driving Method for a Display Device 4:

In any one of the display devices 4 or 5, the number Y of the respective rows of the plurality of pixel-rows being selected in response to each output of the first display signal is 1, the number N of the first display signal outputs in the first step is equal to or greater than 4, the number Z of the respective rows of the plurality of pixel-rows being selected in response to each output of the second display signal is equal to or greater than 4, and the number N of the second display signal outputs in the second step is equal to 1.

Driving Method for a Display Device 5:

(J') In a driving method for a display device having a pixel array in which a plurality of pixels are arranged two-dimensionally along a first direction and a second direction, respective groups of the plurality of pixels arranged along the first direction form a plurality of pixel-rows juxtaposed along the second direction, and respective groups of the plurality of pixels arranged along the second direction form a plurality of pixel-columns juxtaposed along the first direction, (B') the plurality of pixel-rows are selected respectively in response to every scanning signal, (C') the plurality of pixel-columns receive a display signal each and the display signal is supplied to each of the pixels belonging both to the respective pixel-column and to each one of the plurality of pixel-rows selected by the scanning signal, repeating:

(F'+O') (i) a first step for selecting every Y rows (Y is a natural number) of the plurality of pixel-rows N-times (N is a natural number equal to or greater than 2) sequentially from one end of the pixel array to another end of the along the pixel array along the second direction in response to scanning clock signals, and applying first display signals generated in accordance with every line component of image data which is inputted to the display device sequentially in response to a vertical synchronizing signal of the image data to the one of the pair of electrodes provided in each of the pixels belonging to the every Y pixel-rows as selected sequentially; and (ii) a second step for selecting every Z rows (Z is a natural number) of the plurality of pixel-rows other than those selected during the first step M-times (M is a natural number satisfying relationship of $M<N$, $Y<N/M\leqq Z$) sequentially from the one end to the another end, and applying second display signal to the one of the pair of electrodes provided in each of the pixels belonging to the Z pixel-rows as selected sequentially so that brightness of the Z pixel-rows becomes equal to or lower than that before the second display signal is supplied thereto, are repeated alternately, wherein (P') a number of the scanning clock signals generated between the last output of the second display signals in one of frame periods of the image data and the first output of the second display signals in another of the frame periods subsequent to the one of the frame periods is adjusted to N while the one of the frame periods is replaced by the another of the frame periods.

Driving Method for a Display Device 6:

In the driving methods for the display device 5, the first step is performed by setting the number Y of the respective pixel-rows selected in response to each output of the first display signal to 1 and the number N of the first display signal outputs to not smaller than 4, and the second step is performed by setting the number Z of the respective pixel-rows being selected in response to each output of the second display signal to not smaller than 4 and the number N of the second display signal outputs to 1.

The present invention is not limited to the structures mentioned above, but can be variously modified without departing from the technical idea of the present invention.

DETAILED DESCRIPTION

Preferred embodiments of a liquid crystal display device according to the present invention are explained in conjunction with drawings.

<<First Embodiment>>

A display device and a method for driving the same according to the first embodiment of the present invention is explained in conjunction with FIG. 1 to FIG. 7. In this embodiment, the explanation is made with respect to a display device (liquid crystal display device) which uses an active matrix-type liquid crystal display panel as a pixel array. However, the basic structure and a driving method of the display device are applicable to a display device which uses an electroluminescence array or a light emitting diode array as a pixel array.

Figure 1:
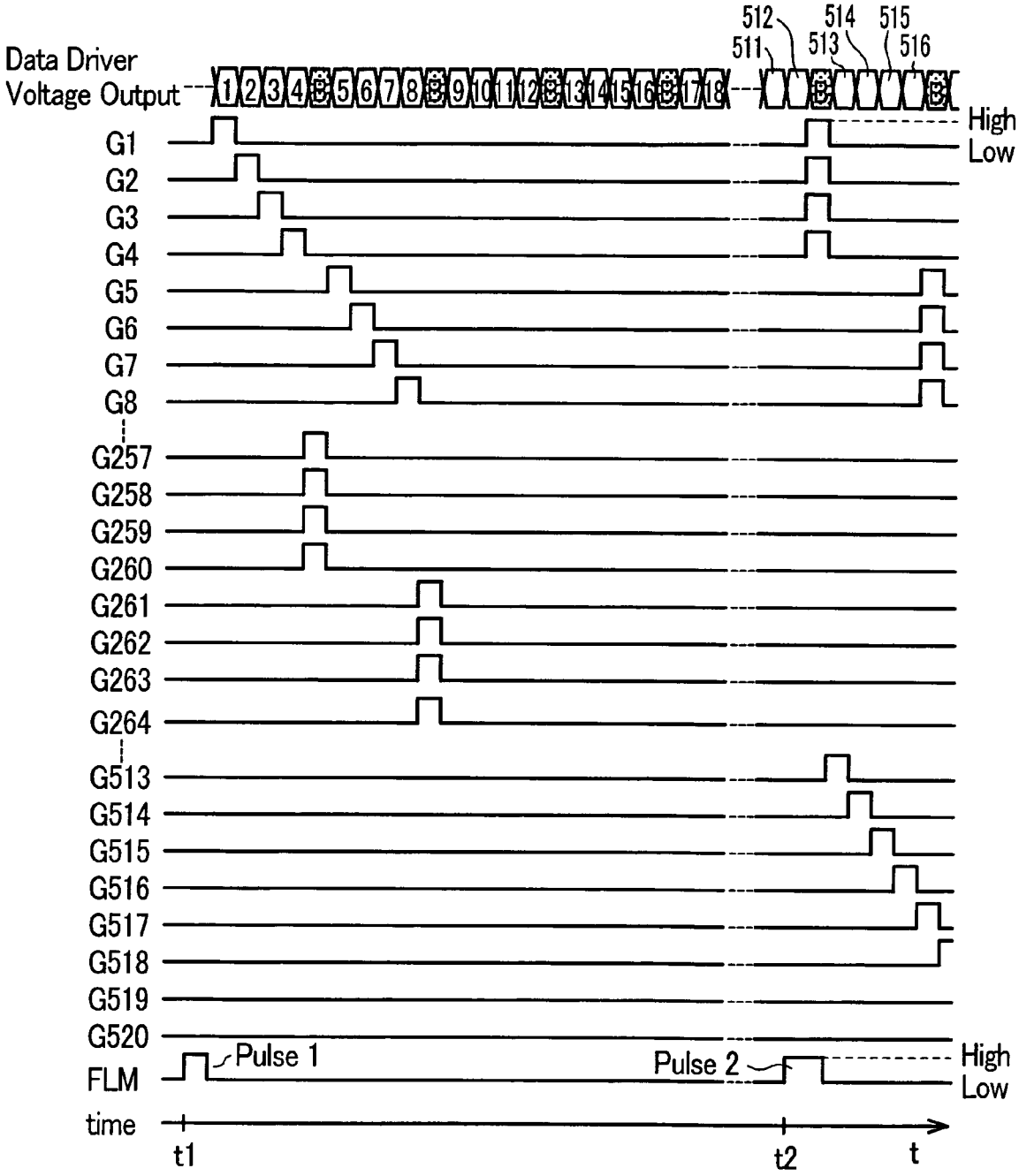
FIG. 1 is a view which shows output timing of display signals and driving waveforms of scanning lines which correspond to the output timing explained as the first embodiment of a driving method of a liquid crystal display device according to the present invention.
Figure 2:
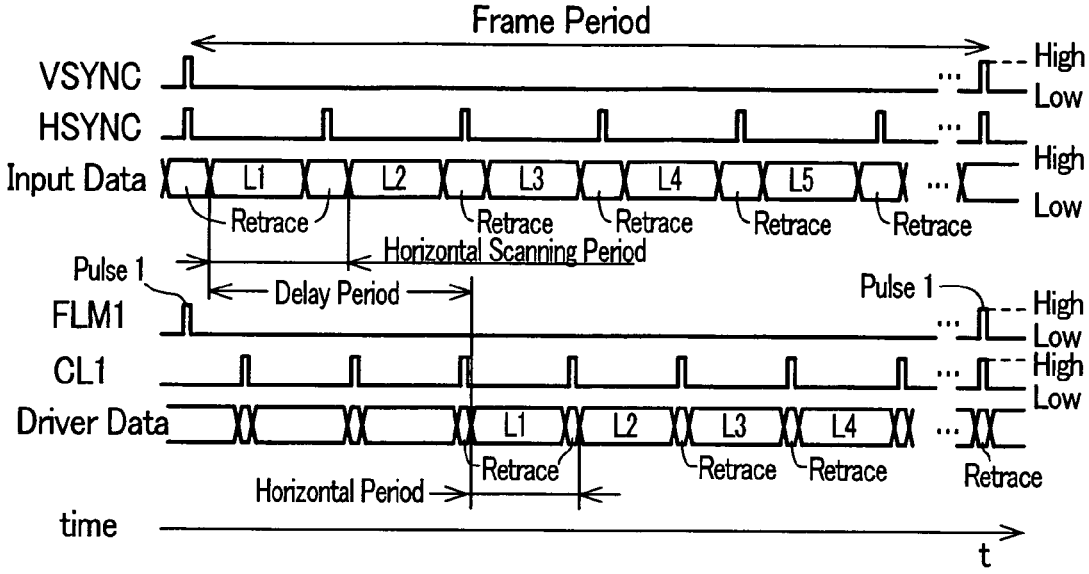
FIG. 2 is a view showing timing of input waveforms (input data) of image data to a display control circuit (timing controller) and output waveforms (driver data) from the display control circuit explained as the first embodiment of a driving method of a liquid crystal display device according to the present invention.

FIG. 1 is a timing chart showing selection timing of display signal outputs (data driver output voltages) to the pixel array of the display device according to the present invention and scanning signal lines G1 in the inside of the pixel array corresponding to the respective signal outputs. FIG. 2 is a timing chart showing timing of inputting (input data) of image data to a display control circuit (timing controller) provided to the display device and outputting of image data (driver data) from the display control circuit.

Figure 3:
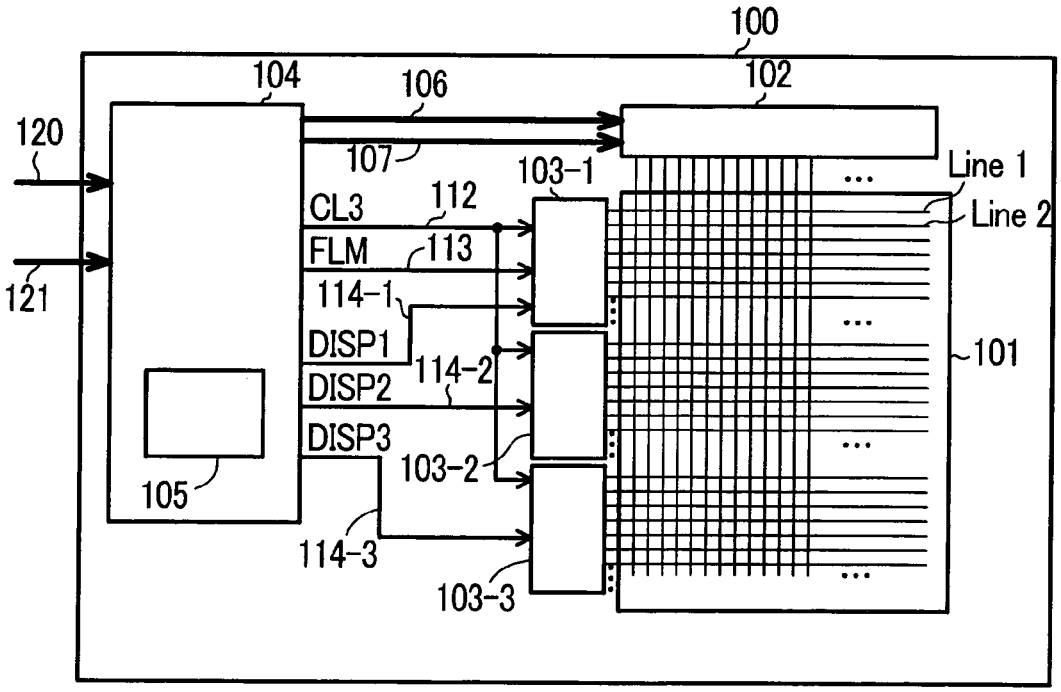
FIG. 3 is a constitutional view showing the summary of the liquid crystal display device according to the present invention.
Figure 9:
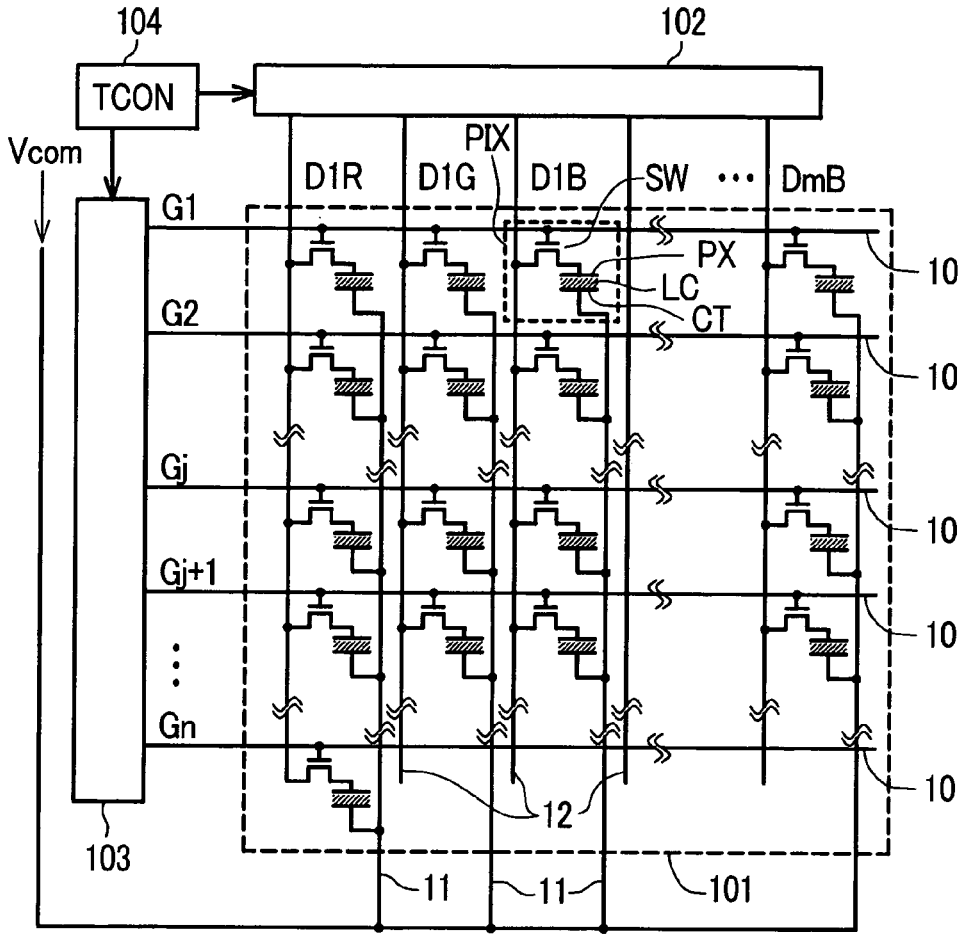
FIG. 9 is a schematic view of one example of a pixel array provided to an active matrix type display device.

FIG. 3 is a constitutional view (block diagram) showing the summary of the display device of the embodiment of the present invention, wherein one example of a detail of a pixel array 101 shown in FIG. 3 and a periphery thereof is shown in FIG. 9. The previously-mentioned timing charts shown in FIG. 1 and FIG. 2 are depicted based on the constitution of the display device (liquid crystal display device) shown in FIG. 3.

Figure 4:
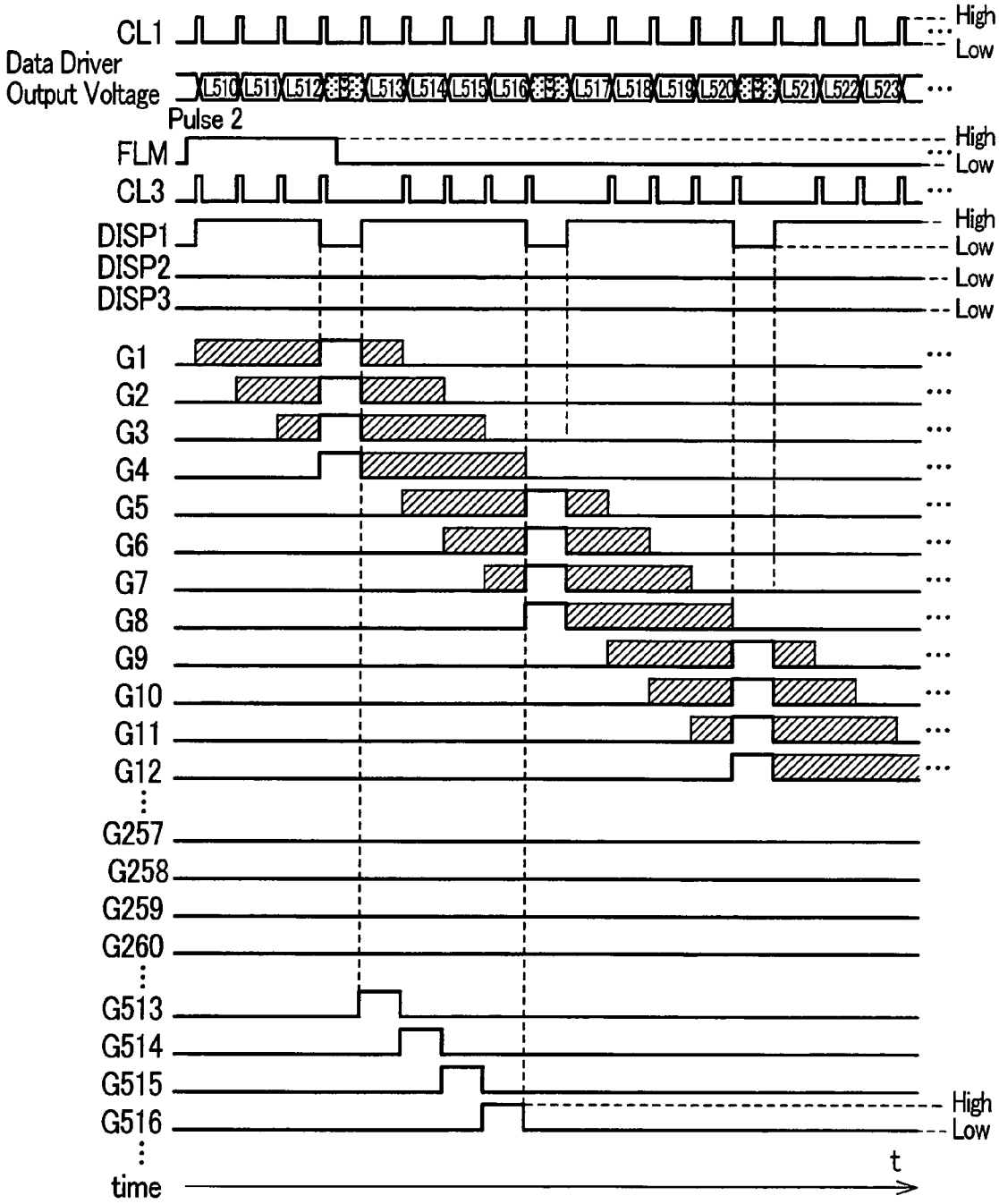
FIG. 4 is a view showing driving waveforms which select four scanning lines simultaneously during an output period of display signals explained as the first embodiment of a driving method of a liquid crystal display device according to the present invention.

FIG. 4 is a timing chart showing another example of timing for each selecting of display signal outputs (data driver output voltages) to the pixel array of the display device according to this embodiment and scanning signal lines corresponding to respective outputs. As four of the scanning signal lines are selected by scanning signals outputted from a shift-register type scanning driver during an outputting period of display signals, display signals are supplied to pixel rows which respectively correspond to these scanning signal lines.

Figure 5:
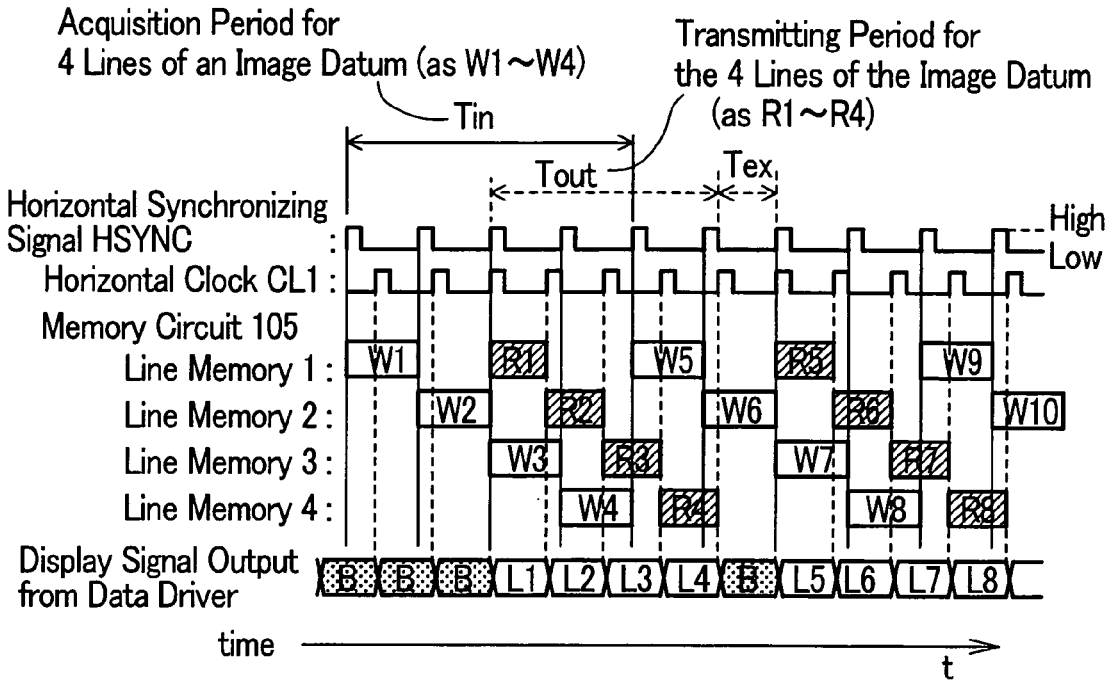
FIG. 5 is a view showing respective timings for writing image data to a plurality of (for example, four) line memories provided to a liquid crystal display device according to the present invention and reading out of the image data from the line memories.
Figure 6:
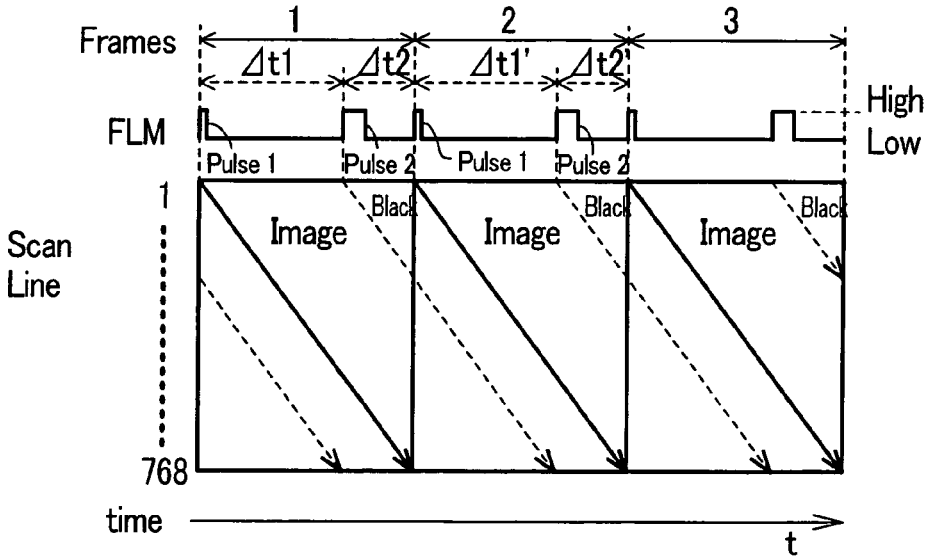
FIG. 6 is a view showing pixel display timing of every frame period (each one of three continuous frame periods) in the first embodiment of the driving method of the liquid crystal display device according to the present invention.
Figure 7:
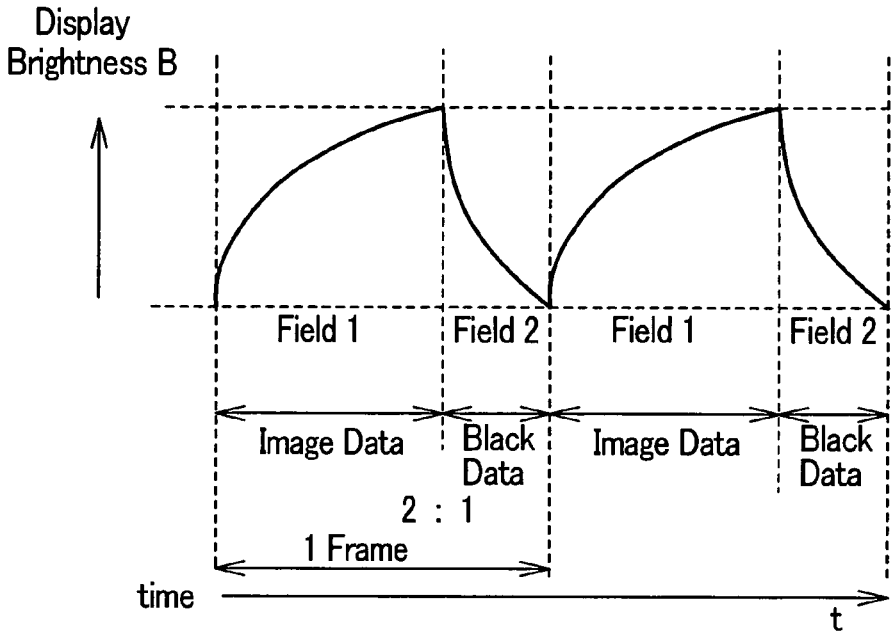
FIG. 7 is a view showing the brightness response to display signals (change of optical transmissivity of a liquid crystal layer corresponding to pixels) when the liquid crystal display device of the present invention is driven in accordance with pixel display timing shown in FIG. 6.

FIG. 5 is a timing chart showing timing in which image data for 4 lines are written one after another to every other 4 line memories included in a line-memory circuit provided to a display control circuit 104 (see FIG. 3) and the image data is read out from respective line memories and is transferred to a data driver (video signal driving circuit). FIG. 6 relates to a method for driving the display device of the present invention and shows display timing of image data and blanking signal according to this embodiment in the pixel array, while FIG. 7 shows the brightness response (change of optical transmissivity of liquid crystal layer corresponding to pixels) when the display device of this embodiment is driven in accordance with this timing.

Firstly, the summery of the display device 100 of this embodiment is explained in conjunction with FIG. 3.

The display device 100 includes a liquid crystal display panel (hereinafter referred to as "liquid crystal panel") having resolution of WXGA class as a pixel array 101. The pixel array 101 having the resolution of WXGA class is not limited to the liquid crystal panel and is characterized in that 768 pixel rows each of which arranges pixels of 1280 dots in the horizontal direction are juxtaposed in the vertical direction in the screen.

Although the pixel array 101 of the display device of this embodiment is substantially equal to the pixel array of the display device explained in conjunction with FIG. 9, due to resolution thereof, the gate lines 10 consisting of 768 lines and the data lines 12 consisting of 1280 lines are respectively juxtaposed within the screen of the pixel array 101. Further, in the pixel array 101, 983040 pixels PIX each of which is selected in response to the scanning signal transmitted through one of the former lines and receives the display signal from one of latter lines are arranged two-dimensionally and images are produced by these pixels PIX.

When the pixel array displays color images, each pixel is divided in the horizontal direction corresponding to the number of primary colors used in color display. For example, in a liquid crystal panel having a color filter corresponding to three primary colors (red, green, blue) of light, the number of the above-mentioned data lines 12 is increased to 3840 lines and the total number of pixels PIX included in the display screen is also three times as large as the above-mentioned value.

To explain the above-mentioned liquid crystal panel used as the pixel array 101 in this embodiment in more detail, each pixel PIX included in the liquid crystal panel is provided with a thin film transistor (abbreviated as TFT) as the switching element SW. Further, each pixel is operated in a so-called normally black-displaying mode in which the larger the display signal supplied to each pixel, the pixel exhibits the higher brightness. Not only the pixel of the liquid crystal panel of this embodiment, a pixel of the above-mentioned electroluminescence array or light emitting diode array is also operated in the normally black-displaying mode.

In the liquid crystal panel operated in the normally black-displaying mode, the greater the potential difference between a gray scale voltage applied to the pixel electrode PX formed in the pixel PIX in FIG. 9 from the data line 12 through the switching element SW and a counter voltage (also referred to as reference voltage, common voltage) applied to the counter electrode CT which faces the pixel electrode PX while sandwiching a liquid crystal layer LC therebetween, the optical transmissivity of the liquid crystal layer LC is elevated so as to increase the brightness of the pixel PIX. That is, with respect to the gray scale voltage which is the display signal of the liquid crystal panel, the remoter the value of the gray scale voltage away from the value of the counter voltage, the display signal is increased.

To the pixel array (TFT-type liquid crystal panel) 101 shown in FIG. 3, in the same manner as the pixel array 101 shown in FIG. 9, a data driver (display signal driving circuit) 102 which supplies display signals (gray scale voltages or tone voltages) corresponding to the display data to the data lines (signal lines) 12 formed on the pixel array 101 and scanning drivers (scanning signal driving circuits) 103-1, 103-2, 103-3 which supply scanning signals (voltage signals) to the gate lines (scanning lines) 10 formed on the pixel array 101 are respectively provided. In this embodiment, although the scanning driver is divided into three drivers along the so-called vertical direction of the pixel array 101, the number of these drivers is not limited to 3. Further, these drivers may be replaced with one scanning driver which collects these functions.

A display control circuit (timing controller) 104 transmits the above-mentioned display data (driver data) 106 and timing signals (data driver control signals) 107 for controlling display signal outputs corresponding to the display data to the data driver 102. Further, the display control circuit 104 transmits scanning clock signals 112 and scanning start signals 113 to the respective scanning drivers 103-1, 103-2, 103-3. Although the display control circuit 104 also transfers scan-condition selecting signals 114-1, 114-2, 114-3 corresponding to the scanning drivers 103-1, 103-2, 103-3 to these scanning drivers 103-1, 103-2, 103-3, this function is explained later. The scan-condition selecting signals are also referred to as display-operation selecting signals in view of a function thereof.

The display control circuit 104 receives image data (video signals) 120 and video control signals 121 inputted to the display control circuit 104 from an external video signal source of the display device 100 such as a television receiver set, a personal computer, a DVD player or the like. Although a memory circuit which temporarily stores the image data 120 is provided in the inside of or in the periphery of the display control circuit 104, in this embodiment, a line memory circuit 105 is incorporated in the display control circuit 104. The video control signals 121 include a vertical synchronizing signal VSYNC which controls a transmission state of the image data, a horizontal synchronizing signal HSYNC, a dot clock signal DOTCLK and a display timing signal DTMG.

The image data which generates an image for 1 screen in the display device 100 is inputted to the display control circuit 104 in response to (in synchronism with) the vertical synchronizing signal VSYNC. That is, the image data is sequentially inputted to the display device 100 (display control circuit 104) from the above-mentioned video signal source for every cycle (also referred to as vertical scanning period or frame period) defined by the vertical synchronizing signal VSYNC, and the image for 1 screen is displayed on the pixel array 101 successively every frame period.

The image data in one frame period is sequentially inputted to the display device by dividing the 1 frame period with a cycle (also referred to as horizontal scanning period) defined by the above-mentioned horizontal synchronizing signals HYNC. That is, each image data which is inputted to the display device for every frame period includes a plurality of line data and the image of 1 screen generated by the image data is generated by sequentially arranging images in the horizontal direction depending on every line data for every horizontal scanning period in the vertical direction. Data corresponding to respective pixels arranged in the horizontal direction in 1 screen are identified with cycles in which the above-mentioned respective line data are defined by the above-mentioned dot clock signals.

Since the image data 120 and video control signals 121 are also inputted to the display device which uses a cathode ray tube, it is necessary to ensure time for sweeping electron lines thereof from the scanning completion position to the scanning start position for every horizontal scanning period and every frame period. This time constitutes a dead time in the transfer of the image information and hence, regions which are referred to as retracing periods which do not contribute to the transfer of image information corresponding to the dead time are also provided to the image data 120. In the image data 120, the regions which correspond to these retracing periods are discriminated from other regions which contribute to the transfer of image information due to the above-mentioned display timing signal DTMG On the other hand, the active matrix type display device 100 described in this embodiment generates display signals corresponding to an amount of image data for 1 line (the above-mentioned line data) at the data driver 102 and these display signals are collectively outputted to a plurality of data lines (signal lines) 12 which are arranged in parallel in the pixel array 101 in response to the selection of the gate lines 10 by the scanning driver 103. Accordingly, theoretically, inputting of the line data to the pixel rows is continued from one horizontal scanning period to next horizontal scanning period without sandwiching the retracing period therebetween, while inputting of the image data to the pixel array is also continued from one frame period to next frame period. Accordingly, in the display device 100 of this embodiment, reading out of every image data (line data) for 1 line from the memory circuit (line memory) 105 using the display control circuit 104 is performed in accordance with the cycle generated by shortening the retracing periods which are included in the above-mentioned horizontal scanning periods (allocated to storing of the image data for 1 line to the memory circuit 105).

Since this cycle is reflected on an output interval of the display signals to the pixel array 101 described later, the cycle is referred to as the horizontal period of the pixel array operation or simply as the horizontal period. The display control circuit 104 generates a horizontal clock CL1 which defines the horizontal period and transfers the horizontal clock CL1 as one of the above-mentioned data driver control signals 107 to the data driver 102. In this embodiment, with respect to the time for storing the image data for 1 line to the memory circuit 105 (the above-mentioned horizontal scanning period), by shortening time for reading out the image data from the memory circuit 105 (the above-mentioned horizontal period), time for inputting blanking signals to the pixel array 101 for every 1 frame period is produced.

FIG. 2 is a timing chart showing one example of inputting (storing) of image data to the memory circuit 105 and outputting (reading-out) of the image data from the memory circuit 105 using the display control circuit 104. The image data which is inputted to the display device for every frame period defined by the pulse interval of the vertical synchronizing signal VSYNC is, as shown in waveforms of the input data, sequentially inputted to the memory circuit 105 using the display control circuit 104 in response to (in synchronism with) the horizontal synchronizing signal HSYNC including respective retracing periods for every plurality of line data (image data of 1 line) L1, L2, L3, . . . included in the image data. The display control circuit 104 sequentially reads out the line data L1, L2, L3, . . . stored in the memory circuit 105 in accordance with the above-mentioned horizontal clock CL1 or the timing signals similar to the horizontal clock CL1 as shown in the waveforms of the output data.

Here, the retracing periods which make respective line data L1, L2, L3, outputted from the memory circuit 105 spaced apart from each other along a time axis is made shorter than the retracing periods which make respective line data inputted to the memory circuit 105 spaced apart from each other. Accordingly, between the period necessary for inputting the line data to the memory circuit 105 N times (N being a natural number of 2 or more) and the period necessary for outputting these line data from the memory circuit 105 (N-time line data outputting period), time which is capable of outputting the line data M times (M being a natural number smaller than N) from the memory circuit 105 is produced. In this embodiment, by making use of a so-called extra time in which the image data for M lines is outputted from the memory circuit 105, the pixel array 101 is made to perform a separate display operation.

Here, the image data (line data included in the image data in FIG. 2) is temporarily stored in the memory circuit 105 before being transferred to the data driver 102 and hence, the image data is read out by the display control circuit 104 during a delay time corresponding to the stored period. When a frame memory is used as the memory circuit 105, this delay time corresponds to 1 frame period. When the image data is inputted to the display device at the frequency of 30 Hz, 1 frame period thereof is about 33 ms (milliseconds) and hence, a user of the display device cannot perceive the delay of display time of the image with respect to an input time of the image data to the display device. However, by providing a plurality of line memories to the display device 100 in place of the frame memory as the memory circuit 105, this delay time can be shortened, the structure of the display control circuit 104 or the peripheral circuit structure can be simplified or the increase of size can be suppressed.

One example of the driving method of the display device 100 using the line memory for storing a plurality of line data as the memory circuit 105 is explained in conjunction with FIG. 5. In the driving of the display device 100 according to this embodiment, in the above-mentioned extra time between the period for inputting image data for N lines to the display control circuit 104 and the period for outputting image data for N lines from the display control circuit 104 (period for sequentially outputting the display signals respectively corresponding to the N-line image data from the data driver 102), display signals (hereinafter, these signals being referred to as blanking signals) which mask the display signals which are already held in the pixel array (the image data which are inputted to the pixel array in one preceding frame period) are written M times. In this driving method of the display device 100, the first step in which the display signals are sequentially generated from respective N-line image data using the data driver 102 and the image data is outputted to the pixel array 101 sequentially (N times in total) in response to the horizontal clocks CL1 and the second step in which the above-mentioned blanking signals are outputted to the pixel array 101 in response to the horizontal clock CL1 M times are repeated. Although the further explanation of this driving method of the display device is explained later in conjunction with FIG. 1, the above-mentioned N value is set to 4 and the above-mentioned M value is set to 1 in FIG. 5.

As shown in FIG. 5, the memory circuit 105 includes four line memories 1 to 4 which perform writing and reading-out of data independently from each other, wherein the image data 120 for every 1 line which are sequentially inputted to the display device 100 in synchronism with the horizontal synchronizing signal HSYNC are sequentially stored into one of these line memories 1 to 4 one after another. That is, the memory circuit 105 has a memory capacity for 4 lines. For example, in an acquisition period Tin of image data 120 for 4 lines by the memory circuit 105, the image data W1, W2, W3, W4 for 4 lines are inputted to the line memory 4 from the line memory 1 sequentially.

The acquisition period Tin of image data extends over time which is substantially four times as long as the horizontal scanning period defined by the pulse interval of the horizontal synchronizing signal HSYNC included in the vide control signals 121. However, before this acquisition period Tin of image data is finished with storing of the image data into the line memory 4, the image data which are stored in the line memory 1, the line memory 2 and the line memory 3 in this period are sequentially read out as the image data R1, R2, R3 using the display control circuit 104. Accordingly, as soon as the acquisition period Tin of image data W1, W2, W3, W4 is finished, it is possible to start storing of image data W5, W6, W7, W8 for next 4 lines to the line memories 1 to 4.

In the above-mentioned explanation, the reference symbol affixed to every 1 line of the image data is changed between at the time of inputting the image data to the line memory and at the time of outputting the image data from the line memory. For example, W1 is affixed to the former and R1 is affixed to the latter. This reflects that the image data for every 1 line includes the above-mentioned retracing period and when the image data are read out from any one of line memories 1 to 4 in response to (in synchronism with) the horizontal clock CL1 having higher frequency than the above-mentioned horizontal synchronizing signal HSYNC, the retracing periods included in the image data are shortened. Accordingly, for example, compared to the length of the image data for 1 line (referred to as line data hereinafter) W1 inputted to the line memory 1 along a time axis, the length of the line data R1 outputted from the line memory 1 along a time axis is shorter as shown in FIG. 5.

In the period from inputting of the line data to the line memory to outputting of the line data from the line memory, even when image information (for example, generating image of 1 line along the horizontal direction of the screen) included in the line data is not processed, the length of the image information along the time axis can be compressed as described above. Accordingly, between the finish time of outputting of the 4-line image data R1, R2, R3, R4 from the line memories 1 to 4 and the start time of outputting of the 4-line image data R5, R6, R7, R8 from the line memories 1 to 4, the above-mentioned extra time Tex is generated.

The 4-line image data R1, R2, R3, R4 which are read out from the line memories 1 to 4 are transferred to the data driver 102 as the driver data 106 and display signals L1, L2, L3, L4 which respectively correspond to the image data R1, R2, R3, R4 are produced (display signals L5, L6, L7, L8 being also produced correspond to the image data R5, R6, R7, R8 which are read out next time). These display signals are respectively outputted to the pixel array 101 in response to the above-mentioned horizontal clock CL1 in order indicated by an eye diagram of outputting display signals shown in FIG. 5. Accordingly, by allowing the memory circuit 105 to include at least the line memory (or a mass thereof) having capacity of the above-mentioned N line, it is possible to input image data of 1 line inputted to the display device during a certain frame period to the pixel array during this frame period and hence, the response speed of the display device in response to inputting of image data can be enhanced.

On the other hand, as can be clearly understood from FIG. 5, the above-mentioned extra time Tex corresponds time for outputting the image data of 1 line from the line memory in response to the above-mentioned horizontal clock CL1. In this embodiment, another or separate display signal is outputted to the pixel array one time by making use of this extra time Tex. Another display signal according to this embodiment is a so-called blanking signal B which decreases the brightness of the pixel to which another display signal is inputted to a level equal to or below the brightness before another display signal is not inputted to the pixel. For example, the brightness of the pixel which is displayed with a relatively high gray scale (white or bright gray color close to white in a monochromatic image display) before 1 frame period is decreased lower than the above-mentioned level in response to the blanking signal B. On the other hand, the brightness of the pixel which is displayed with a relatively low gray scale (black or dark gray color like charcoal gray close to black in a monochromatic image display) before 1 frame period is hardly changed even after inputting of the blanking signal B. This blanking signal B temporarily converts the image generated in the pixel array for every frame period into the dark image (blanking image). Due to such display operation of the pixel array, even with respect to a hold-type display device, the image display in response to the image data inputted to the display device for every frame period can be performed in the same manner as the image display of an impulse type display device.

By applying the above-mentioned driving method of the display device which repeats the first step in which N-line image data are sequentially outputted to the pixel array and the second step in which the blanking signal B is outputted to the pixel array M times to the hold-type display device, the image display due to the hold-type display device can be performed in the same manner as the image display due to the impulse-type display device. This driving method of the display device is applicable not only to the display device which has been explained in conjunction with FIG. 5 and includes the line memory having the capacity of at least N lines as the memory circuit 105 but also, for example, to a display device which replaces the memory circuit 105 with a frame memory.

Such a driving method of the display device is further explained in conjunction with FIG. 1. Although the operation of the display device in the above-mentioned first and second steps define outputting of the display signals using the data driver 102 in the display device 100 shown in FIG. 3, outputting of the scanning signals (selection of pixel rows) using the scanning driver 103 which is performed corresponding to outputting of the display signals is described as follows. In the explanation set forth hereinafter, "scanning signal" which is applied to the gate line (scanning signal line) 10 and selects the pixel row (a plurality of pixels PIX arranged along the gate line) corresponding to the gate line 10 indicates pulses (gate pulses) of the scanning signals which make the scanning signals respectively applied to the gate lines G1, G2, G3, . . . shown in FIG. 1 assume a High state. In the pixel array shown in FIG. 9, the switching element SW which is provided to the pixel PIX receives the gate pulse through the gate line 10 connected to the switching element SW and allows the display signal supplied from the data line 12 to be inputted to the pixel PIX.

During the period corresponding to the above-mentioned first step, for every outputting of the display signal corresponding to the N-line image data, the scanning signal which selects the pixel row corresponding to the Y line of gate line is applied to the Y line of gate line. Accordingly, the scanning signal is outputted N times from the scanning driver 103.

Such an application of the scanning signal is sequentially performed in the direction from one end (for example, an upper end in FIG. 3) to another end of the pixel array 101 (for example, a lower end in FIG. 3) every other Y lines of gate lines for the above-mentioned every outputting of the display signal. Accordingly, in the first step, the pixel rows corresponding to gate lines of (Y×N) lines are selected and the display signals generated based on the image data are supplied to respective pixel rows. FIG. 1 shows output timing (see the eye diagram of data driver output voltage) of the display signals when the value of N is set to 4 and the value of Y is set to 1 and waveforms of the scanning signals which are applied to respective gate lines (scanning lines) corresponding to the output timing. Here, the period of the first step corresponds to the data driver output voltage 1 to 4, 5 to 8, 9 to 12, . . . , 513 to 516, . . . respectively.

For the data drive output voltages 1 to 4, the scanning signal is sequentially applied to the gate lines G1 to G4. For the next data drive output voltages 5 to 8, the scanning signal is sequentially applied to the gate lines G5 to G8. After a lapse of further time, for the data drive output voltages 513 to 516, the scanning signal is sequentially applied to the gate lines G513 to G516. That is, outputting of scanning signals from the scanning driver 103 is sequentially performed in the direction that the address number (G1, G2, G3, . . . , G257, G258, G259, . . . , G513, G514, G515, . . . ) of the gate line 10 in the pixel array 101 is increased.

On the other hand, during the period corresponding to the above-mentioned second step, for every M-times outputting of the display signal, the scanning signal which selects the pixel rows corresponding to the Z-line of the gate lines is applied to the line of the gate lines as the blanking signal. Accordingly, the scanning signal is outputted M times from the scanning driver 103. The combination of gate lines (scanning lines) to which the scanning signal is applied for outputting of the scanning signal from the scanning driver 103 one time is not particularly limited. However, from a viewpoint of holding the display signal supplied to the pixel row in the first step and reducing a load applied to the data driver 102, it is preferable to sequentially apply the scanning signal to every other Z lines of gate lines for every outputting of the display signal. The application of the scanning signal to the gate lines in the second step is sequentially performed from one end of the pixel array 101 to another end of the pixel array 101 in the same manner as the first step. Accordingly, in the second step, the pixel rows corresponding to the gate lines consisting of (Z×M) lines are selected and the blanking signal is supplied to respective pixel rows.

FIG. 1 shows output timing of the blanking signals B in the second step which follows the first step when the value of M is set to 1 and the value of Z is set to 4 and waveforms of the scanning signals which are applied to respective gate lines (scanning lines) in response to the output timing. In the second step which follows the first step in which the scanning signal is sequentially applied to the gate lines G1 to G4, for outputting the blanking signal B one time, the scanning signal is sequentially applied to 4 gate lines ranging from G257 to G260. Then, in the second step which follows the first step in which the scanning signal is sequentially applied to the gate lines G5 to G8, for outputting of the blanking signal B one time, the scanning signal is sequentially applied to 4 gate lines ranging from G261 to G264. Further, in the second step which follows the first step in which the scanning signal is sequentially applied to the gate lines G513 to G516, for outputting the blanking signal B one time, the scanning signal is sequentially applied to 4 gate lines ranging from G1 to G4.

As described above, in the first step, the scanning signal is sequentially applied to four gate lines respectively, while in the second step, to apply the scanning signal to four gate lines collectively or simultaneously, for example, in response to outputting of the display signal from the data driver 102, it is necessary to match the operation of the scanning driver 103 to respective steps. As mentioned previously, the pixel array used in this embodiment has the resolution of WXGA class and gate lines consisting of 768 lines are juxtaposed to the pixel array. On the other hand, a group of four gate lines (for example, G1 to G4) which are sequentially selected in the first step and a group of four gate lines (for example, G257 to G260) which are sequentially selected in the second step which follows the first step are spaced apart from each other by the gate lines consisting of 252 lines along the direction that the address number of the gate lines 10 in the pixel array 101 is increased. Accordingly, the gate lines consisting of 768 lines which are juxtaposed in the pixel array are divided into three groups each consisting of 256 lines along the vertical direction thereof (extending direction of the gate lines) and the outputting operation of scanning signals from the scanning driver 103 is independently controlled for every group. To enable such a control, in the display device shown in FIG. 3, three scanning drivers 103-1, 103-2, 103-3 are arranged along the pixel array 101 and the outputting operation of scanning signals from respective scanning drivers 103-1, 103-2, 103-3 are controlled in response to the scanning state selection signals 114-1, 114-2, 114-3.

For example, when the gate lines G1 to G4 are selected in the first step and the gate lines G257 to G260 are selected in the second step which follows the first step, the scanning state selection signal 114-1 instructs the scanning driver 103-1 to assume a scanning state in which outputting of the scanning signal for sequentially selecting the gate line for continuous 4 pulses of the scanning clock CL3 one after another and stopping of outputting of the scanning signals for one pulse of the scanning clock CL3 which follows the outputting of the scanning signal are repeated. On the other hand, the scanning state selection signal 114-2 instructs the scanning driver 103-2 to assume a scanning state in which stopping of outputting of scanning signals for 4 continuous pulses of the scanning clock CL3 and outputting of scanning signals to the 4 line gate lines for 1 pulse of the scanning clock CL3 which follows the stopping of outputting. Further, the scanning state selection signal 114-3 makes the scanning clock CL3 inputted to the scanning driver 103-3 ineffective and stops outputting of the scanning signal initiated by the scanning clock CL3. The respective scanning drivers 103-1, 103-2, 103-3 are provided with two control signal transfer networks corresponding to the above-mentioned two instructions by the scanning state selection signals 114-1, 114-2, 114-3.

On the other hand, a waveform of a scanning start signal FLM shown in FIG. 1 includes two pulses which rise at points of time t1 and t2. A series of gate line selection operations in the above-mentioned first step are started in response to the pulse (described as pulse 1, hereinafter referred to as the first pulse) of the scanning start signal FLM which is generated at the point of time t1, while a series of gate line selection operations in the above-mentioned second step are started in response to the pulse of the scanning start signal FLM (described as pulse 2, hereinafter referred to as the second pulse) which is generated at the point of time t2. The first pulse of the scanning start signal FLM also responds to starting of inputting image data (defined by a pulse of the above-mentioned vertical synchronizing signal VSYNC) to the display device during 1 frame period. Accordingly, the first pulse and the second pulse of the scanning start signals FLM are repeatedly generated every frame period.

Further, by adjusting an interval between the first pulse of the scanning start signal FLM and the second pulse which follows the first pulse of the scanning start signal FLM or an interval between this second pulse and the pulse which follows the second pulse (for example, the first pulse of the next frame period), time for holding the display signal based on image data in the pixel array during 1 frame period can be adjusted. That is, the pulse interval including the first pulse and the second pulse generated on the scanning start signal FLM can take two different values (time widths) alternately. On the other hand, the scanning start signal FLM is generated by the display control circuit (timing controller) 104. From the above, the above-mentioned scanning state selection signals 114-1, 114-2, 114-3 can be generated in reference to the scanning start signal FLM in the display control circuit 104.

FIG. 1 shows the operation in which every time the image data shown in FIG. 1 are written 4 times in the pixel array for every 1 line, the blanking signal is written in the pixel array one time. As has been explained in conjunction with FIG. 5, such blanking signal writing operation is completed within time necessary for inputting the image data for 4 lines to the display device. Further, in response to the above-mentioned operation, the scanning signal is outputted to the pixel array 5 times. Accordingly, the horizontal period necessary for operating the pixel array becomes ⅘ of the horizontal scanning period of the video control signal 121. In this manner, inputting of the image data (display signals based on the image data) and the blanking signal to be inputted to the display device during 1 frame period to the whole pixels within the pixel array is completed within this 1 frame period.

The blanking signal shown in FIG. 1 generates the pseudo image data (hereinafter referred to as blanking data) in the display control circuit 104 and the peripheral circuit thereof. Here, the pseudo image data may be transferred to the data driver 102 and the blanking data may be generated in the data driver 102. Alternatively, a circuit which generates the blanking signal may be preliminarily formed in the data driver 102 and the blanking signal may be outputted to the pixel array 101 in response to a specific pulse of the horizontal clock CL1 transferred from the display control circuit 104.

In the former case, a frame memory is provided in the display control circuit 104 or in the vicinity of the display control circuit 104 and the pixel in which the blanking signal is to be strengthened based on the image data for every frame period (pixel displayed with high brightness due to the image data) stored in the frame memory is specified using the display control circuit 104, and the blanking data which makes the data driver 102 generate blanking signal which differs in darkness in response to the pixel may be generated.

In the latter case, the number of pulses of the horizontal clock CL1 is counted by the data driver 102 so as to make the data driver 102 output the display signal which enables the pixel display black or dark color close to black (for example, color such as charcoal gray) in response to the count number. At a portion of the liquid crystal display device, a plurality of gray scale voltages which determine the brightness of the pixels are generated by the display control circuit (timing converter) 104. In such a liquid crystal display device, a plurality of gray scale voltages are transferred by the data driver 102, the gray scale voltages corresponding to the image data are selected and are outputted to the pixel array by the data driver 102. In the same manner, the blanking signals may be generated by selection of the gray scale voltages in response to pulses of the horizontal clock CL1 due to the data driver 102.

The outputting manner of display signals to the pixel array and the outputting manner of scanning signals to respective gate lines (scanning lines) corresponding to the display signals according to the present invention shown in FIG. 1 are suitable for driving the display device having the scanning driver 103 which has a function of simultaneously outputting the scanning signal to a plurality of gate lines in response to the inputted scanning state selection signal 114. On the other hand, the image display operation according to the present invention can be performed without simultaneously outputting the scanning signal to a plurality of scanning lines to a plurality of scanning lines as explained above, by making the respective scanning drivers 103-1, 103-2, 103-3 sequentially output the scanning signals for every 1 line of the gate lines (scanning lines) for every pulse of the scanning clock CL3. The image display operation of this embodiment repeating to input the blanking data into 4 of pixel rows (the above-mentioned second step in which the blanking data is outputted one time) every time the image data of 4 lines are sequentially inputted to one of other pixel rows one after another thereof (the above-mentioned first step in which the image data are outputted four times) due to such operations of the scanning drivers 103 is explained in conjunction with respective output waveforms of the display signals and the scanning signals shown in FIG. 4.

The display device shown in FIG. 3 is referred in the same manner as FIG. 1 with respect to the driving method of the display device explained in conjunction with FIG. 4. Each scanning driver 103-1, 103-2, 103-3 includes 256 terminals for outputting the scanning signals. That is, each scanning driver 103 can output the scanning signals to gate lines consisting of 256 lines at maximum. On the other hand, the pixel array 101 (for example, the liquid crystal display panel) is provided with gate lines 10 consisting of 768 lines and pixel rows which correspond to the respectively gate lines. Accordingly, three scanning drivers 103-1, 103-2, 103-3 are sequentially arranged at one side of the pixel array 101 along the vertical direction (extending direction of the data lines 12 provided to the pixel array). The scanning driver 103-1 outputs the scanning signals to a group of gate lines G1 to G256, the scanning driver 103-2 outputs the scanning signals to a group of gate lines G257 to G512, and the scanning driver 103-3 outputs the scanning signals to a group of gate lines G513 to G768 so as to control the image display on the whole screen (whole region of the pixel array 101) of the display device 100.

The display device to which the driving method explained in conjunction with FIG. 1 is applied and the display device to which the driving method explained hereinafter in conjunction with FIG. 4 is applied are in common with respect to a point that they both have the above-mentioned arrangement of scanning drivers. Further, with respect to the provision that the waveform of the scanning start signal FLM includes the first pulse which starts outputting of a series of scanning signals which are served for inputting the image data to the pixel array and the second pulse which starts outputting of a series of scanning signals which are served for inputting the blanking data to the pixel array in every frame period, the driving method of the display device which is explained in conjunction with FIG. 1 and the driving method of the display device which is explained in conjunction with FIG. 4 are in common. Further, also with respect to the provision that the scanning driver 103 acquires the first pulse and the second pulse of the above-mentioned scanning start signal FLM in response to the scanning clock CL 3 and, thereafter, terminals (or a group of terminals) from which the scanning signals are to be outputted in response to the scanning clock CL3 are sequentially shifted in response to the acquisition of the image data or the blanking data into the pixel array, the driving method of the display device using the signal waveforms shown in FIG. 1 and the driving method of the display device using the signal waveforms shown in FIG. 4 are common.

However, the driving method of the display device of this embodiment which is explained in conjunction with FIG. 4 differs from the driving method of the display device which is explained in conjunction with FIG. 1 in the roles of the scanning state selection signals 114-1, 114-2, 114-3. In FIG. 4, respective waveforms of the scanning state selection signals 114-1, 114-2, 114-3 are indicated as DISP1, DISP2, DISP3. The scanning state selection signals 114, first of all, determine the output conditions of the scanning signals in the regions which the scanning state selection signals 114 control (a group of pixels corresponding to a group of gate lines G257 to G512 in case of DISP2, for example) in response to operational conditions applied to these regions.

In FIG. 4, in the period in which the data driver output voltages exhibit outputs of the display signals L513 to L516 in response to the image data of 4 lines (the above-mentioned first step in which the display signals L513 to L516 are outputted), the scanning signals are applied to the gate lines G513 to G516 from the scanning driver 103-3 corresponding to the pixel rows to which these display signals are inputted. Accordingly, the scanning state selection signal 114-3 which is transferred to the scanning driver 103-3 performs a so-called gate line selection for every 1 line which sequentially outputs the scanning signal for every 1 line of the gate lines G513 to G516 in response to the scanning clock CL3 (for every outputting of the gate pulse one time). Accordingly, the display signal L513 is supplied to the pixel rows corresponding to the gate line G513 over 1 horizontal period (defined by the pulse interval of the horizontal clock CL1). Then, the display signal L514 is supplied to the pixel rows corresponding to the gate line G514 over 1 horizontal period. Subsequently, the display signal L515 is supplied to the pixel rows corresponding to the gate line G515 over 1 horizontal period. Finally, the display signal L516 is supplied to the pixel rows corresponding to the gate line G516 over 1 horizontal period.

On the other hand, in the above-mentioned second step which follows the first step and in which these display signals L513 to L516 are sequentially outputted for every horizontal period (in response to the pulse of the horizontal clock CL1), the blanking signal B is outputted in 1 horizontal period which follows 4 horizontal periods corresponding to the first step. In this embodiment, the blanking signal B which is outputted between outputting of the display signal L516 and outputting of the display signal L517 is supplied to respective pixel rows corresponding to the group of gate lines G5 to G8. Accordingly, the scanning driver 103-1 is required to perform the so-called 4-line simultaneous gate-line selection which applies the scanning signal to all 4 lines of the gate lines G5 to G8 within the outputting period of the blanking signal B. However, in the display operation of the pixel array according to FIG. 4, as mentioned above, although the scanning driver 103 starts the application of scanning signal to only one gate line in response to the scanning clock CL3 (for the pulse generated one time), the scanning driver 103 does not start the application of scanning signal to a plurality of gate lines. That is, the scanning driver 103 does not simultaneously rise the scanning signal pulses for a plurality of gate lines.

Accordingly, the scanning state selection signal 114-1 transferred to the scanning driver 103-1 applies the scanning signal to at least (Z−1) lines out of Z lines of gate lines to which the scanning signal is to be applied before outputting the blanking signal B, and controls the scanning driver 103-1 such that the application time of the scanning signal (pulse width of the scanning signal) is prolonged to a period which is at least N times as long as the horizontal period. These variables Z, N are defined as the selection number: Z of gate lines in the second step and as the outputting number: N of display signals in the first step, which are described in the explanation of the first step for writing the image data to the pixel array and the second step for writing the blanking data to the pixel array.

For example, scanning signals are respectively applied to the gate lines G5 to G8 in the following manner. The scanning signal is supplied to the gate line G5 from an outputting start time of the display signal L514 over a period which is 5 times as long as the horizontal period. The scanning signal is supplied to the gate line G6 from an outputting start time of the display signal L515 over a period which is 5 times as long as the horizontal period. The scanning signal is supplied to the gate line G7 from an outputting start time of the display signal L516 over a period which is 5 times as long as the horizontal period. The scanning signal is supplied to the gate line G8 from an outputting completion time of the display signal L516 (start time for outputting the blanking signal B subsequent to the output period of the display signal L516) over a period which is 5 times as long as the horizontal period. That is, although the respective rising times of the gate pulses of a group of gate lines G5 to G8 due to the scanning driver 103 are sequentially shifted for every 1 horizontal period in response to the scanning clock CL3, by delaying the respective falling times of the respective gate pulses after N horizontal period of the rising time, all of the gate pulses of the groups of gate lines G5 to G8 are made to assume a state in which the gate pulses rise (High in FIG. 4) during the above-mentioned blanking signal outputting period. In controlling outputting of the gate pulses in this manner, it is preferable to make the scanning driver 103 have a shift resistor operational function. Here, hatching regions indicated in the gate pulses of the gate lines G1 to G12 in which the blanking signal is supplied to the corresponding pixel rows are explained later.

On the other hand, between this period (the above-mentioned first step in which the display signals L513 to L516 are outputted) and the second step which follows the first step, the display signals are not supplied to the pixel rows which correspond to the group of gate lines G257 to G512 which receive the scanning signals from the scanning driver 103-2. Accordingly, the scanning state selection signal 114-2 which is transferred to the scanning driver 103-2 makes the scanning clock CL3 ineffective for the scanning driver 103-2 during the period extending over the first step and the second step. Such an operation to make the scanning clock CL3 ineffective using the scanning state selection signal 114 is applicable at a given timing to a case in which the display signals and the blanking signals are supplied to the group of pixels within the region to which the scanning signals are outputted from the scanning driver 103 to which the scanning state selection signal 114-2 is transferred.

In FIG. 4, the waveform of the scanning clock CL3 corresponding to the scanning signal output from the scanning driver 103-1 is shown. Although the pulse of the scanning clock CL3 is generated in response to the pulse of the horizontal clock CL1 which defines an output of interval of the display signal and the blanking signal, the pulses are not generated at the output start time of the display signals L513, L517 . . . . In this manner, the operation to make the scanning clock C13 transferred to the scanning driver 103 from the display control circuit 104 ineffective at a specific time can be performed using the scanning state selection signal 114. The operation to make the scanning clock CL3 partially ineffective for the scanning driver 103 may be performed such that a signal processing path corresponding to the scanning clock CL3 is incorporated in the scanning driver 103 and the operation of the signal processing path may be started in response to the scanning state selection signal 114 transferred to the scanning driver 103. Here, although not shown in FIG. 4, the scanning driver 103-3 which controls writing of the image data to the pixel array also becomes dead for the scanning clock LC3 at the outputting start time of the blanking signal B. Accordingly, it is possible to prevent the scanning driver 103-3 from erroneously supplying the blanking signal to the pixel rows to which the display signals based on the image data are supplied in the first step which follows the second step due to outputting of the blanking signal B.

Next, the scanning state selection signals 114 make the pulses of the scanning signals (gate pulses) which are sequentially generated in the regions which the scanning state selection signals 114 respectively control ineffective at a stage in which the gate pulses are outputted to the gate lines. This function, in the driving method of the display device shown in FIG. 4, makes the scanning state selection signal 114 transferred to the scanning driver 103 concerned with the signal processing inside the scanning driver 103 which supplies the blanking signal to the pixel array. Three waveforms DISP1, DISP2, DISP3 shown in FIG. 4 show those of the scanning state selection signals 114-1, 114-2, 114-3 which are concerned with the signal processing inside the respective scanning drivers 103-1, 103-2, 103-3. When these waveforms DISP1, DISP2, DISP3 are at Low-level, outputting of the gate pulse becomes effective. Further, the waveform DISP1 of the scanning state selection signal 114-1 assumes the High-level during the period in which the display signals are outputted to the pixel array in the above-mentioned first step so as to make outputting of the gate pulse generated by the scanning driver 103-1 during this period ineffective.

For example, the gate pulses which are generated on the scanning signals respectively corresponding to the gate lines G1 to G7 during 4 horizontal periods in which the display signals L513 to L516 are supplied to the pixel array have respective outputs thereof made ineffective as indicated by hatching in response to the scanning state selection signal DISP1 which assumes the High-level during this period. Accordingly, it is possible to prevent the display signals based on the image data from being erroneously supplied to the pixel rows to which the blanking signals are to be supplied during a certain period. And hence, the blanking display due to these pixel rows (erasing of images displayed in these pixel rows) can be surely performed and, at the same time, the loss of intensity of the display signals based on the image data per se can be prevented. Further, during 1 horizontal period which outputs the blanking signal B and is arranged between 4 horizontal periods which output the display signals L513 to L516 and next 4 horizontal periods which output the display signals L517 to L520, the scanning state selection signal DISP1 assumes the Low-level. Accordingly, the gate pulses which are generated on the scanning signals corresponding to respective gate lines G5 to G8 during these periods are collectively outputted to the pixel array, the pixel rows corresponding to these gate lines consisting of 4 lines are simultaneously selected, and the blanking signals B are supplied to the respective pixel rows.

As described above, in the display operation of the display device shown in FIG. 4, based on the scanning state selection signals 114, it is possible to determine not only the operational state of the scanning driver 103 to which the scanning state selection signal 114 is transferred (the operational state of either one of the above-mentioned first step and the above-mentioned second step or the non-operational state which depends on neither of them) but also the validity of outputting of the gate pulses generated by the scanning driver 103 in response to these operational states. Here, a series of controls of the scanning driver 103 (outputting of scanning signals from the scanning driver 103) based on these scanning state selection signals 114 are started from outputting the scanning signal to the gate line G1 in response to the scanning start signal FLM with respect to both of writing the display signals based on the image data to the pixel array and writing of the blanking signals.

FIG. 4 mainly shows the line selection operation (4 line simultaneous selection operation) of the gate lines using the scanning driver 103 which is sequentially shifted by the scanning state selection signal DISP1 in response to the above-mentioned second pulse of the scanning start signal FLM. Although not shown in FIG. 4, due to the operation of the display device in response to the scanning state selection signal DISP1, the selection operation of gate line for every 1 line using the scanning driver 103 is sequentially shifted in response to the first pulse of the scanning start signals FLM. Accordingly, also in the operation of the display device shown in FIG. 4, it is necessary to start scanning of two types of the pixel arrays one time for each in response to the scanning start signal FLM for every frame period and hence, as the waveform of the scanning start signal FLM, the first pulse and the second pulse which follows the first pulse appear.

In both of the above-mentioned driving methods of the display device shown in FIG. 1 and FIG. 4, the number of the scanning drivers 103 which are arranged along one side of the pixel array 101 and the number of scanning state selection signals 114 which are transmitted to the scanning drivers 103 can be changed without changing the structure of the pixel array 101 which has been explained in conjunction with FIG. 3 and FIG. 9, wherein respective functions which are shared by three scanning drivers 103 may be collectively held by one scanning driver 103 (for example, the inside of the scanning driver 103 is divided into circuit sections respectively corresponding to the above-mentioned three scanning drivers 103-1, 103-2, 103-3).

FIG. 6 is a timing chart showing image display timing of a display device of this embodiment over three continuous frame periods. At the beginning of each frame period, writing of image data from the first scanning line (corresponding to the above-mentioned gate line G1) to the pixel array is started in response to the first pulse of the scanning start signal FLM. After a lapse of time: Δt1 from this point of time, writing of blanking data from the first scanning line to the pixel array is started in response to the second pulse of the scanning start signal FLM. Further, after a lapse of time: Δt2 from the point of time that the second pulse of the scanning start signal FLM is generated, writing of image data to be inputted to the display device to the pixel array in the next frame period is started in response to the first pulse of the scanning start signal FLM. Here, in this embodiment, time: Δt1' shown in FIG. 6 is equal to the time: Δt1 and time: Δt2' shown in FIG. 6 is equal to time Δt2.

With respect to the advance of writing of image data to the pixel array and the advance of writing of the blanking data, although they differ in the number of lines (the former: 1 line the latter: 4 lines) of gate lines which they select during 1 horizontal period, these writings advance substantially equally with respect to a lapse of time. Accordingly, irrespective of positions of the scanning lines in the pixel array, the period that the pixel rows which correspond to respective scanning lines hold display signals based on the image data (substantially covering the above-mentioned time: including time for receiving the display signals) and the period in which the pixel rows hold the blanking signal (substantially covering the above-mentioned time: Δt2 including time for receiving the blanking signal) become substantially uniform over the vertical direction of the pixel array. That is, the irregularities of display brightness between the pixel row (along the vertical direction) in the pixel array can be suppressed.

In this embodiment, 67% and 33% of 1 frame, are respectively allocated to the display period of the image data in the pixel array and the display period of the blanking data as shown in FIG. 6, and the timing adjustment of the scanning start signal FLM corresponding to the allocation of frame period is performed (the above-mentioned times Δt1 and Δt2 are adjusted). However, by changing the timing of the scanning start signal FLM, the display period of the image data and the display period of the blanking data can be suitably changed.

One example of the brightness response of the pixel rows when the display devices is operated at the image display timing shown in FIG. 6 is shown in FIG. 7. In this brightness response, a liquid crystal display panel which has the resolution of WXGA class and is operated in the normally black display mode is used as the pixel array 101 shown in FIG. 3, and display ON data which display the pixel rows in white are written in the pixel rows as the image data, while display OFF data which display the pixel rows in black are written in the pixel rows as the blanking data. Accordingly, the brightness response shown in FIG. 7 shows the change of optical transmissivity of the liquid crystal layer corresponding to the pixel rows of the liquid crystal display panel.

As shown in FIG. 7, pixel rows (each pixel included in these pixel rows), during 1 frame period, respond to the brightness corresponding to the image data first of all and, thereafter, respond to the black brightness. Although the optical transmissivity of the liquid crystal layer responds to the change of an electric field applied to the liquid crystal layer relatively gradually, as clearly understood from FIG. 7, the value of optical transmissivity sufficiently responds to the electric field corresponding to the image data for every frame period and an electric field corresponding to the blanking data. Accordingly, with respect to an image due to image data generated on the screen (pixel rows) during the frame period, the image is sufficiently erased from the screen (pixel rows) within the frame period and hence, the image is displayed in the same state as an impulse type display device. Due to such an impulse-type response of the image based on the image data, blurring of animated image which is generated on the image can be reduced. Such an advantageous effect can be obtained in the same manner by changing the resolution of the pixel array or by changing the rate of retracing period in the horizontal period of the driver data shown in FIG. 2.

In the above-mentioned embodiment, in the first step, the display signals which are generated for every 1 line of image data are sequentially outputted to the pixel array four times and are respectively sequentially supplied to the pixel row corresponding to 1 line of the gate lines, and in the succeeding second step, the blanking signals are sequentially outputted to the pixel array one time and are supplied to the pixel rows corresponding to 4 lines of gate lines. However, the outputting number: N (this value also corresponding to the number of line data written in the pixel array) of the display signals in the first step is not limited to 4, while the outputting number: M of the blanking signals in the second step is not limited to 1. Further, the line number: Y of the gate lines to which the scanning signals (selection pulses) are applied for one-time outputting of the display signals in the first step is not limited to 1, while the line numbers: Z of the gate lines to which the scanning signal is applied for one-time blanking signal output in the second step is not limited to 4. These factors N, M are required to be natural numbers which satisfy the condition that M<N and N is required to be 2 or more. Further, it is also required that the factor Y is a natural number smaller than N/M and the factor Z is a natural number equal to or greater than N/M. Still further, 1 cycle in which N-time display signal outputting and M-time blanking signal outputting are performed is completed within a period in which N-line image data are inputted to the display device. That is, the value which is (N+M) times as large as the horizontal period in the operation of the pixel array is set to a value equal to or smaller than the value which is N times as large as the horizontal scanning period in inputting of the image data to the display device. The former horizontal period is defined by the pulse interval of the horizontal clock CL1, while the latter horizontal scanning period is defined by the pulse interval of the horizontal synchronizing signal HSYNC which constitutes one of the video control signals.

According to such operational conditions of the pixel array, during the period Tin in which N-line image data are inputted to the display device, the (N+M) times signal outputting from the data driver 102 is performed, that is, the pixel array operation of 1 cycle consisting of the first step and second step which follows the first step is performed. Accordingly, time (referred to as Tinvention hereinafter) allocated respectively to outputting of display signals and outputting of blanking signals in this one cycle is reduced to a value which is (N/(N+M)) times as large as the time (Tprior) necessary for outputting signal one time for sequentially outputting the display signal corresponding to the N-line image data during the period Tin.

However, since the factor M is the natural number smaller than N, according to the present invention, the outputting period Tinvention of the present invention in which signals during 1 cycle are outputted can ensure a length which is equal to or longer than ½ of the above-mentioned Tprior. That is, from a viewpoint of writing the image data to the pixel array, an advantageous effect described in the above-mentioned SID 01 Digest, pages 994 to 997 is obtained against a technique described in the above-mentioned Japanese Unexamined Patent Publication 2001-166280.

Further, according to the present invention, by supplying the blanking signals to the pixels during the period Tinvention, it is possible to rapidly lower the brightness of the pixel. Accordingly, compared to the technique described in SID 01 Digest, pages 994 to 997, according to the present invention, the video display period and the blanking display period of each pixel row during 1 frame period can be clearly divided and hence, the motion blur can be efficiently reduced. Further, in the present invention, although the supply of the blanking signals to the pixels is performed intermittently for every (N+M) times, the blanking signals can be supplied to the pixel row corresponding to Z-line gate lines with respect to 1-time blanking signal outputting and hence, the irregularities of ratio between the video display period and the blanking display period which is generated between the pixel rows can be suppressed. Further, by sequentially applying the scanning signal to the gate line every other Z line of the gate lines for every outputting of the blanking signal, the load for one-time outputting of the blanking signal from the data driver 102 can be also reduced due to the restriction on the number of pixel rows to which the blanking signal is supplied.

Accordingly, the driving of the display device according to the present invention is not limited to the example which has been explained in conjunction with FIG. 1 to FIG. 7 and in which N is set to 4, M is set to 1 an Z is set to 4. So long as the above-mentioned conditions are satisfied, the driving method of the display device according to the present invention is universally applicable to the whole driving of the hold-type display device. For example, when the image data are inputted to the display device in an interlace method through either one of odd-numbered lines and even-numbered lines for every frame period, by applying the image data of the odd-numbered lines or the even-number lines sequentially to every 1 line thereof and the scanning signals sequentially to every 2 lines of gate lines, the display signals may be supplied to the pixel rows corresponding to the two lines of the gate lines (in this case, at least the above-mentioned factor Y assuming 2). Further, in the driving of the display device according to the present invention, the frequency of the horizontal clock CL1 is set to a value which is ((N+M)/N) times (1.25 times in the examples shown in FIG. 1 and FIG. 4) as large as the frequency of the horizontal synchronizing signal HSYNC. However, the frequency of the horizontal clock CL1 may be increased further so as to narrow the pulse interval and to ensure the operational margin of the pixel array. In this case, a pulse oscillation circuit may be provided to or in the vicinity of the display control circuit 104 and hence, the frequency of the horizontal clock CL1 may be increased in conjunction with the reference signal having frequency higher than a dot clock DOTCLK included in the video control signals generated by the pulse oscillation circuit.

With respect to the above-mentioned respective factors, the factor N may preferably be set to the natural number of 4 or more, while the factor M may preferably be set to 1. Further, the factor Y may preferably take the equal value as the factor M, while the factor Z may preferably take the equal value as the factor N.

<<Second Embodiment>>

Also in this embodiment, in the same manner as the above-mentioned first embodiment, with respect to the image data which are inputted to the display device shown in FIG. 3 at the timing shown in FIG. 2, the display signals and the scanning signals are outputted from the data driver 102 with the waveforms shown in FIG. 1 or FIG. 4 and the display is performed in accordance with the display timing shown in FIG. 6. However, in this embodiment, the output timing of the blanking signals with respect to the outputting of the display signals based on the image data shown in FIG. 1 and FIG. 4 is changed every frame period as shown in FIG. 8.

Figure 8:
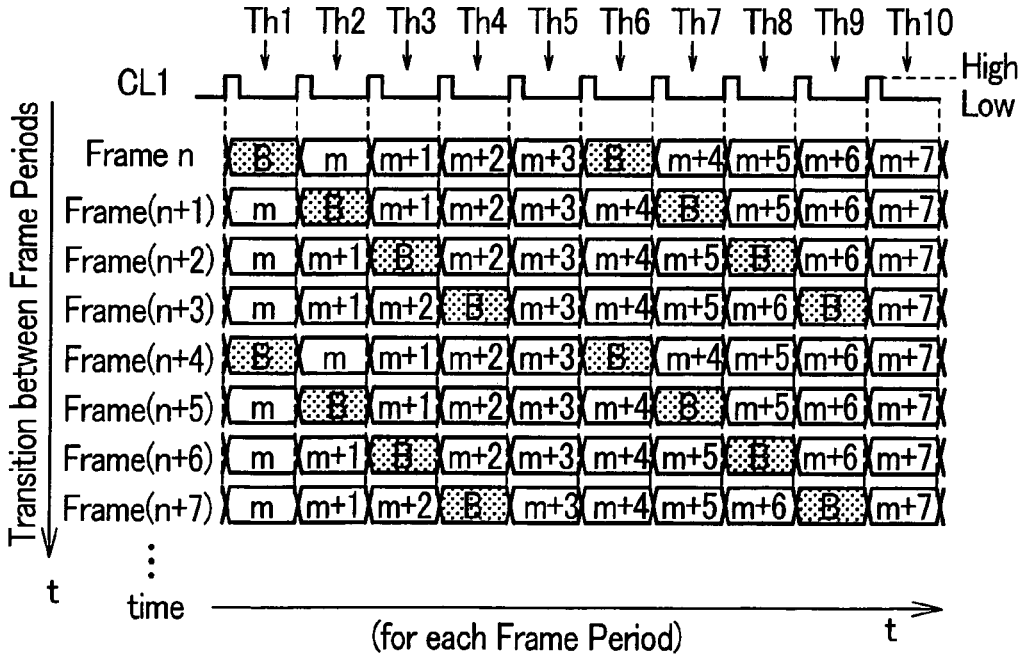
FIG. 8 is a view showing the change of display signals (m, m+1, m+2, based on image data and B based on a blanking signal) supplied to respective pixel rows corresponding to gate lines G1, G2, G3, . . . over a plurality of continuous frame periods m, m+1, m+2, . . . explained as the second embodiment of the driving method of the liquid crystal display device according to the present invention.

In the display device using the liquid crystal display panel as the pixel array, the output timing of the blanking signals of this embodiment shown in FIG. 8 has an advantageous effect that the influence of rounding of waveforms of the signals generated in the data lines of the liquid crystal display panel to which the blanking signals are supplied can be dispersed whereby the display quality of the image can be enhanced. In FIG. 8, periods Th1, Th2, Th3, . . . which respectively correspond to pulses of the horizontal clock CL1 are sequentially arranged in the lateral direction and, in any one of these periods, eye diagrams each of which includes the display signal m, m+1, m+2, m+3, . . . for every 1 line of the image data outputted from the data driver 102 and the blanking signal B are sequentially arranged in the longitudinal direction for every one of continuous frame periods n, n+1, n+2, n+3, . . . . The display signals m, m+1, m+2, m+3 described in this embodiment are not limited to the image data of specific lines and, for example, can be used as the display signals L1, L2, L3, L4 as well as the display signals L511, L512, L513, L514 in FIG. 1.

Every time the image data are written in the pixel array four times in the manner explained in conjunction with the first embodiment, the blanking data are written in the pixel array one time. In this case, terms for applying the blanking data to the pixel array shown in FIG. 8 are sequentially changed for every frame from any one of group of periods which are arranged every 4 other periods in the above-mentioned periods Th1, Th2, Th3, Th4, Th5, Th6, . . . (for example, a group consisting of the periods Th1, Th6, Th12, . . . ) to another group of the periods (for example, a group consisting of periods Th2, Th7, Th13, . . . ). For example, in the frame period n, before inputting the mth line data into the pixel array (before applying the display signal based on the mth line data to the mth pixel row), the blanking data are inputted to the pixel array (the blanking data is applied to the pixel row corresponding to the given 4 lines of the gate lines). In the frame period n+1, after inputting the mth line data into the pixel array and before inputting the display signal based on the (m+1)th line data to the pixel array, the above-mentioned blanking data are inputted to the pixel array. Inputting of the (m+1)th line data to the pixel array follows that of the mth line data and the display signal based on the (m+1)th line data is applied to the (m+1)th pixel row. In succeeding inputting of respective line data to the pixel array, the display signal based on the line data is applied to the pixel row having the same address (order) as the line data.

In the frame period n+2, after inputting the (m+1)th line data into the pixel array and before applying the display signal based on the (m+2)th line data to the pixel array, the blanking data are inputted to the pixel array. In the subsequent frame period n+3, after inputting the (m+2)th line data into the pixel array and before inputting the display signal based on the (m+3)th line data to the pixel array, the blanking data are inputted to the pixel array. Thereafter, such inputting of the line data and the blanking data to the pixel array is repeated by shifting or deviating the timing of the blanking data every 1 horizontal period and, in the frame period n+4, the inputting returns to the input pattern of the line data and the blanking data to the pixel array in the frame period n. By repeating a series of operations, the influence of the rounding of the signal waveforms which are generated along the extending direction of data line when not only the blanking signal but also the display signal based on the line data are outputted to respective data lines of the pixel array can be uniformly dispersed so that the quality of image displayed on the pixel array can be enhanced.

Also in this embodiment, in the same manner as the first embodiment, the display device can be operated at the image display timing shown in FIG. 6. In this embodiment, however, since the timing for applying the blanking signal to the pixel array is shifted every frame period as mentioned above, a point of time for generating the second pulse of the scanning start signal FLM which starts scanning of the pixel array by the blanking signal is deviated corresponding to the frame period. Corresponding to the change of the second pulse generating timing of the scanning start signal FLM, the time: Δt1 indicated in the frame period 1 in FIG. 6 becomes the time: Δt1' which is shorter (or longer) than the time: Δt1 in the succeeding frame period 2, and the time: Δt2 indicated in the frame period 1 becomes the time: Δt2' which is longer (or shorter) than the time: Δt2 in the succeeding frame period 2. To consider "the deviation" of the scanning start time of the pixel array on the display signals based on the line data m which is observed between a pair of frame periods n and n+1 and between another pair of frame periods n+3 and n+4 shown in FIG. 8, in this embodiment, at least one of two time intervals: Δt1, Δt2 corresponding to the pulse interval of the scanning start signal FLM is changed in response to the frame period.

As described above, when the display operation is performed following the image display timing shown in FIG. 6 in accordance with the driving method of the display device according to this embodiment which shifts the outputting period of blanking signal along the time axis direction for every frame period, some change is necessary in setting the scanning start signal. However, the advantageous effects obtained by this embodiment are almost comparable to the advantageous effects obtained by the first embodiment shown in FIG. 7. Accordingly, also in this embodiment, the image corresponding to the image data can be displayed on the hold-type display device substantially in the same manner as the impulse-type display device. Further, compared to the hold-type pixel array, the animated images do not damage the brightness and hence, it is possible to perform the display by reducing the motion blur generated in the animated image. Also in this embodiment, the ratio between the display period of image data and the display period of blanking data during 1 frame period can be suitably changed by adjusting the timing of the scanning start signal FLM (for example, the distribution of the above-mentioned pulse intervals: Δt1, Δt2). Further, the applicable range of the driving method of this embodiment to the display device is not limited, as in the case of the driving method of the first embodiment, by the resolution of the pixel array (for example, liquid crystal display panel). Still further, in the display device according to this embodiment, in the same manner as the display device of the first embodiment, by suitably changing the ratio of retracing period included in the horizontal period defined by the horizontal clock CL1, the outputting number: N of display signals in the first step and the line number: Z of the gate lines selected by the second step can be increased or decreased.

<<Third Embodiment>>

Figure 10:
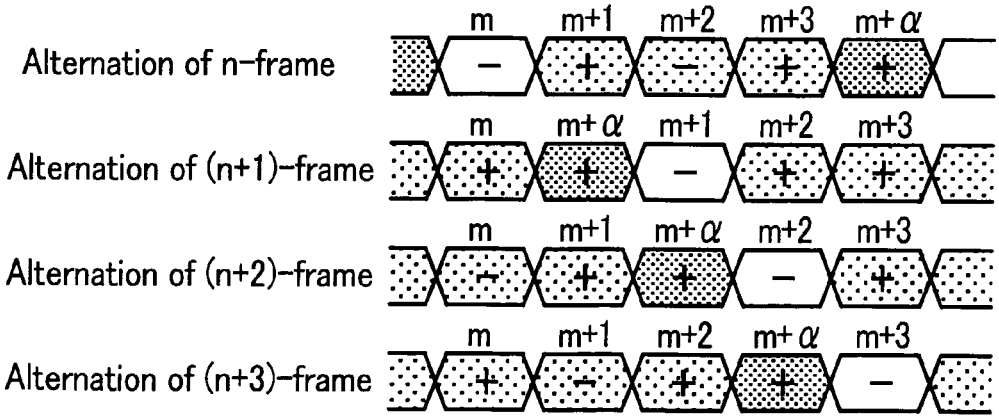
FIG. 10 is a view showing the change of display signals (m, m+1, m+2, based on image data and B based on blanking signal) supplied to respective pixel rows corresponding to gate lines G1, G2, G3, . . . in the dot inversion driving over a plurality of continuous frame periods m, m+1, m+2, . . . explained as the third embodiment of the driving method of the liquid crystal display device according to the present invention.
Figure 11:
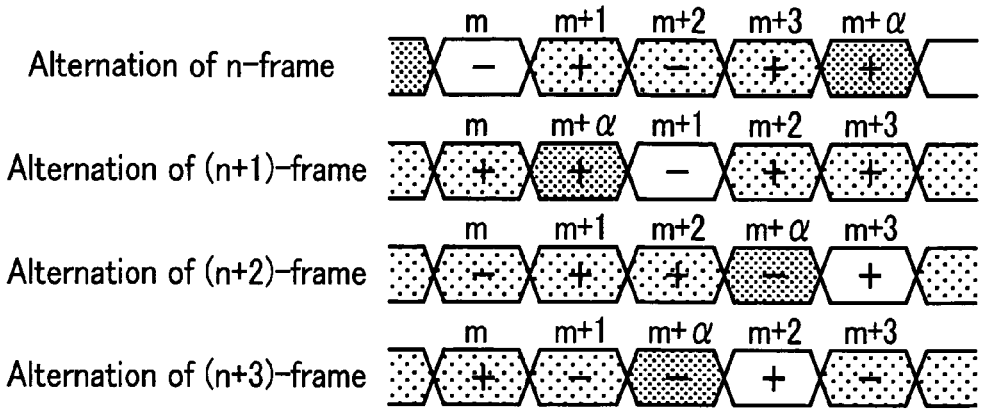
FIG. 11 is a view depicting another mode of the driving method shown in FIG. 10 after a waveform diagram shown in FIG. 10.

FIG. 10 is a view which shows another embodiment of the liquid crystal display device according to the present invention and corresponds to FIG. 8.

That is, in the same manner as FIG. 8, FIG. 10 also shows the change of display signals, wherein the display signals and the scanning signals are outputted from the data driver 102 with waveforms shown in FIG. 1 or FIG. 4 in accordance with the display timing shown in FIG. 6. In this embodiment, however, the output timing of the blanking signals with respect to outputting of the display signals based on the image data shown in FIG. 1 or FIG. 4 is changed for every frame period. Moreover, waveform of the scanning signal CL1 is omitted in FIG. 10.

In this case, the blanking signal B which is included in the N-time display signals which are sequentially outputted are not juxtaposed in the direction orthogonal to a time axis and have their output timing shifted or deviated from each other. That is, as shown in FIG. 8, with respect to the periods Th1, Th2, Th3, which respectively correspond to pulses of the horizontal clock CL1, the blanking signal of the n-frame is allocated to the period Th1, the blanking signal of the (n+1)-frame is allocated to the period Th3, the blanking signal of the (n+2)-frame is allocated to the period Th4 and, further, the blanking signal of the (n+3)-frame is allocated to the period Th5.

That is, in any one of the above-mentioned periods Th1, Th2, Th3 . . . , the blanking signal B which is included in the above-mentioned sequentially outputted N-time display signals is present by only one. In other words, the blanking signal B is outputted at different times from each other in the display of respective frames by shifting time.

Then, as the constitution which is not shown in FIG. 8, the above-mentioned display signals are subjected to so-called alternation. That is, in FIG. 10, with respect to the n-frame display signal, the image data of respective lines from m to m+3 which are outputted between the blanking signal B and the next blanking signal B, the polarity thereof is converted such that a − polarity thereof is given to the m line, a + polarity thereof is given to the m+1 line, a − polarity thereof is given to the m+2 line, and a + polarity thereof is given to the m+3 line.

Here, − polarity in m line means that the polarity is headed by − polarity and then is sequentially changed in order of +, −, +, −, . . . in accordance with pixel unit in the line direction. + polarity in m+1 line means that the polarity is headed by + polarity and then is sequentially changed in order of −, +, −, +, . . . in accordance with pixel unit in the line direction. − polarity in m+2 line means that the polarity is headed by − polarity and then is sequentially changed in order of +, −, +, −, . . . in accordance with pixel unit in the line direction. + polarity in m+3 line means that the polarity is headed by + polarity and then is sequentially changed in order of −, +, −, +, . . . in accordance with pixel unit in the line direction.

Further, the fact that polarity is + in each pixel means that the voltage applied to the pixel electrode PX assumes a positive polarity with respect to the counter electrode CT, while the fact that polarity is − in each pixel means that the voltage applied to the pixel electrode PX assumes a negative polarity with respect to the counter electrode CT.

Accordingly, when the polarity of a certain pixel assumes +, the polarity of other neighboring pixels in the row direction and other neighboring pixels in the column direction assumes −, while when the polarity of a certain pixel assumes −, the polarity of other neighboring pixels in the row direction and other neighboring pixels in the column direction assumes +, whereby the so-called alternation of dot inversion is realized.

Such change of polarity is performed in the same manner also with respect to the blanking signal B. However, it is important that the polarity of a certain blanking signal B assumes the polarity opposite to the polarity of the image data to be outputted next to the blanking signal B. That is, in FIG. 10, although the polarity of the blanking signals B which are arranged by shifting the output timing for every frame period is set to + by a chance, the polarity of the image data which are outputted next to the respective blanking signals B is set to −.

FIG. 11 to FIG. 33 are views showing other embodiments of the driving method of the liquid crystal display device respectively and correspond to FIG. 10.

In all these drawings, as mentioned above, the blanking signals B are not juxtaposed in the direction orthogonal to the time axis and the output timing thereof is shifted or deviated along the time axis so as to perform the so-called dot inversion driving. At the same time, the cases shown in these drawings satisfy the condition that the polarity of the blanking signal B assumes the polarity opposite to the polarity of the image data to be outputted next to the blanking signal B.

That is, in respective cases shown FIG. 11 to FIG. 33, compared to the case shown in FIG. 10, the blanking signal B in each frame is made different with respect to the blanking data B of another frame in the deviation of time and the polarity of the blanking signal B also differs accordingly.

However, this embodiment is equal to other embodiments with respect to the point that the polarities of the image data are allocated such that all of them can perform the dot inversion driving and hence, the polarity of each blanking signal B is set to the polarity opposite to the polarity of the image data to be outputted next to the blanking signal B.

The driving method of each liquid crystal display device shown in the third embodiment aims at, on the premise that the so-called dot inversion driving is performed, the further enhancement of the display quality by shifting or deviating the output timing of the blanking signal B for every frame period. To be more specific, the driving method of each liquid crystal display device shown in the third embodiment aims at minimizing lateral stripes which are relatively brighter than the background in display and can be observed by naked eyes.

Figure 34A:
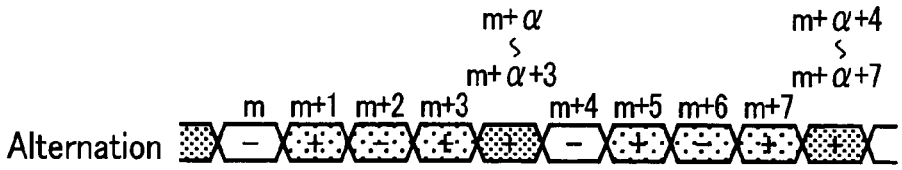
FIG. 34 is an explanatory view showing a drawback when blanking signals are outputted without generating the time deviation for every changeover of frames with respect to the third embodiment, wherein FIG. 34(*a*) shows an output of the display signal along a lapse of time during 1 frame period, FIG. 34(*b*) shows polarities of voltages applied to respective pixels of a liquid crystal display panel by supplying display signals shown in FIG. 34(*a*), and FIG. 34(*c*) shows bright lateral stripes generated on a screen of the liquid crystal display panel to which display signals (image data, blanking signals) are supplied in order shown in FIG. 34(*a*)
Figure 34B:
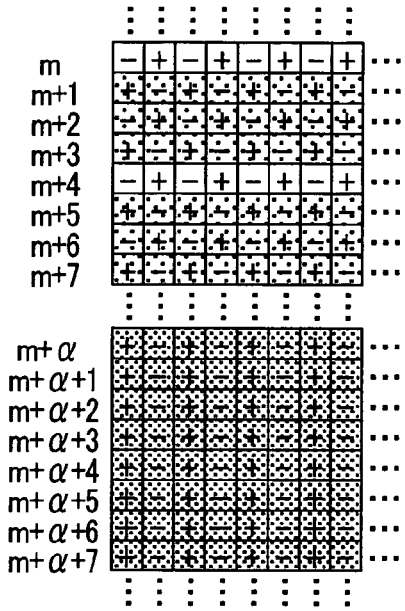
Figure 34C:
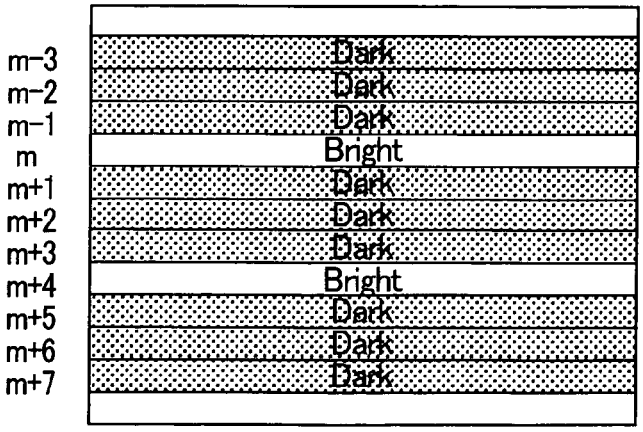

FIG. 34 shows a drawback when the so-called dot inversion driving is performed, wherein the blanking signals B are included in the display signals, and the blanking signals B are inserted at the same timing for every frame.

First of all, FIG. 34(*a*) shows the case that the display signals are outputted along a lapse of time in 1 frame such that m-line image data come next to the blanking signal B, then, (m+1)-line image data, (m+2)-line image data, (m+3)-line image data, and the next planking signal B, (m+4)-line image data, . . . are outputted. Then, although not shown in the drawing, the same goes for 2 frame and succeeding frames, wherein respective blanking signals B are arranged in the direction orthogonal to the axis of time. That is, in the changeover of respective frames, the blanking signals B are outputted at the same timing for every frame.

In this case, the respective image data change polarities thereof for every line or for every pixel on the line. For example, although the polarity of the image data on the m line is described as – in FIG. 34, this – polarity indicates the polarity of the first pixel on the m-line.

Further, in this case, the polarity of each blanking signal B assumes the polarity opposite to the polarity of the image data to be outputted next to the blanking signal B.

Further, FIG. 34(*b*) is a plan view of the polarities of voltages applied to respective pixels of a liquid crystal display panel when the display signals shown in FIG. 34(*a*) are supplied to the liquid crystal display panel.

The m-line image data, the (m+1)-line image data, the (m+2)-line image data and the (m+3)-line image data shown in FIG. 34 are respectively written in the m-line (row), the (m+1)-line (row), the (m+2)-line (row) and the (m+3)-line (row) in FIG. 34(*b*). In this case, with respect to respective pixels of the m-line (row), the polarities are determined sequentially in order of +, –, +, –, . . . to the right in the drawing after being headed by the – polarity given to a portion of the image data of the m-line in FIG. 34(*a*). In the same manner, with respect to respective pixels of the (m+1)-line (row), the polarities are determined sequentially in order of –, +, –, +, . . . to the right in the drawing after being headed by the + polarity given to a portion of the image data of the (m+1)-line in FIG. 34(*a*).

Then, the blanking signals B which are outputted next to the above-mentioned respective image data are simultaneously written in the (m+α) line (row), the (m+α+1) line (row), the (m+α+2) line (row) and the (m+α+3) line (row) in FIG. 34(*b*).

As can be clearly understood from FIG. 34(*b*), the polarities of the respective pixels to which the blanking signals B are supplied (for example, the polarities of respective pixels in the (m+α) to (m+α+3) rows in the drawing) are made different from each other in the direction of the video lines (the direction orthogonal to the scanning lines) with respect to respective pixels to which the display signals of 1 line are supplied after outputting the blanking signals B (for example, polarities of respective pixels in the (m+4) row in the drawing).

Figure 35:
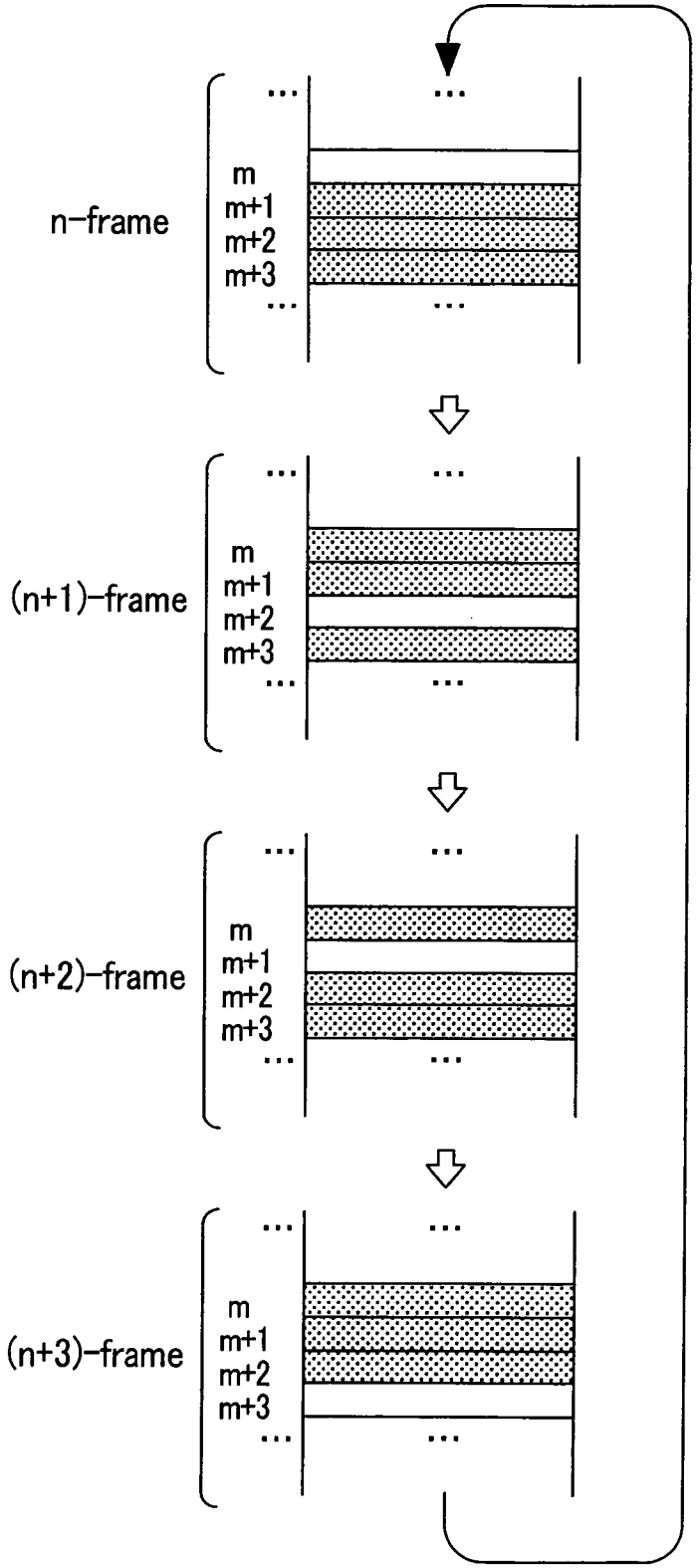
FIG. 35 is a view showing a written state of pixels of respective frames of display signals (m, m+1, m+2, . . . derived from image data, B derived from blanking data) of the third embodiment.

On a display surface of the liquid crystal display panel having such a constitution, as shown in FIG. 34(*c*), on lines after supplying the blanking signal B, that is, on the m-line (row) and the (m+4)-line (row), the line-shaped lateral stripes which are relatively brighter than the background are displayed. Since the display of the lateral stripes does not change positions thereof even in subsequent frames, the lateral stripes are observed with naked eyes. In view of the above, in this third embodiment, as in the case of respective modes shown in FIG. 10 to FIG. 33, the blanking signals B which are included in the sequentially outputted N-times display signals have outputting timing thereof shifted or deviated at different times without being juxtaposed in the direction orthogonal to the time axis. FIG. 35 shows the positions of lateral stripes in a line shape in respective frames when the blanking signals B which are included in the sequentially outputted N-times display signals have outputting timing thereof shifted or deviated at different times without being juxtaposed in the direction orthogonal to the time axis.

FIG. 35 shows that the lateral stripe in a line shape is displayed on the m-line in the n-frame display, the lateral stripe in a line shape is displayed on the (m+2)-line in the (n+1)-frame display, the lateral stripe in a line shape is displayed on the (m+1)-line in the (n+2)-frame display, and the lateral stripe in a line shape is displayed on the (m+3)-line in the (n+3)-frame display. In such a case, the lateral stripe in a line shape does not stay on the same line and moves to other line when the frames are changed over and hence, the lateral stripe is hardly observed with naked eyes and is displayed in an unnoticeable manner.

Next, the reason that the polarity of each blanking signal B is set opposite to the polarity of the image data outputted next to the blanking signal B in such driving is explained.

Figure 36A:
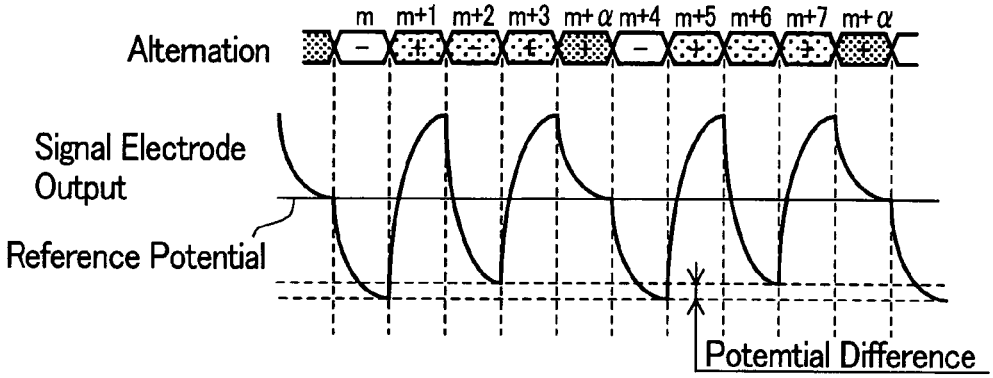
FIG. 36 is a view showing driving waveforms of image data when the polarity of each blanking signal B is set to a polarity opposite to the polarity of image data to be outputted next to the blanking signal, wherein FIG. 36(*a*) shows a voltage waveform when the blanking signal of positive (+) polarity is outputted immediately before the image data of negative (−) polarity, and FIG. 36(*b*) shows a voltage waveform when the blanking signal of negative (−) polarity is outputted immediately before the image data of positive (+) polarity.
Figure 36B:
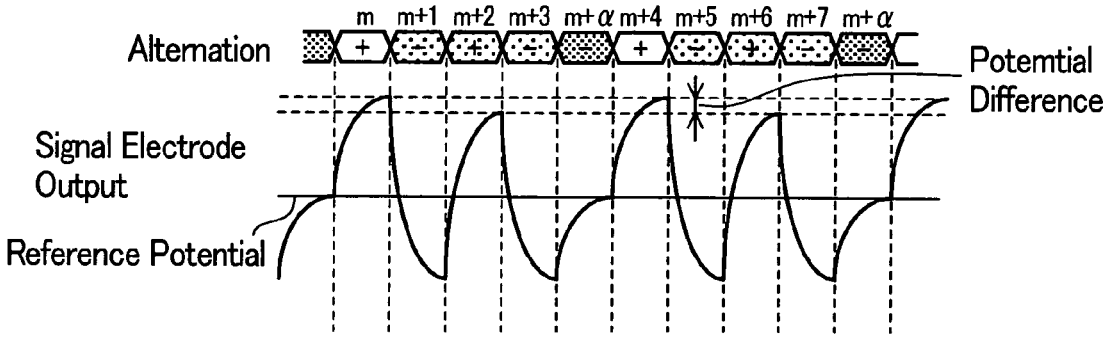

FIG. 36(*a*), (*b*) are waveform diagrams of the respective image data and the blanking data B in the n-frame and the (n+1) frame when the polarity of each blanking signal B is set opposite to the polarity of the image data outputted next to the blanking signal B. The blanking signal B shown in FIG. 36(*a*) has the + polarity and the blanking signal B shown in FIG. 36(*b*) has the – polarity.

The waveform diagrams correspond to the voltage applied to the pixel electrode PX against the counter voltage (reference voltage, common voltage) which is applied to the counter electrode CT, wherein when the voltage applied to the pixel assumes the + polarity, the voltage applied to the pixel electrode PX against the reference voltage assumes the positive polarity, while when the voltage applied to the pixel electrode PX assumes the – polarity, the voltage applied to the pixel electrode PX against the reference voltage assumes the negative polarity.

Then, in case of FIG. 36(*a*), the polarity of the image data outputted next to the blanking signal B is set to – and this – is changed from the polarity + of the blanking signal B. Here, however, the polarity of the image data outputted before the blanking signal B has the + polarity and hence, the waveform change of the voltage during a transition period of the blanking signal B having + polarity to the reference voltage and during a transition period to the voltage of the image data having – polarity with respect to the reference voltage does not become sharp or acute and hence, the integrated value which is served for white display of the image data outputted next to the blanking signal B is displayed as a relatively large value. This implies that, in FIG. 36(*a*), the voltage (absolute value) at the time of transition from the blanking signal B having + polarity to the image data having – polarity becomes larger than the voltage (absolute value) at the time of transition from the image data having + polarity to the image data having – polarity. The difference between these voltages is indicated as the potential difference in the drawing.

In the same manner, in case of FIG. 36(*b*), the polarity of the image data outputted next to the blanking signal B is set to + and this + is changed from the polarity – of the blanking signal B. Here, however, the polarity of the image data outputted before the blanking signal B has the – polarity and hence, the waveform change of the voltage during a transition period of the blanking signal B having – polarity to the reference voltage and during a transition period to the voltage of the image data having + polarity with respect to the reference voltage does not become sharp or acute and hence, the integrated value which is served for white display of the image data outputted next to the blanking signal B is displayed as a relatively large value. This implies that, in FIG. 36(*b*), the voltage (absolute value) at the time of transition from the blanking signal B having – polarity to the image data having + polarity becomes larger than the voltage (absolute value) at the time of transition from the image data having – polarity to the image data having + polarity. The difference between these voltages is indicated as the potential difference in the drawing.

However, since the polarity of each blanking signal B has the polarity opposite to the polarity of the image data outputted next to the blanking signal B, the magnitude of the above-mentioned potential difference is configured to be minimized.

Figure 37A:
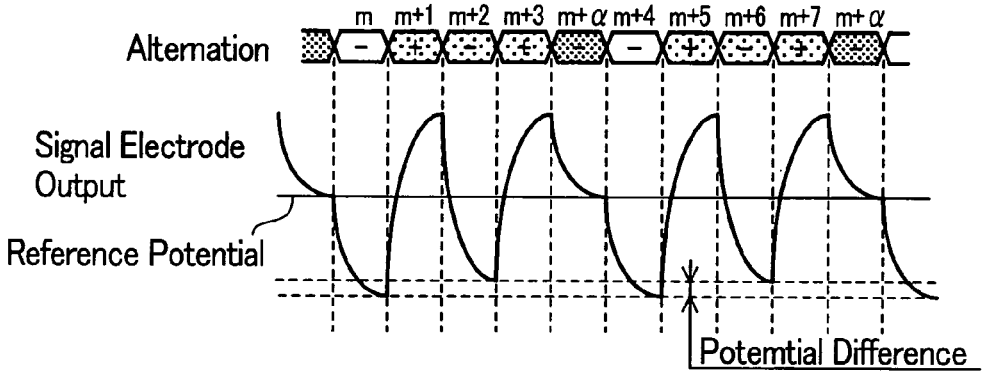
FIG. 37 is a view showing driving waveforms of image data when the polarity of each blanking signal B is set to a polarity equal to the polarity of image data to be outputted next to the blanking signal B, wherein FIG. 37(*a*) shows a voltage waveform when the blanking signal of negative (−) polarity is outputted immediately before the image data of negative (−) polarity in the image data outputting sequence shown in FIG. 36(*a*), and FIG. 37(*b*) shows a voltage waveform when the blanking signal of positive (+) polarity is outputted immediately before the image data of positive (+) polarity in the image data outputting sequence shown in FIG. 36(*b*)
Figure 37B:
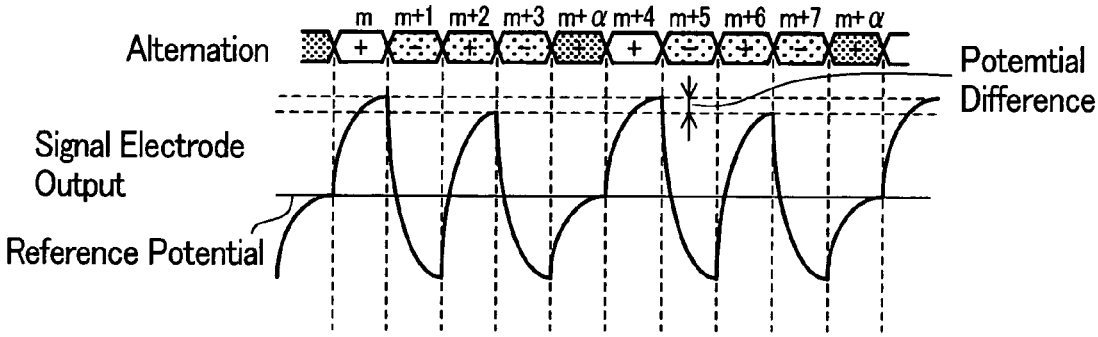
Figure 38A:
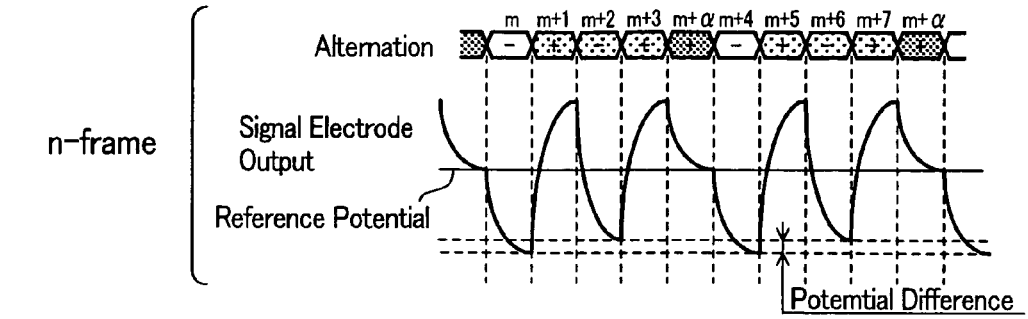
FIG. 38 is a view showing the waveforms of the image data and the blanking signal in the driving shown in FIG. 12, wherein FIG. 38(*a*) is an n-frame voltage waveform which is outputted in accordance with a technique shown FIG. 36(*a*) (the blanking signal of + polarity being followed by image data of − polarity), FIG. 38(*b*) is an (n+1)-frame voltage waveform which is outputted in accordance with a technique shown FIG. 36(*b*) (the blanking signal of − polarity being followed by image data of + polarity), FIG. 38(*c*) is an (n+2)-frame voltage waveform which is outputted in accordance with a technique shown FIG. 36(*b*), and FIG. 38(*d*) is an (n+3)-frame voltage waveform which is outputted in accordance with a technique shown FIG. 36(*a*)
Figure 38B:
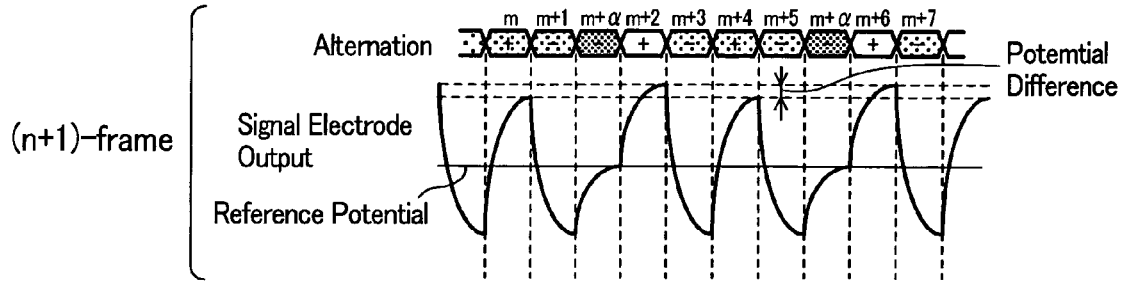
Figure 38C:
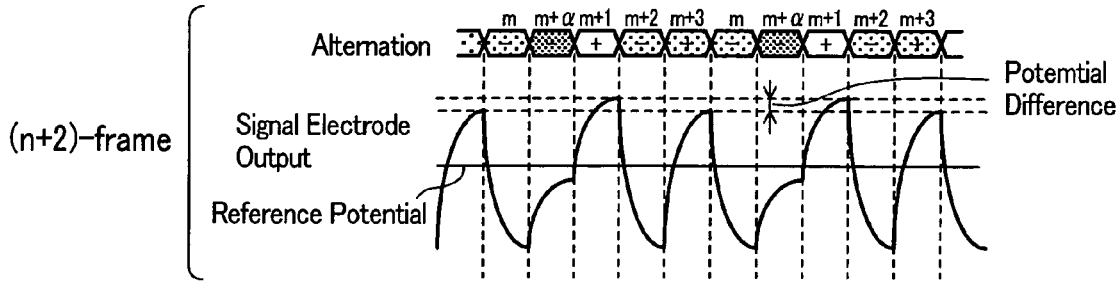
Figure 38D:
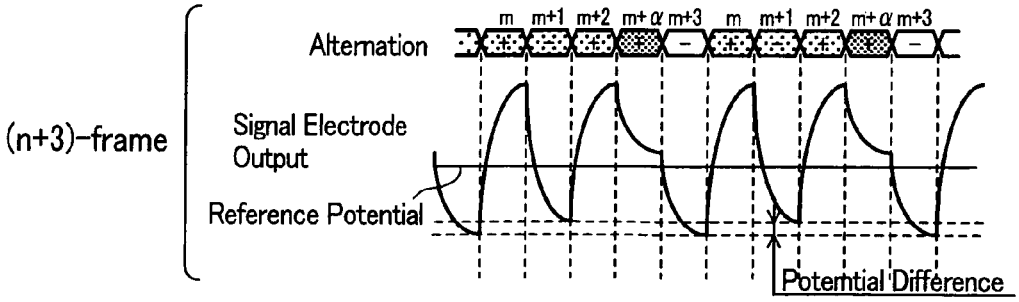

That is, FIG. 37(*a*), (*b*) are views which respectively correspond to the above-mentioned FIG. 36(*a*), (*b*), wherein the polarity of each blanking signal B is set equal to the polarity of the image data outputted next to the blanking signal B.

In this case, as shown in FIG. 37(*a*), the polarity of the image data which is outputted next to the blanking signal B is set to – and this – is changed from the polarity – of the blanking signal B. Here, however, the polarity of the image data outputted before the blanking signal B has the + polarity and hence, the waveform change of the voltage during a transition period of the blanking signal B having – polarity to the reference voltage and during a transition period to the voltage of the image data having – polarity with respect to the reference voltage is temporarily dropped to minus and the absolute value of minus polarity is increased due to the image data outputted next to the blanking signal B. Accordingly, the integrated value which is served for white display is displayed as a larger value. This implies that, in FIG. 37(*a*), the voltage (absolute value) at the time of transition from the blanking signal B having – polarity to the image data having – polarity becomes larger than the voltage (absolute value) at the time of transition from the image data having + polarity to the image data having – polarity. The difference between these voltages is indicated as the potential difference in the drawing. In this case, the potential difference assumes a larger value than the potential difference shown in FIG. 36(*a*).

In the same manner, as shown in FIG. 37(*b*), the polarity of the image data which is outputted next to the blanking signal B is set to + and this + is changed from the polarity + of the blanking signal B. Here, however, the polarity of the image data outputted before the blanking signal B has the + polarity and hence, the waveform change of the voltage during a transition period of the blanking signal B having – polarity to the reference voltage and during a transition period to the voltage of the image data having + polarity with respect to the reference voltage is temporarily elevated to plus and the absolute value of plus polarity is increased due to the image data outputted next to the blanking signal B. Accordingly, the integrated value which is served for white display is displayed as a larger value. This implies that, in FIG. 37(*b*), the voltage (absolute value) at the time of transition from the blanking signal B having + polarity to the image data having + polarity becomes larger than the voltage (absolute value) at the time of transition from the image data having + polarity to the image data having – polarity. The difference between these voltages is indicated as the potential difference in the drawing. In this case, the potential difference assumes a larger value than the potential difference shown in FIG. 36(*b*).

Figure 12:
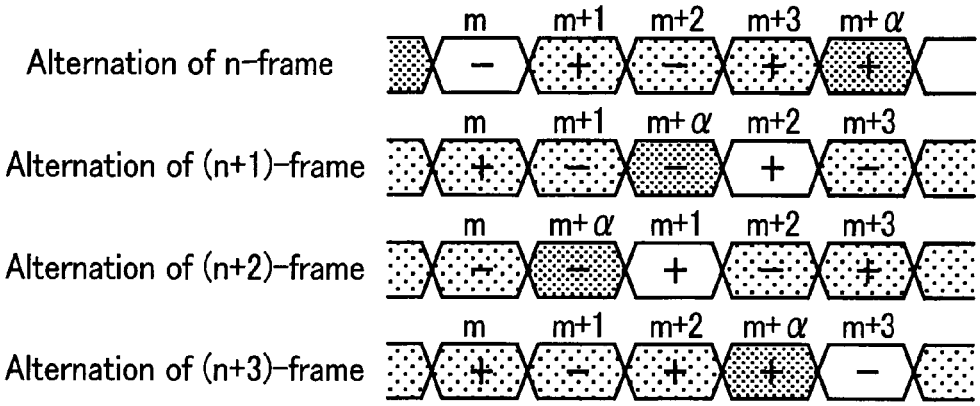
FIG. 12 is a view depicting another mode of the driving method shown in FIG. 10 after a waveform diagram shown in FIG. 10.
Figure 13:
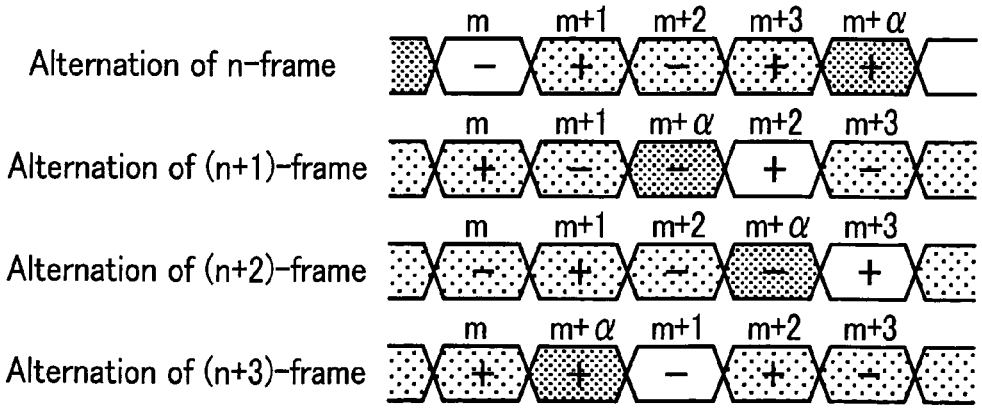
FIG. 13 is a view depicting another mode of the driving method shown in FIG. 10 after a waveform diagram shown in FIG. 10.
Figure 14:
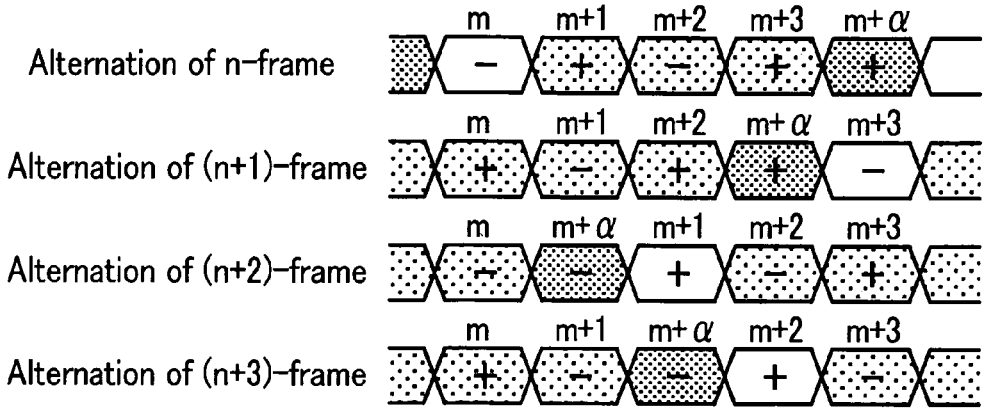
FIG. 14 is a view depicting another mode of the driving method shown in FIG. 10 after a waveform diagram shown in FIG. 10.
Figure 15:
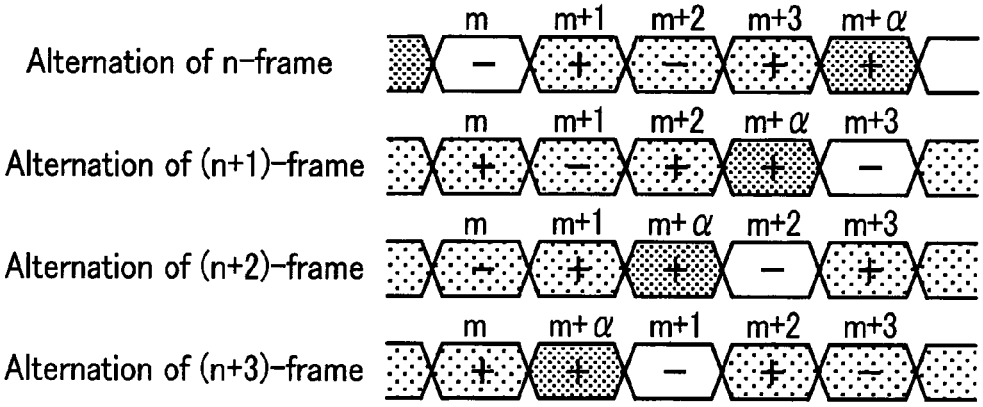
FIG. 15 is a view depicting another mode of the driving method shown in FIG. 10 after a waveform diagram shown in FIG. 10.
Figure 16:
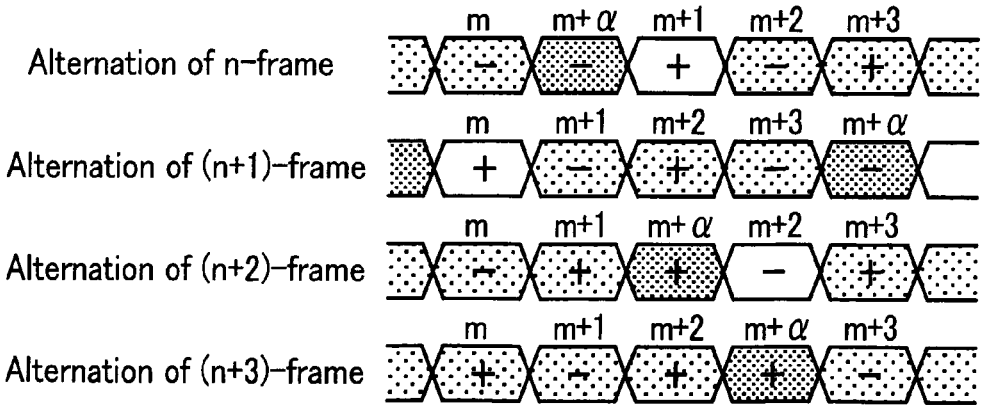
FIG. 16 is a view depicting another mode of the driving method shown in FIG. 10 after a waveform diagram shown in FIG. 10.
Figure 17:
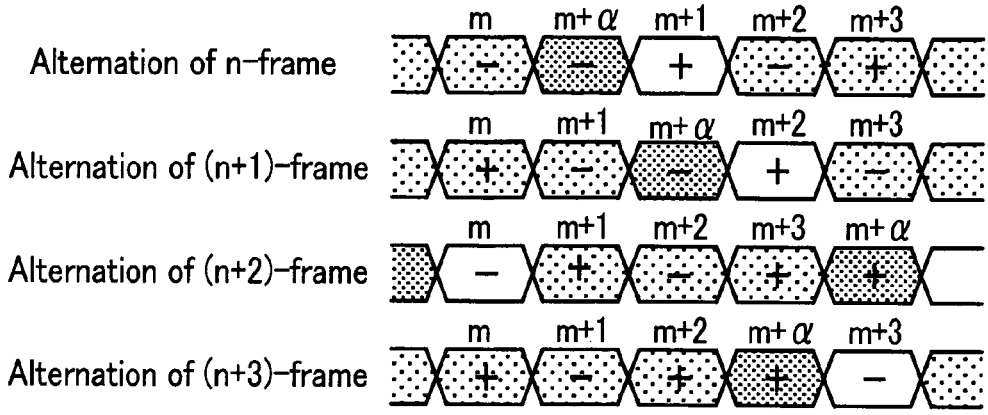
FIG. 17 is a view depicting another mode of the driving method shown in FIG. 10 after a waveform diagram shown in FIG. 10.
Figure 18:
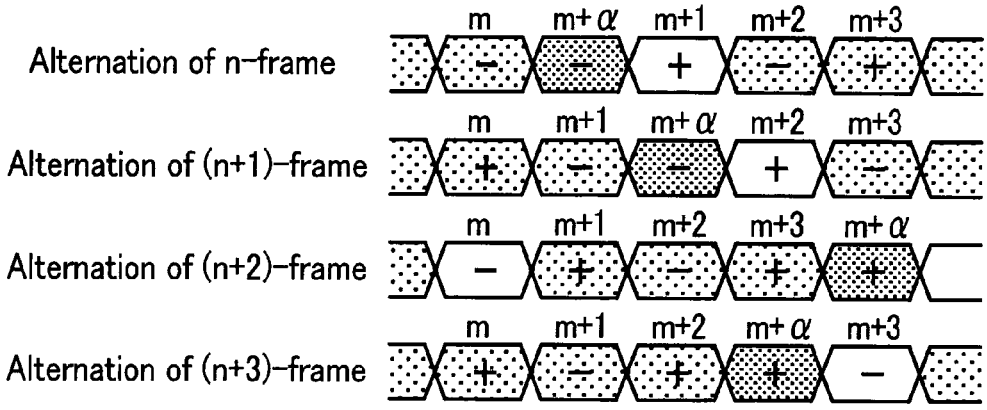
FIG. 18 is a view depicting another mode of the driving method shown in FIG. 10 after a waveform diagram shown in FIG. 10.
Figure 19:
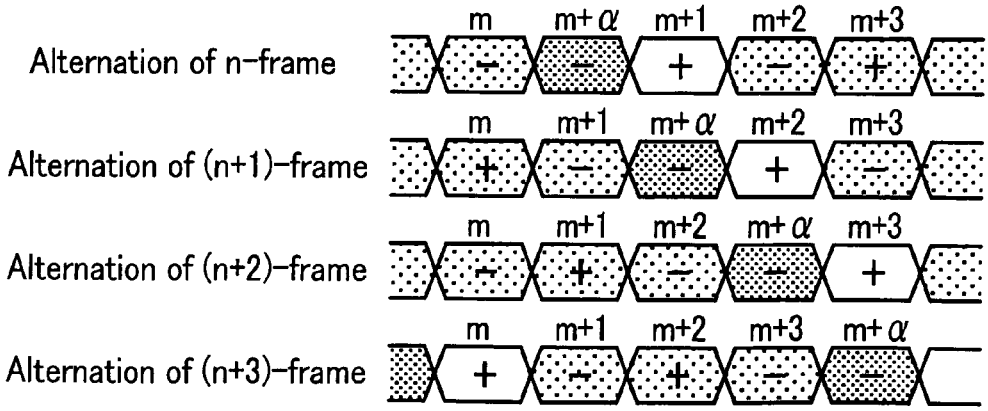
FIG. 19 is a view depicting another mode of the driving method shown in FIG. 10 after a waveform diagram shown in FIG. 10.
Figure 20:
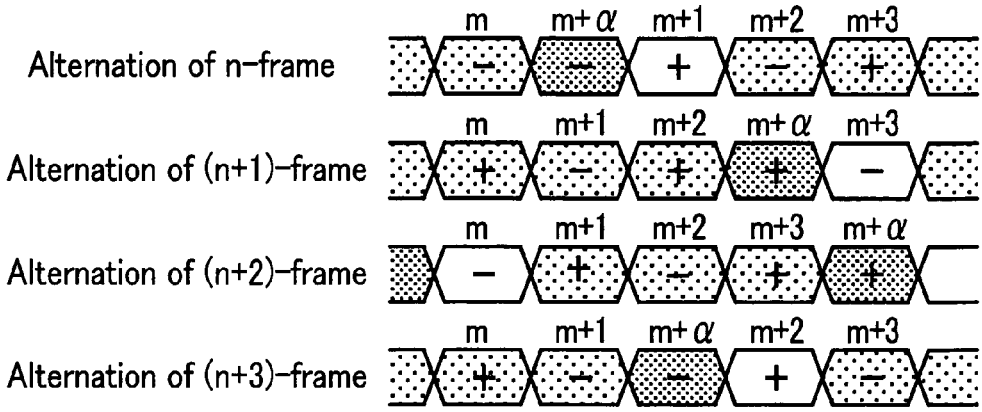
FIG. 20 is a view depicting another mode of the driving method shown in FIG. 10 after a waveform diagram shown in FIG. 10.
Figure 21:
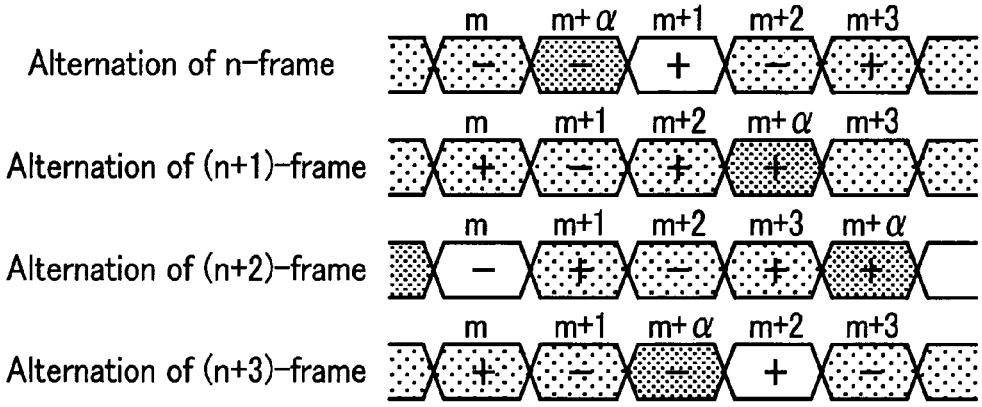
FIG. 21 is a view depicting another mode of the driving method shown in FIG. 10 after a waveform diagram shown in FIG. 10.
Figure 22:
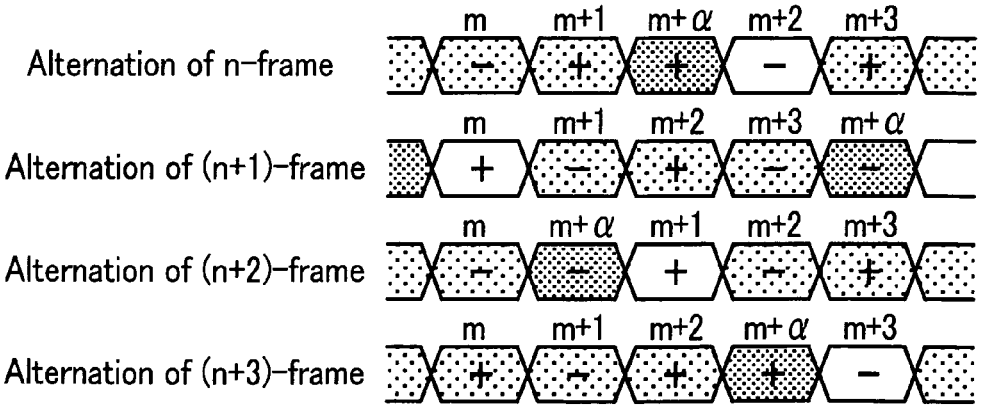
FIG. 22 is a view depicting another mode of the driving method shown in FIG. 10 after a waveform diagram shown in FIG. 10.
Figure 23:
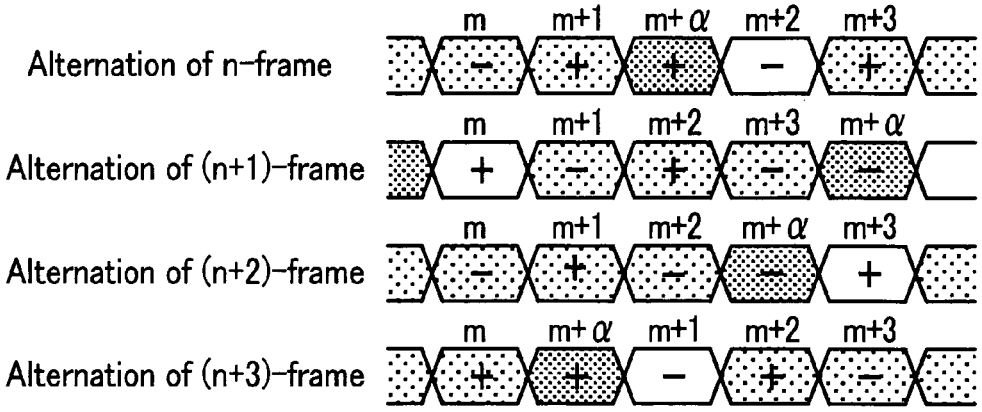
FIG. 23 is a view depicting another mode of the driving method shown in FIG. 10 after a waveform diagram shown in FIG. 10.
Figure 24:
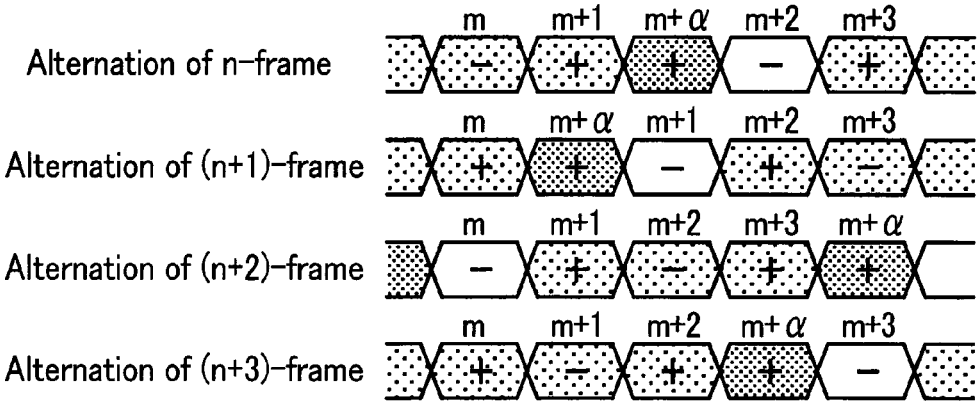
FIG. 24 is a view depicting another mode of the driving method shown in FIG. 10 after a waveform diagram shown in FIG. 10.
Figure 25:
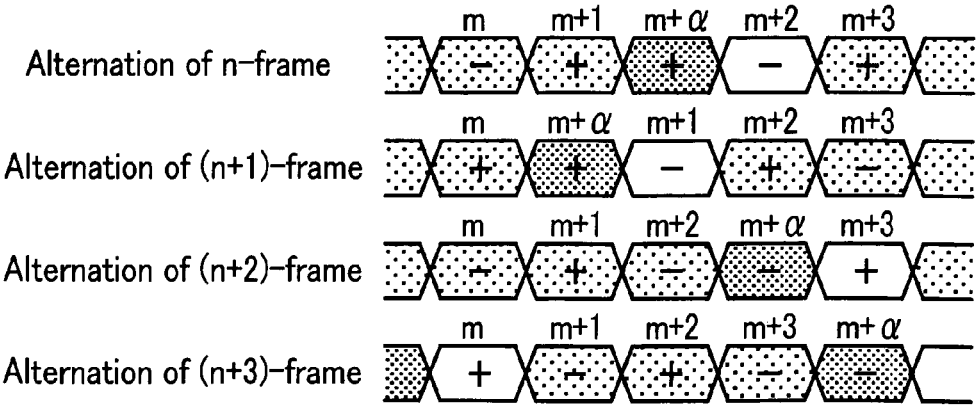
FIG. 25 is a view depicting another mode of the driving method shown in FIG. 10 after a waveform diagram shown in FIG. 10.
Figure 26:
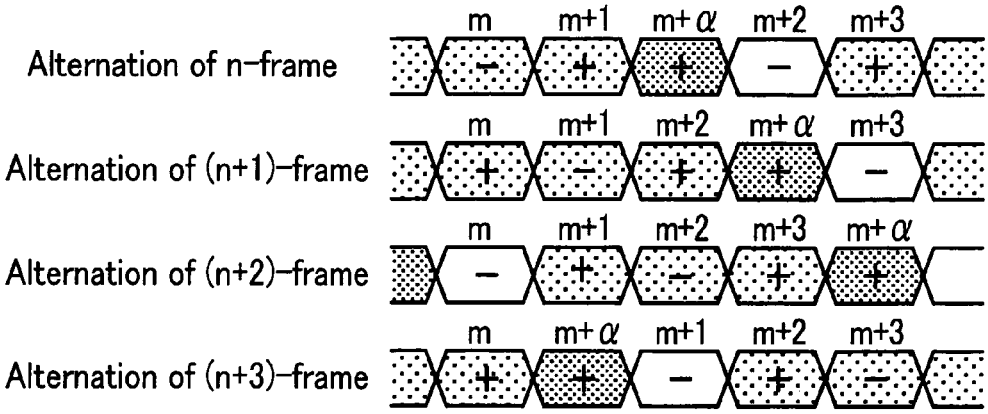
FIG. 26 is a view depicting another mode of the driving method shown in FIG. 10 after a waveform diagram shown in FIG. 10.
Figure 27:
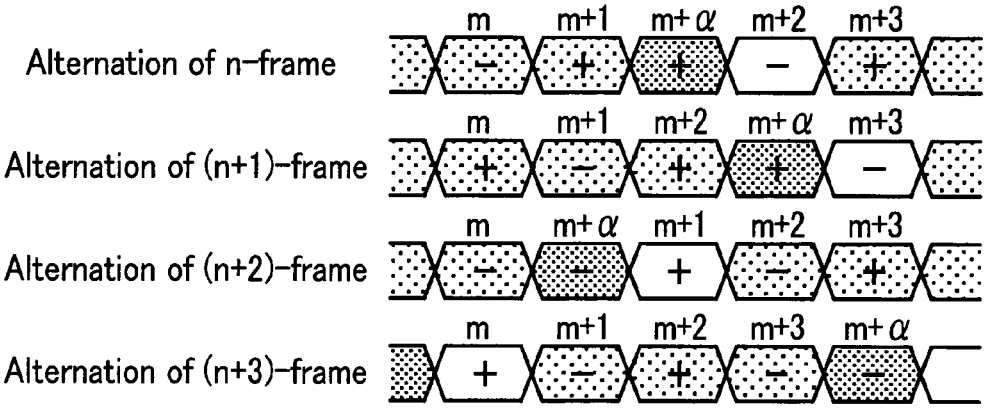
FIG. 27 is a view depicting another mode of the driving method shown in FIG. 10 after a waveform diagram shown in FIG. 10.
Figure 28:
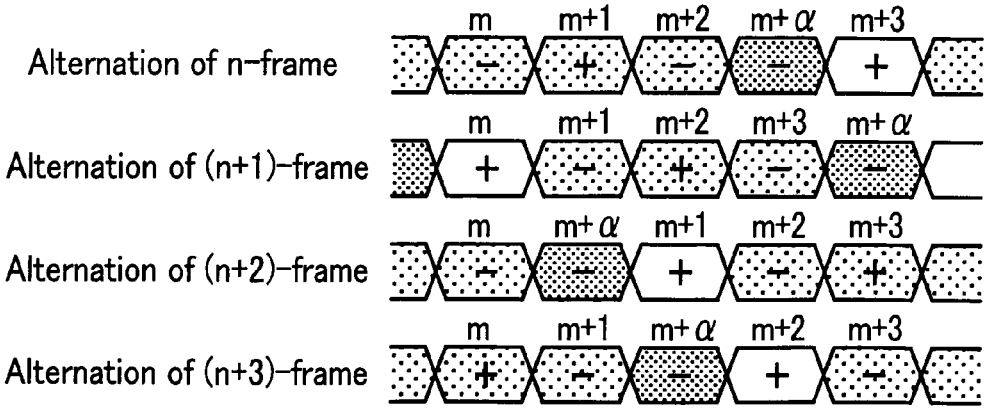
FIG. 28 is a view depicting another mode of the driving method shown in FIG. 10 after a waveform diagram shown in FIG. 10.
Figure 29:
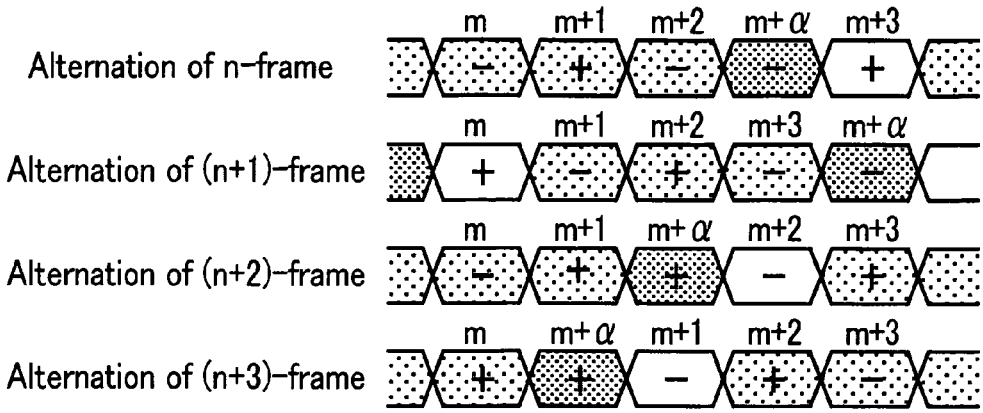
FIG. 29 is a view depicting another mode of the driving method shown in FIG. 10 after a waveform diagram shown in FIG. 10.
Figure 30:
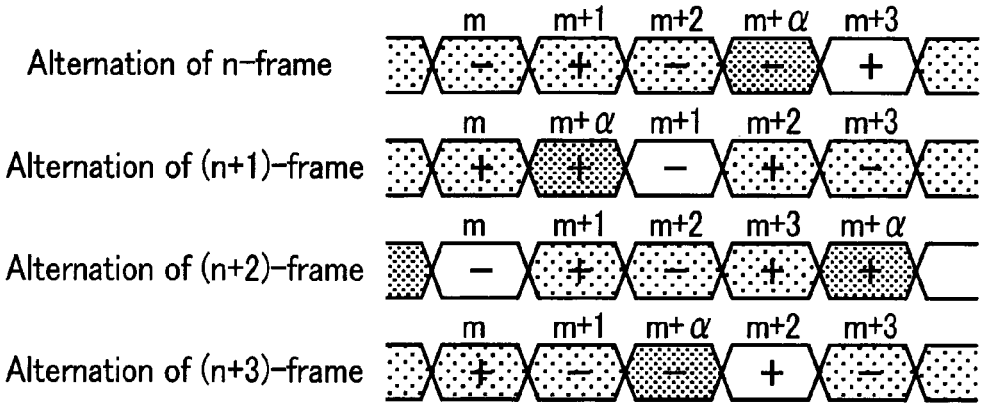
FIG. 30 is a view depicting another mode of the driving method shown in FIG. 10 after a waveform diagram shown in FIG. 10.
Figure 31:
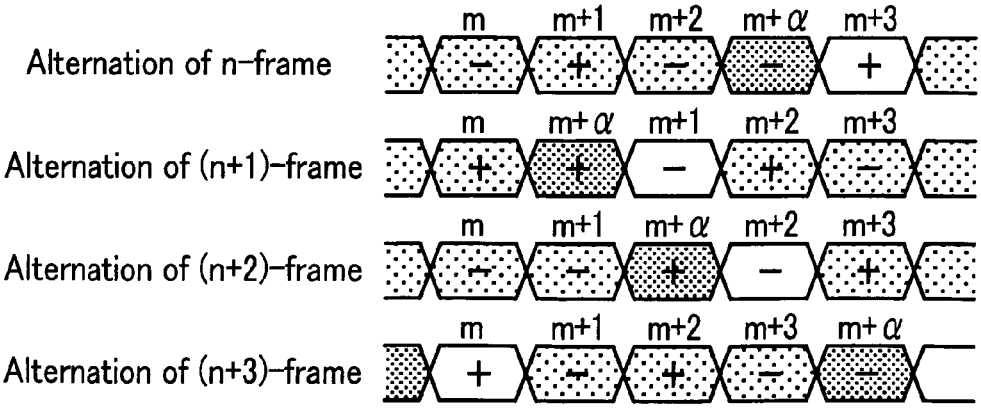
FIG. 31 is a view depicting another mode of the driving method shown in FIG. 10 after a waveform diagram shown in FIG. 10.
Figure 32:
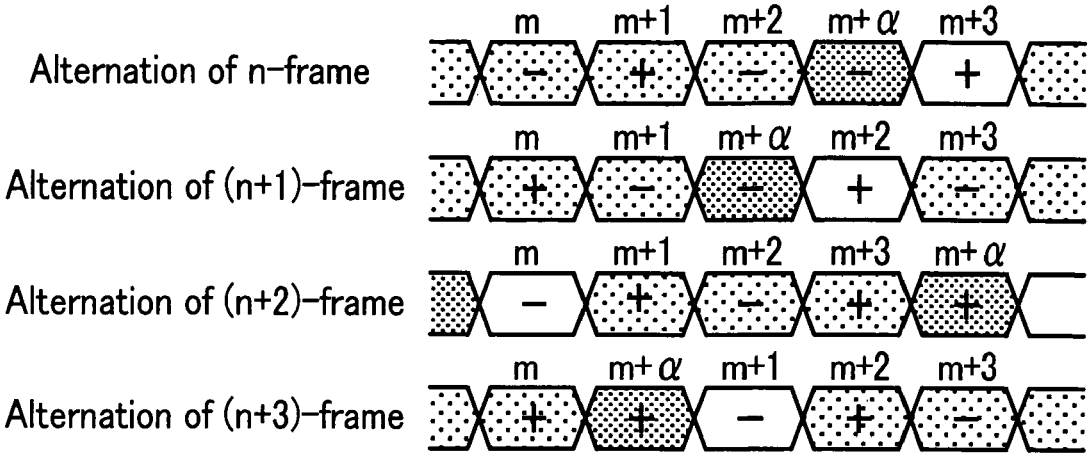
FIG. 32 is a view depicting another mode of the driving method shown in FIG. 10 after a waveform diagram shown in FIG. 10.
Figure 33:
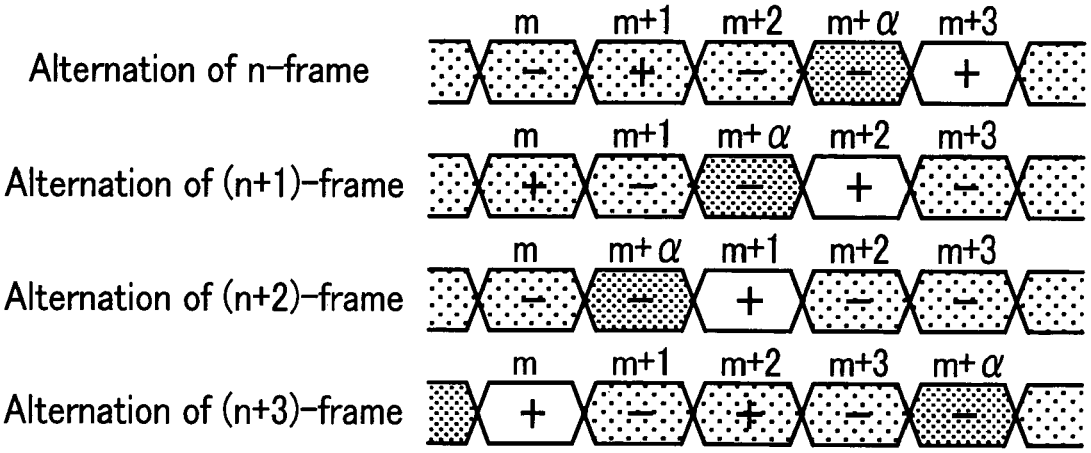
FIG. 33 is a view depicting another mode of the driving method shown in FIG. 10 after a waveform diagram shown in FIG. 10.

FIG. 38(*a*), (*b*), (*c*), (*d*) respectively show waveform diagrams of the image data and the blanking signal B in the n-frame, the (n+1)-frame, (n+2)-frame and the (n+3)-frame as an example of a driving mode shown in FIG. 12.

As can be clearly understood from these drawings, FIG. 38(*a*) corresponds to the case shown in FIG. 36(*a*), FIG. 38(*b*) corresponds to the case shown in FIG. 36(*b*), FIG. 38(*c*) corresponds to the case shown in FIG. 36(*b*), and FIG. 38(*d*) corresponds to the case shown in FIG. 36(*a*).

Accordingly, the image data for 1 line which are supplied next to the blanking signal B exhibit brightness higher than that of the image data of other line. However, the brightness can be suppressed to a minimum level.

Further, the image data for 1 line which are supplied next to the blanking signal B do not stay on the same line in the changeover of respective frames in the same manner as the blanking signal B and move to other line. Accordingly, the image data are hardly observed with naked eyes and are displayed in an unnoticeable manner. The embodiment described in the third embodiment can be also directly applicable to the modification shown in the first embodiment. For example, the outputting number: M of display signals in the first step is not limited to 4 and the outputting number: M of blanking signals in the second step is not limited to 1.

As can be clearly understood from the foregoing explanation, according to the liquid crystal display device and the driving method of this embodiment, it is possible to prevent the generation of lateral stripes displayed on the screen.

<<Fourth Embodiment>>

Figure 39:
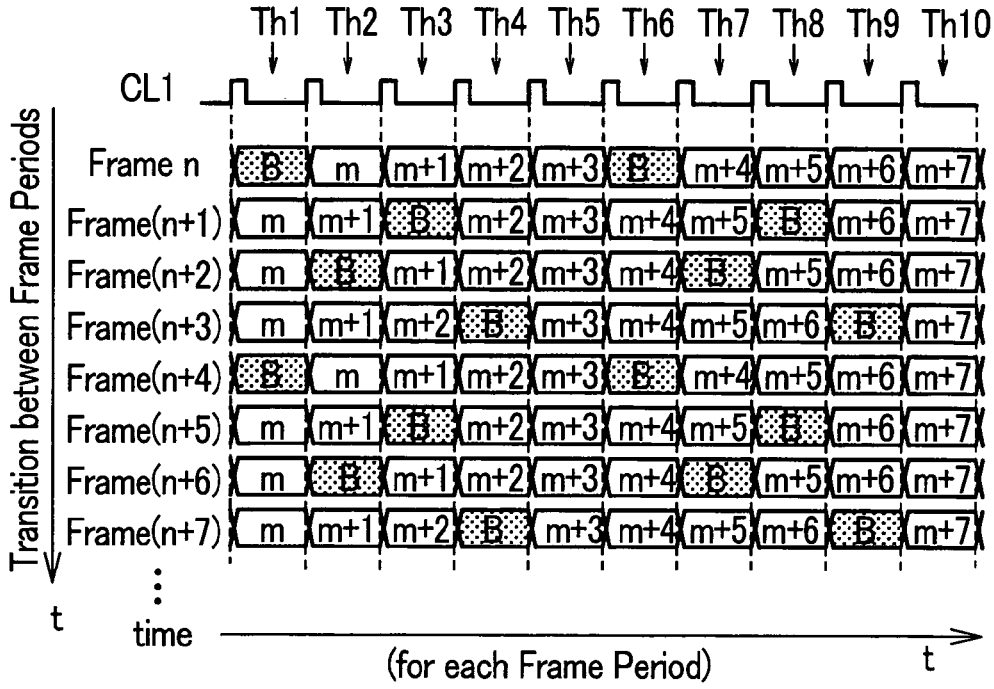
FIG. 39 is a view showing the change of display signals (m, m+1, m+2, based on image data and B based on blanking signal) supplied to respective pixel rows corresponding to gate lines G1, G2, G3, . . . over a plurality of continuous frame periods m, m+1, m+2, . . . explained as one mode of the fourth embodiment of the driving method of the liquid crystal display device according to the present invention.

FIG. 39 is a view which shows the change of display signals (m, m+1, m+2 derived from the image data and B derived from the blanking data) supplied to respective pixel rows corresponding to gate lines G1, G2, G3, . . . explained as the third embodiment of the driving method of the display device according to the present invention over a plurality of continuous frame periods n, n+1, n+2, FIG. 39 corresponds to FIG. 8.

In the same manner as the case shown in FIG. 8, with respect to the image data inputted at the timing shown in FIG. 2, the display signals and the scanning signals are outputted from the data driver 102 in waveforms shown in FIG. 1 or FIG. 4 and are displayed in accordance with the display timing shown in FIG. 6. However, in this embodiment, the outputting timing of the blanking signals with respect to outputting of the display signals based on the image data shown in FIG. 1 and FIG. 4 is changed for every frame period.

That is, in the embodiment shown in FIG. 39, in the same manner as the embodiment shown in FIG. 8, the display signals and the scanning signals are outputted from the data driver 102 in waveforms shown in FIG. 1 or FIG. 4 and are displayed in accordance with the display timing shown in FIG. 6. However, in this embodiment, the outputting timing of the blanking signals with respect to outputting of the display signals based on the image data shown in FIG. 1 and FIG. 4 is changed for every frame period.

However, in case of the embodiment shown in FIG. 39, the blanking signals B which are included in the sequentially outputted N-times display signals are, as a matter of course, not juxtaposed in the direction orthogonal to the time axis and have outputting timing thereof shifted or deviated. Further, the blanking signals B are distributed on the straight line (straight line extending from the left upper side to the right lower side in the drawing) such that all of them are not juxtaposed. That is, the blanking signal B of each one of frames which are sequentially displayed in response to N-times display signals is distributed such that the time-sequential deviation (shift) of the period does not include (N−2) pieces of Th1 (Th2, Th3, Th4, . . . ) at maximum with respect to the next blanking signal.

FIG. 39 shows a case in which N is set to N=4. Assuming a group consisting of successive four frames (e.g. frames n, n+1, n+2, n+3), time-sequential deviation as long as one of the periods Th1, Th2, Th3, Th4, . . . (one cycle of the horizontal clock CL1 in FIG. 39) is recognized between respective output terms of the blanking signals in each frame belonging to the group and another frame just before the each frame.

As shown in FIG. 39, in the periods Th1, Th2, Th3, . . . which correspond to respective pulses of the horizontal clock CL1, the blanking signal of the n-frame is allocated to the period Th1, the blanking signal of the (n+1) frame is allocated to the period Th3, the blanking signal of the (n+2) frame is allocated to the period Th2 and, further, the blanking signal of the (n+3) frame is allocated to the period Th4. Here, after the transition to the (n+4) frame, the above-mentioned relationship is repeated.

Therefore, in the aforementioned group consisting of the frames n, n+1, n+2, and n+3, only the term for outputting the blanking signal B in the (n+2) frame is shifted to one of the aforementioned periods Th1, Th2, Th3, Th4, . . . adjacent to another thereof for outputting the blanking signal B in the (n+1) frame just before the (n+2) frame. Moreover, each term for outputting the blanking signals B in the (n+2) frame is shifted toward the scanning start signal FLM for the (n+2) frame in contrast to another frame (the (n+1) frame) just before the (n+2) frame, while each term for outputting the blanking signals B in the other frame belonging to the group is shifted away from the scanning start signal FLM for the other frame in contrast to another frame just before the other frame. In FIG. 39, the (n+6) frame appearing 4 frames after the (n+2) frame has similar features to those of the (n+2) frame.

The reason that this embodiment adopts the above constitution is as follows. For example, when the driving of the display device shown in FIG. 8 is performed, due to the influence of the rounding waveforms, the display data which are outputted next to the blanking signals B of respective frames, that is, the display signals m, m+4, . . . in the n-frame, the display signals m+1, m+5, . . . in the (n+1)-frame, the display signals m+2, m+6, . . . in the (n+2)-frame, the display signals m+3, m+7, . . . in the (n+3) frame are respectively displayed with relatively large brightness and are displayed such that they are arranged linearly on the pixel region. Accordingly, the retracing lines which are relatively bright compared to the other region are displayed (display flow) such that they flow in response to changeover of respective frames whereby the display data can be easily observed with naked eyes.

The embodiment shown in the fourth embodiment is provided for solving this drawback and is configured such that, as described above, the respective blanking signals B are distributed such that they are not juxtaposed on a straight line which starts from the left upper portion and reaches the right lower portion in FIG. 39. Due to such a constitution, to observe the screen as a whole, the line which receives the influence of rounding of waveforms moves in the downward direction on the screen in the changeover from the n-frame to the (n+1)-frame, moves in the upward direction on the screen in the changeover from the (n+1)-frame to the (n+2)-frame, moves in the downward direction on the screen in the changeover from the (n+2)-frame to the (n+3)-frame, and moves in the upward direction on the screen in the changeover from the (n+3)-frame to the (n+4)-frame, whereby it is possible to make it difficult for a user to observe the display flow with naked eyes.

Figure 40:
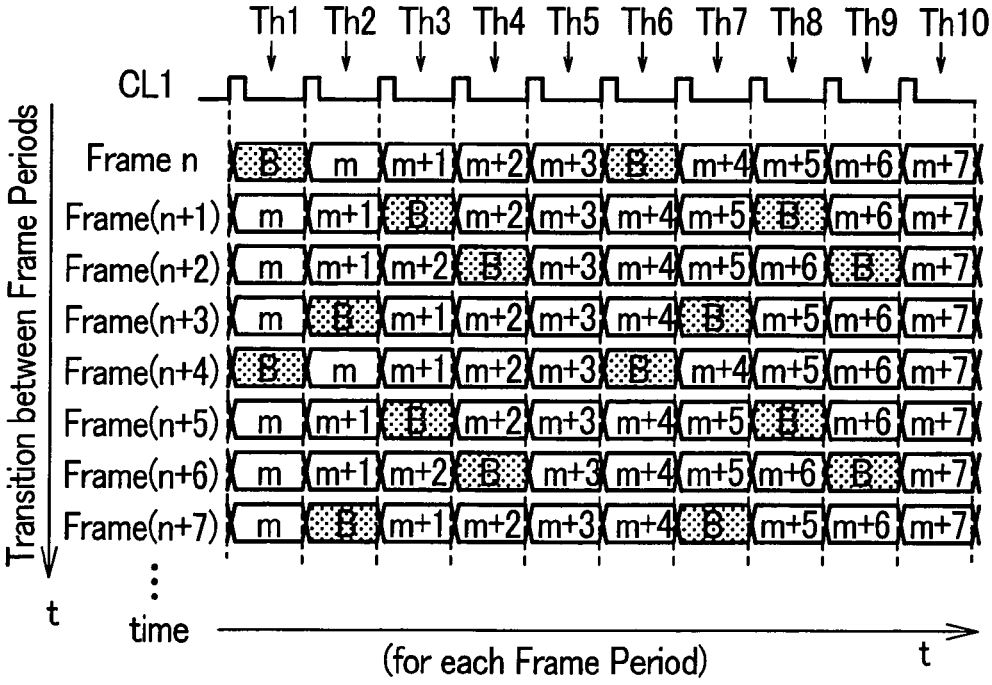
FIG. 40 is a view showing the change of display signals (m, m+1, m+2, based on image data and B based on blanking signal) supplied to respective pixel rows corresponding to gate lines G1, G2, G3, . . . over a plurality of continuous frame periods m, m+1, m+2, . . . explained as another mode of the fourth embodiment of the driving method of the liquid crystal display device according to the present invention.

FIG. 40 is a view which shows another mode based on the above-mentioned same concept and also corresponds to FIG. 8.

In the case shown in FIG. 40, with respect to the periods Th1, Th2, Th3, which respectively correspond to the pulses of the horizontal clock CL1, the blanking signal of the n-frame is allocated to the period Th1, the blanking signal of the (n+1)-frame is allocated to the period Th3, the blanking signal of the (n+2)-frame is allocated to the period Th4 and, further, the blanking signal of the (n+3)-frame is allocated to the period Th2. Here, in succeeding frames including the (n+4) frame, the above-mentioned relationship is repeated.

From the above, with respect to the blanking signals B of respective frames, the frame which exhibits the time-sequential deviation of the period Th1 (Th2, Th3, Th4, . . . ) with respect to the next blanking signal is only the (n+2) frame. This mode is substantially equal to the mode shown in FIG. 39.

The embodiment described in the fourth embodiment can be also directly applicable to the modification shown in the first embodiment. For example, the outputting number: M of display signals in the first step is not limited to 4 and the outputting number: M of blanking signals in the second step is not limited to 1.

<<Fifth Embodiment>>

FIG. 41 to FIG. 56 show output waveforms of signals from the display control circuit (timing controller) and respective output waveforms of signals from the scanning driver and the data driver corresponding to the these signals which are explained as the fifth embodiment of the display device and the driving method thereof according to the present invention, wherein the waveforms are shown in the same manner as those shown in FIG. 4. However, this embodiment shown in FIG. 41 to FIG. 56 differs from the embodiment shown in FIG. 4 in that, as can be clearly understood from pulses of the scanning start signal FIL which is depicted at the center of the respective drawings, a boundary between a certain frame period and next frame period is arranged at the center in the lateral direction of respective frames.

In the fifth embodiment, at the time of changeover from the frame to the next frame, the number of scanning clocks CL3 which are generated between the blanking signal B which is outputted last in the former frame and the blanking signal B which is outputted first in the next frame is always adjusted to N pieces while preventing the number of scanning clocks CL3 from becoming uncertain or indefinite (becomes 2, 3 or 5).

Figure 57:
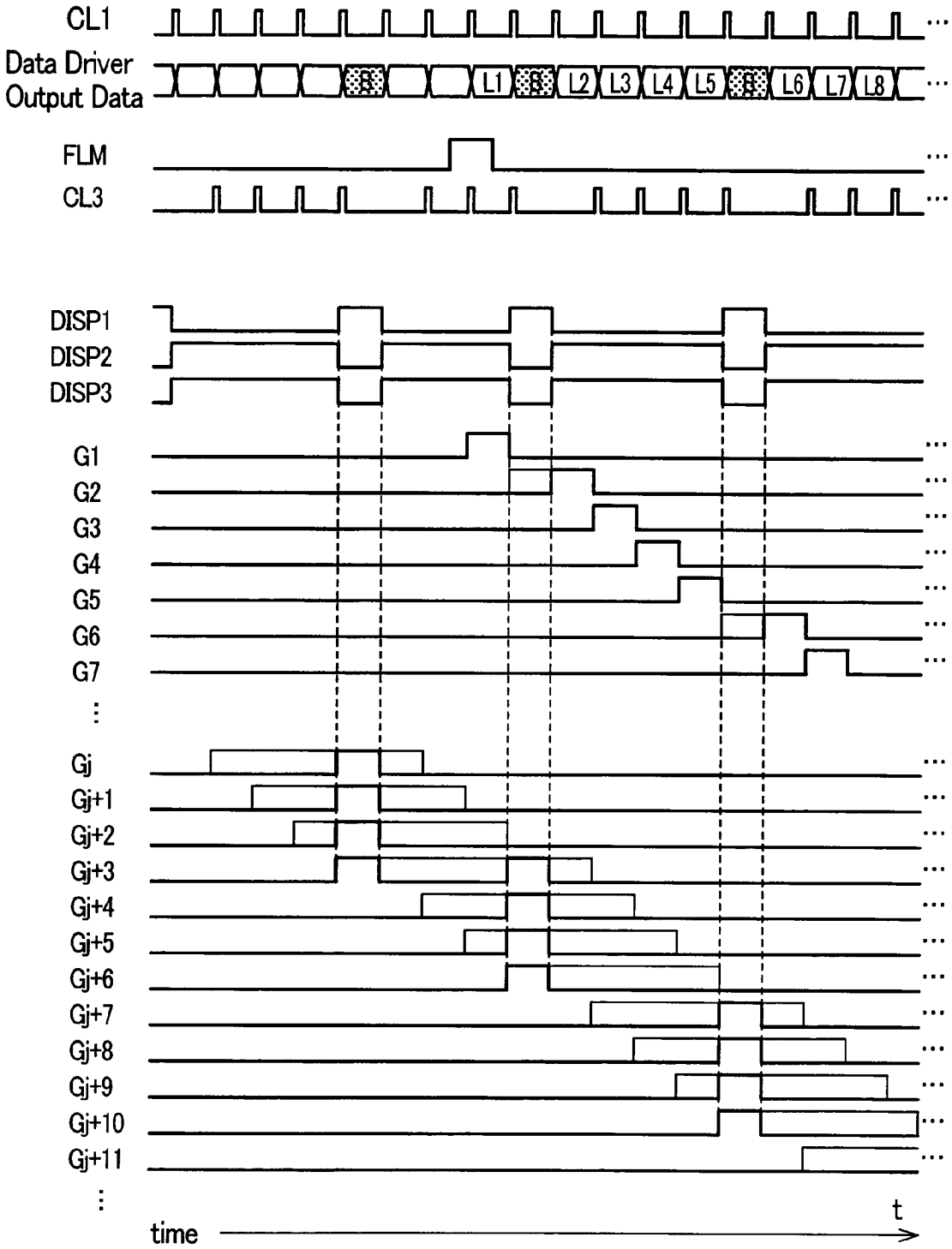
FIG. 57 is a driving waveform diagram showing a drawback that two blanking signals are generated on a same line by not performing the adjustment of the number of scanning clocks at the time of changing over the frames.

The reason to perform such an adjustment is as follows. For example, as shown in FIG. 57, there may be a case that the number of scanning clocks CL3 which are generated between the blanking signal B which is outputted last in the former frame and the blanking signal B which is outputted first in the next frame becomes 3. In this case, there arises a phenomenon that the blanking signal B is written twice in 1 frame in which the scanning start signal FLM is positioned at the center thereof on the line of the gate lines $G_{j+3}$. In such a case, this line works as a boundary and the ratio between the holding time of the image data and the holding time of the blanking signal B differs between the upper and lower portions of the pixel array and hence, the brightness difference is generated whereby the line portion is displayed darker than other background.

Figure 58:
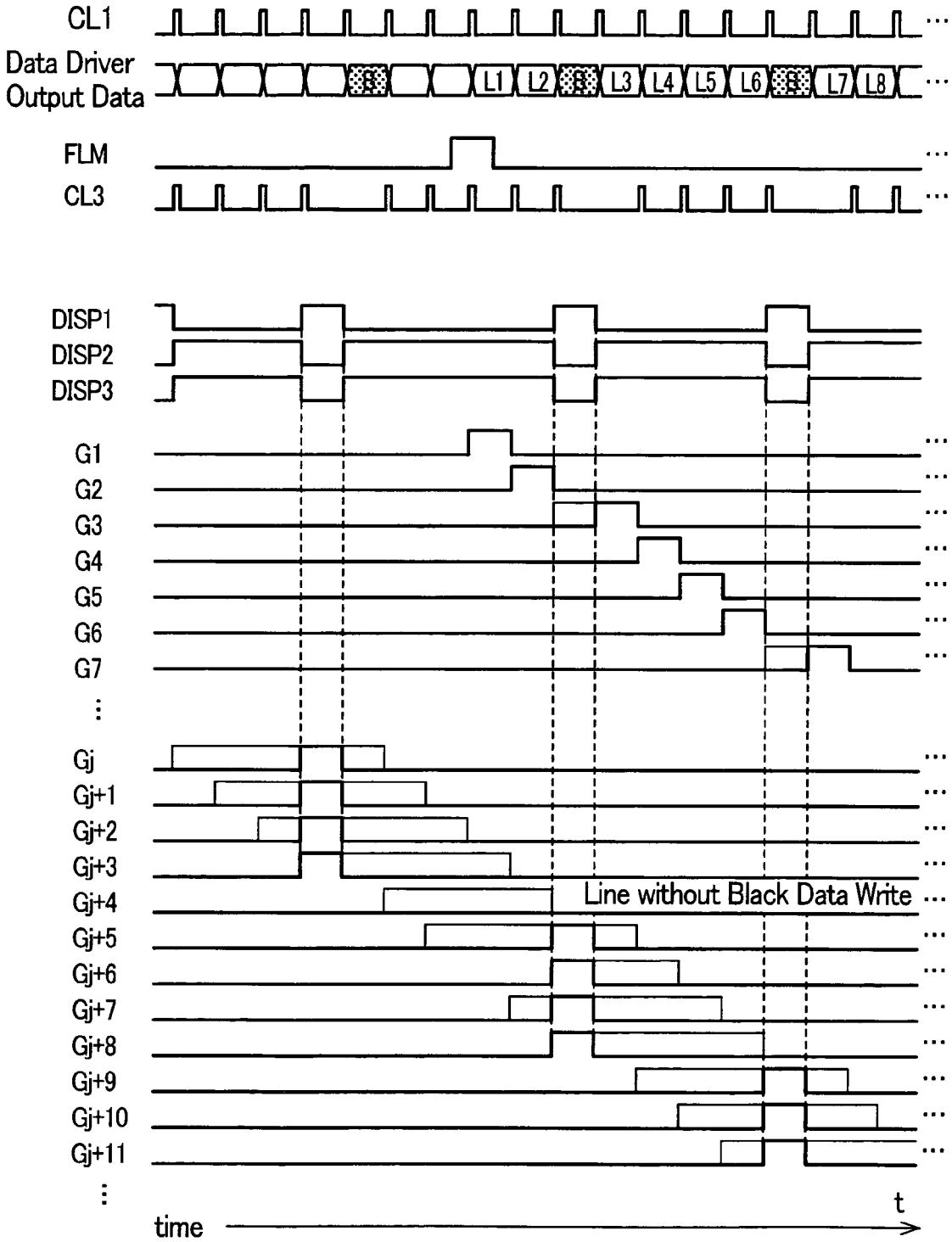
FIG. 58 is a driving waveform diagram showing a drawback that blanking signals are not generated on a line by not performing the adjustment of the number of scanning clocks at the time of changing over the frames.

Further, as shown in FIG. 58, there may be a case that the number of scanning clocks CL3 which are generated between the blanking signal B which is outputted last in the former frame and the blanking signal B which is outputted first in the next frame becomes 5. In this case, there arises a phenomenon that the blanking signal B is not written at all in 1 frame in which the scanning start signal FLM is positioned at the center thereof on the line of the gate lines $G_{j+4}$. In such a case, this line works as a boundary and the ratio between the holding time of the image data and the holding time of the blanking signal B differs between the upper and lower portions of the pixel array and hence, the brightness difference is generated whereby the line portion is displayed brighter than other background.

Accordingly, in this fifth embodiment, as mentioned above, the number of scanning clocks CL3 which are generated between the blanking signal B which is outputted last in the former frame and the blanking signal B which is outputted first in the next frame is always adjusted to N pieces so that the holding time of the image data and the holding time of the blanking signal B are made to agree with each other in accordance with the N frame unit whereby the brightness difference between the upper and lower portions of the pixel array can be eliminated.

Here, since the timing between the input waveform (input data) of the image data to the display control circuit (timing controller) and the output waveform (driver data) from the display control circuit is preliminarily set, the adjustment of the number of the scanning clocks CL3 at the time of changeover of frame can be easily performed using the timing controller (display control circuit) 104, for example.

Hereinafter, a case adopting a method in which the image data for 4 lines and the blanking data for 4 lines are written using the input 4 horizontal periods and the blanking data are distributed using the embodiments shown in FIG. 41 to FIG. 56 is explained.

Here, in the above-mentioned respective drawings, all of symbols CL31, CL32, CL33 indicate scanning clocks, wherein the scanning clock CL31 is inputted to the scanning driver 103-1, the scanning clock CL32 is inputted to the scanning driver 103-2 and the scanning clock CL33 is inputted to the scanning driver 103-3.

In this case, although pulses are outputted at the same timing with respect to all of respective scanning clocks CL31, CL32, CL33, one of them is served for display based on the display signals other than the blanking signals B and two remaining scanning clocks are served for display based on the blanking signals B.

Accordingly, with respect to two other remaining scanning clocks, at the time of changeover of frame, the number of scanning clocks which are generated between the blanking signal B which is outputted lastly in the preceding frame and the blanking signal B which is outputted firstly in the next frame can be adjusted.

In such a constitution, first of all, it is judged whether the number of inputting horizontal periods in 1 frame is a multiple of 4, a multiple of 4+1, a multiple of 4+2 or a multiple of 4+3. Further, the input frames are monitored and the number of inputting horizontal periods is allocated to the first, the second, the third and the fourth frames and this operation is repeated. Based on the above, the case in which the number of inputting horizontal periods is the multiple of 4 is explained hereinafter.

Figure 41:
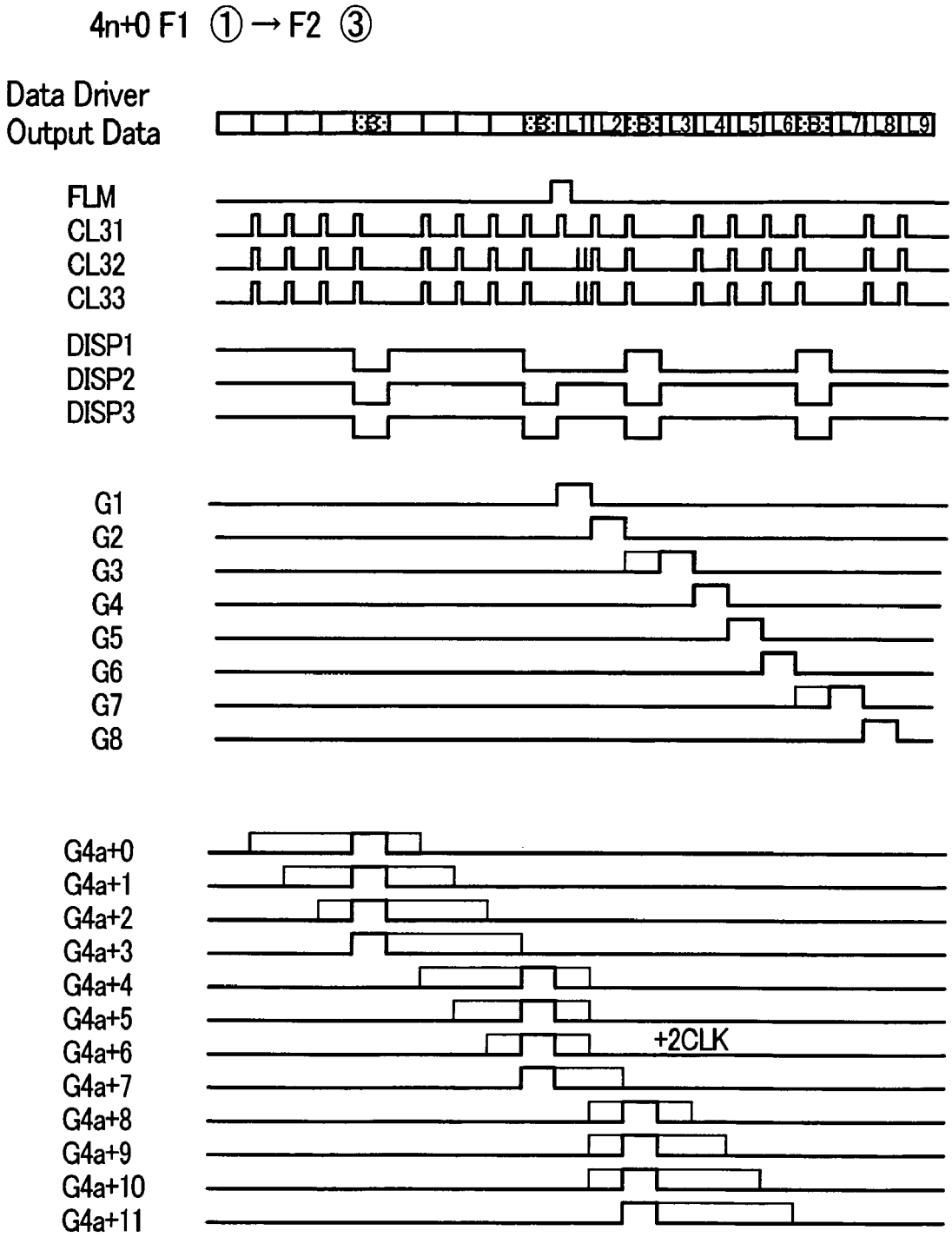
FIG. 41 is a view showing driving waveforms of the liquid crystal display device explained as the fifth embodiment (one of the driving methods of the liquid crystal display device according to the present invention which simultaneously select 4 scanning lines during an outputting period of display signals), while the second frame is taking the place of the first frame wherein the number of inputting horizontal periods is a multiple of 4.

As shown in FIG. 41, at the time of changeover between the first frame and the second frame, 2 horizontal periods are present between writing of the final blanking signal B to the first frame and writing of the beginning blanking signal B to the second frame. In this manner, during 2 horizontal periods, when the usual scanning clock CL3 is inputted to the scanning driver, the output timing is shifted by only 2 lines and hence, the scanning clock CL3 is short of 2 clocks. Accordingly, the scanning clocks CL3 are added by two clocks which are in short to the beginning 1 horizontal period of the second frame so as to output 3 pulses.

Figure 42:
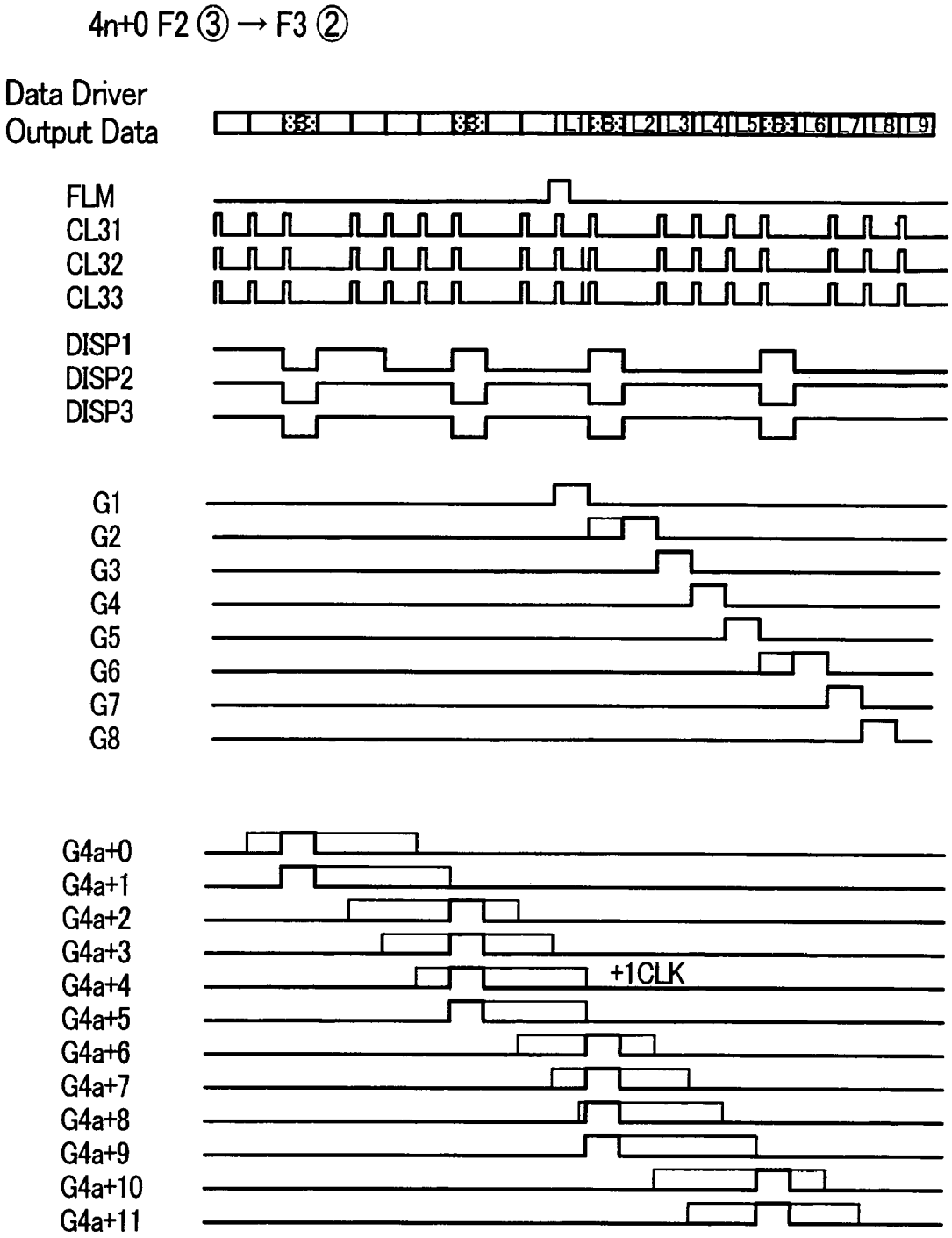
FIG. 42 is a view showing the driving waveforms of the liquid crystal display device in the fifth embodiment while the third frame is taking the place of the second frame, wherein the number of inputting horizontal periods is a multiple of 4.

As shown in FIG. 42, at the time of changeover between the second frame and the third frame, 3 horizontal periods are present between writing of the final blanking signal B to the second frame and writing of the beginning blanking signal B to the third frame. In this manner, during 3 horizontal periods, when the usual scanning clock CL3 is inputted to the scanning driver, the output timing is shifted by only 3 lines and hence, the scanning clock CL3 is short of 1 clock. Accordingly, the scanning clocks CL3 are added by one clock which is in short to the beginning 1 horizontal period of the third frame so as to output 2 pulses.

Figure 43:
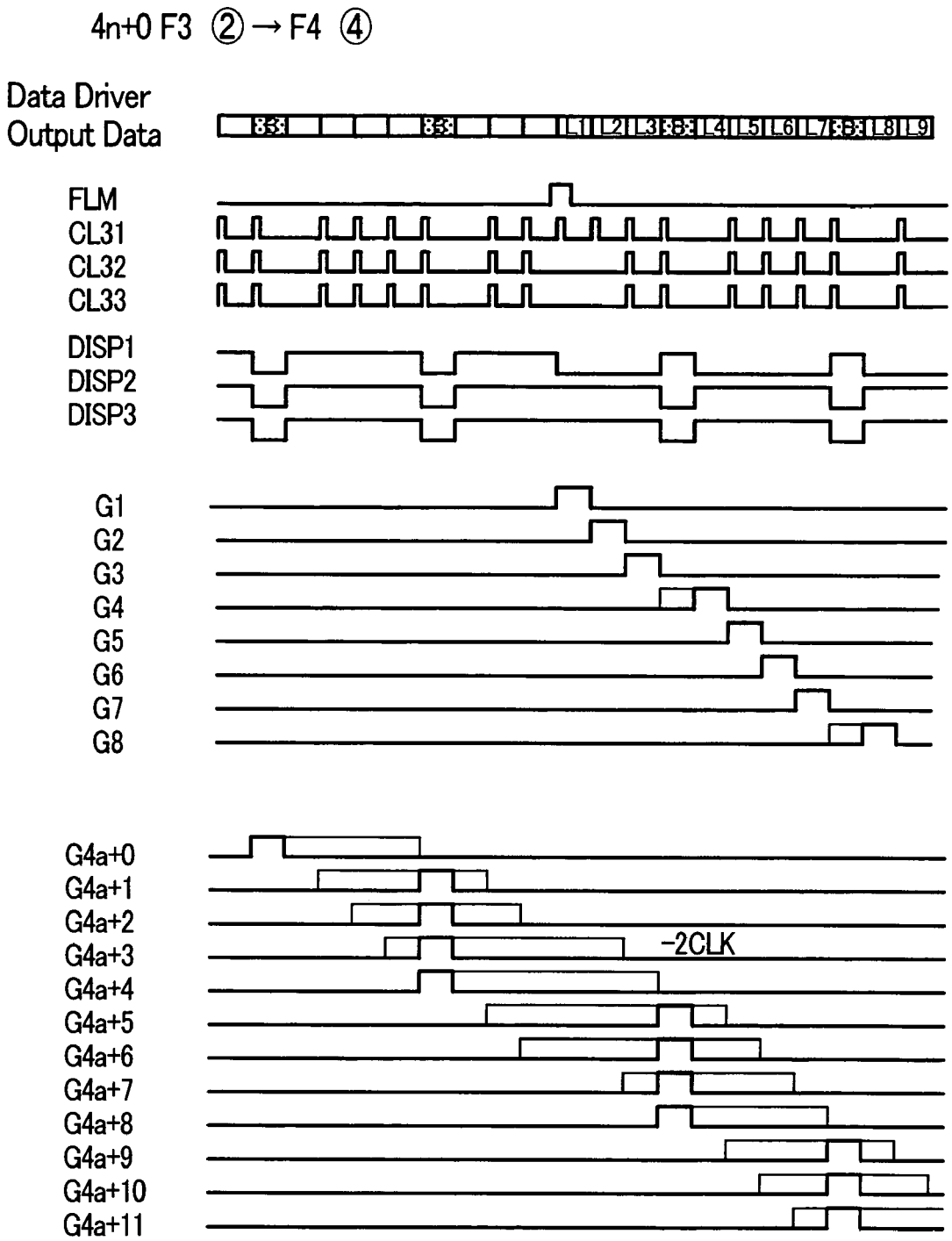
FIG. 43 is a view showing the driving waveforms of the liquid crystal display device in the fifth embodiment while the fourth frame is taking the place of the third frame, wherein the number of inputting horizontal periods is a multiple of 4.

As shown in FIG. 43, at the time of changeover between the third frame and the fourth frame, 6 horizontal periods are present between writing of the final blanking signal B to the third frame and writing of the beginning blanking signal B to the fourth frame. In this manner, during 6 horizontal periods, when the usual scanning clock CL3 is inputted to the scanning driver, the output timing is shifted by 6 lines and hence, two lines in which the blanking signals are not written appears. Accordingly, the scanning clocks CL3 becomes excessive by 2 clocks. Accordingly, the scanning clocks CL3 are stopped from the beginning of the fourth frame by 2 horizontal periods.

Figure 44:
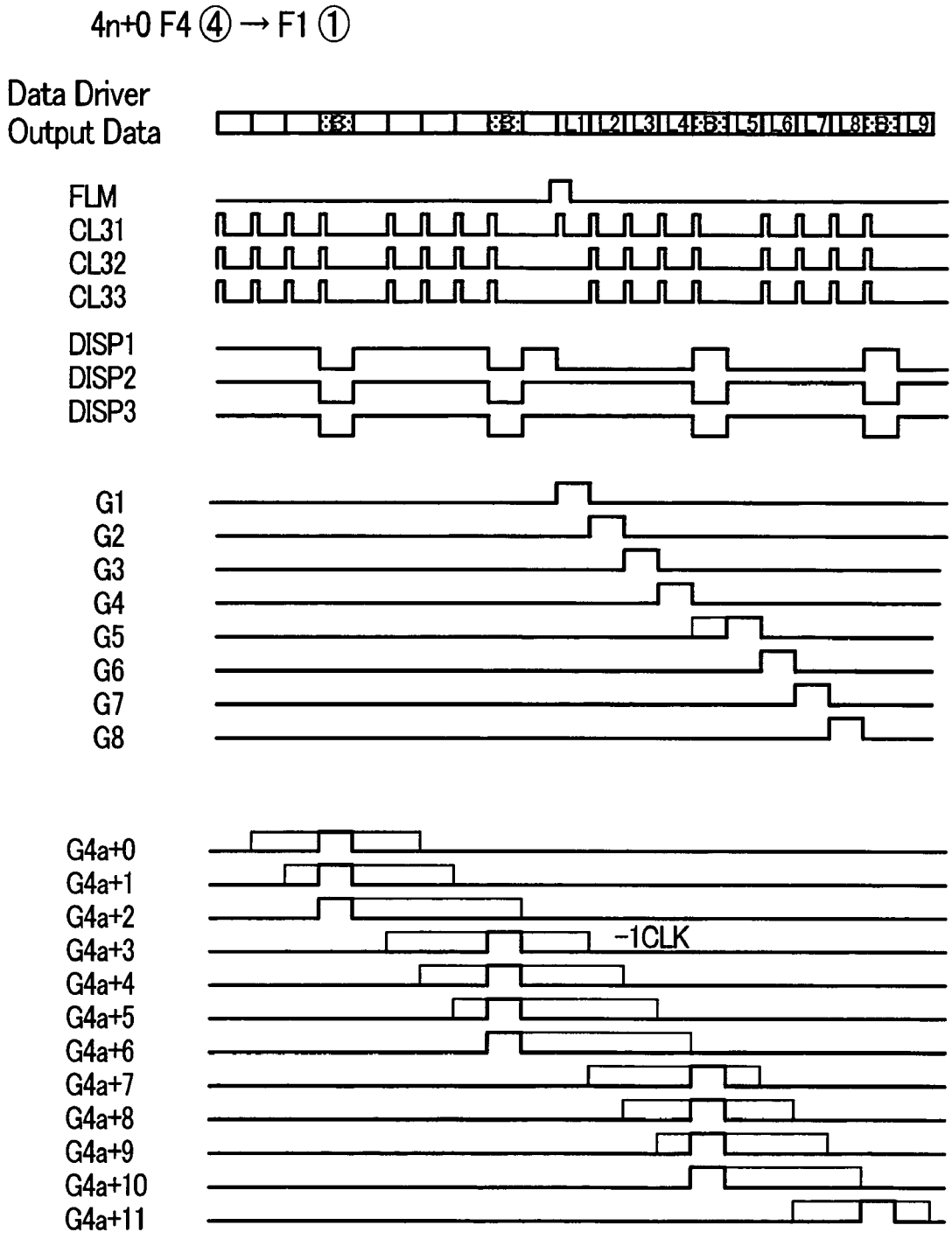
FIG. 44 is a view showing the driving waveforms of the liquid crystal display device in the fifth embodiment while the first frame is taking the place of the fourth frame, wherein the number of inputting horizontal periods is a multiple of 4.

As shown in FIG. 44, at the time of changeover between the fourth frame and the first frame, 5 horizontal periods are present between writing of the final blanking signal B to the fourth frame and writing of the beginning blanking signal B to the first frame. In this manner, during 5 horizontal periods, when the usual scanning clock CL3 is inputted to the scanning driver, the output timing is shifted by 5 lines and hence, 1 line in which the blanking signals B are not written appears. Accordingly, the scanning clocks CL3 becomes excessive by 1 clock. Accordingly, the scanning clocks CL3 are stopped at the beginning horizontal period of the first frame.

Accordingly, writing of the blanking signal B is performed with respect to all lines by 1 time/1 frame so that the favorable display quality can be obtained. To consider four frames in total as a result of adjustment, the scanning clocks CL3 are added by 3 clocks and are stopped by three clocks and hence, the numbers of adjustments agree to each other. Accordingly, the ratio between the image data holding time and blanking signal B holding time agree to each other throughout 4 frames inclusive and hence, the brightness difference between upper and lower portions of the pixel array is eliminated whereby the image quality can be enhanced.

Further, under the premise of the above-mentioned conditions, a case in which the number of inputting horizontal periods is a multiple of 4+1 is explained.

In this case, writing of the blanking signal B is performed by making use of the retracing period for input 4 lines. That is, the output 5 line periods are generated based on the input 4 line periods. Here, the fractions are present when the number of inputting horizontal periods in 1 frame is a multiple of 4+1. To obviate this situation, the four frames is set as one unit and the fractions obtained from four frames are combined to further generate the output 1 line period.

Figure 45:
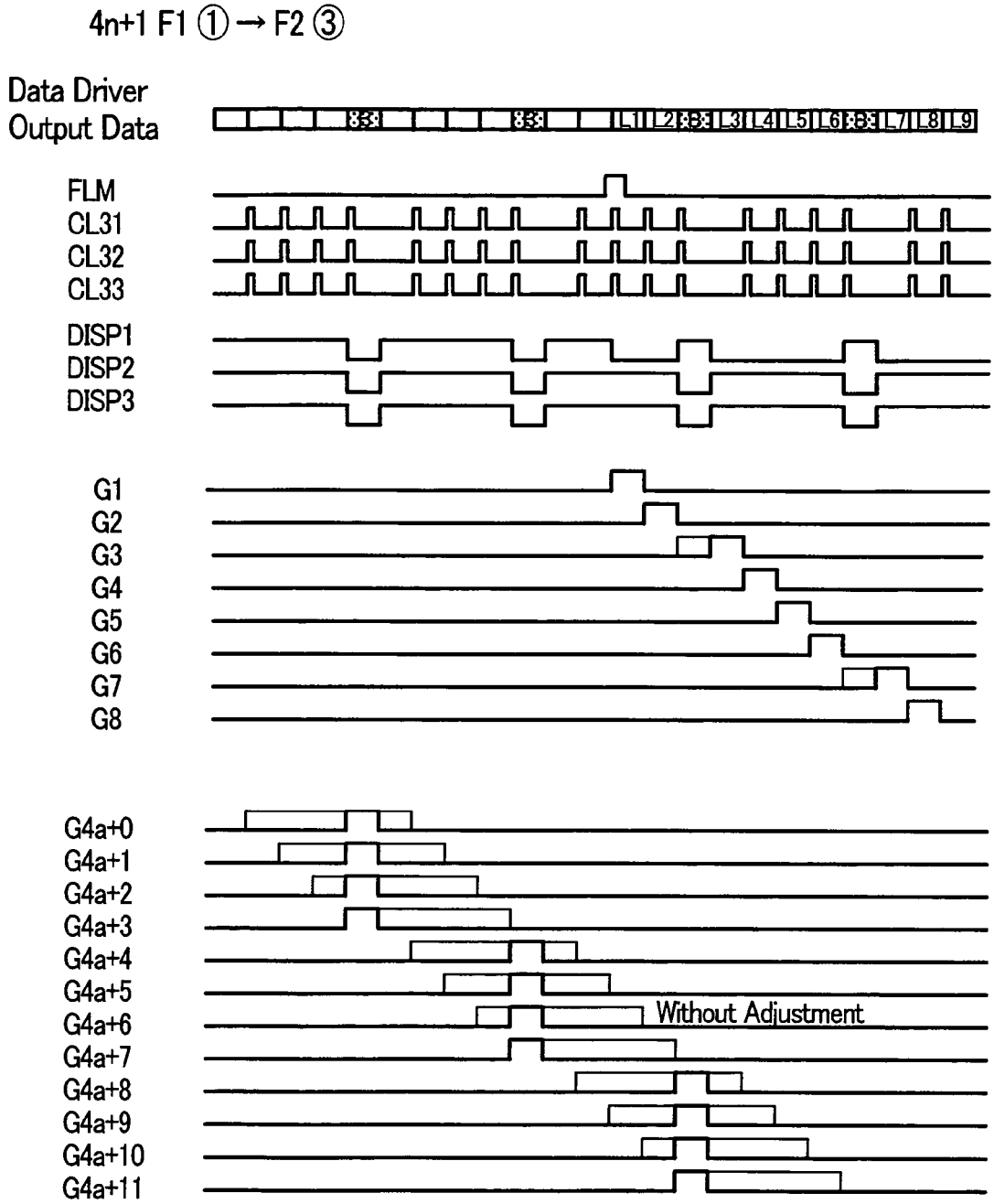
FIG. 45 is a view showing the driving waveforms of the liquid crystal display device in the fifth embodiment while the second frame is taking the place of the first frame, wherein the number of inputting horizontal periods is "a multiple of 4"+1.

As shown in FIG. 45, at the changeover of the first frame and the second frame, 4 horizontal periods are present between writing of the final blanking signal B in the first frame and writing of the beginning blanking signal B in the second frame. Accordingly, the adjustment of the number of pulses of the scanning clock CL3 is not performed.

Figure 46:
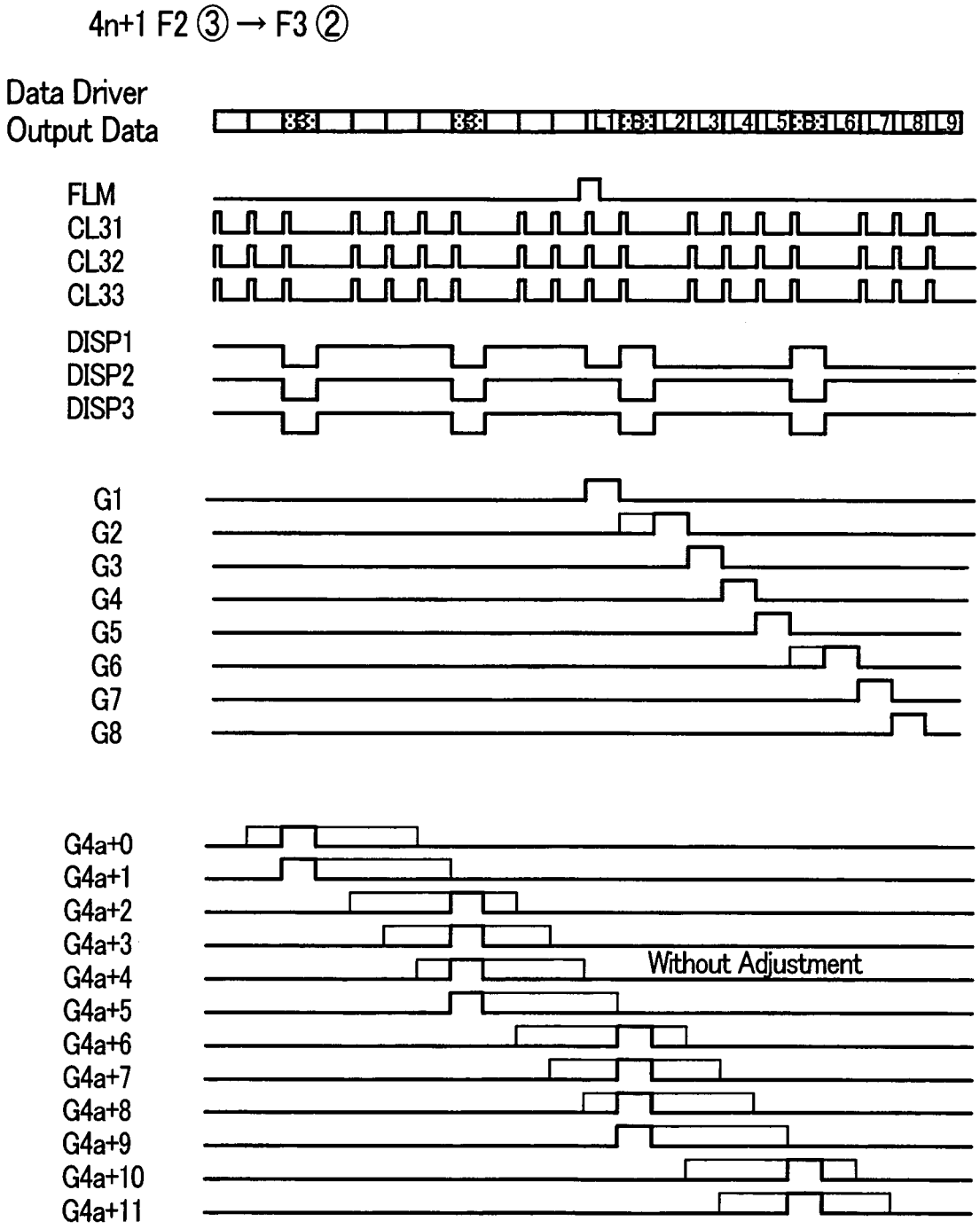
FIG. 46 is a view showing the driving waveforms of the liquid crystal display device in the fifth embodiment while the third frame is taking the place of the second frame, wherein the number of inputting horizontal periods is "a multiple of 4"+1.

Subsequently, as shown in FIG. 46, at the changeover of the second frame and the third frame, 4 horizontal periods are present between writing of the final blanking signal B in the second frame and writing of the beginning blanking signal B in the third frame. Accordingly, the adjustment of the number of pulses of the scanning clock CL3 is not performed.

Figure 47:
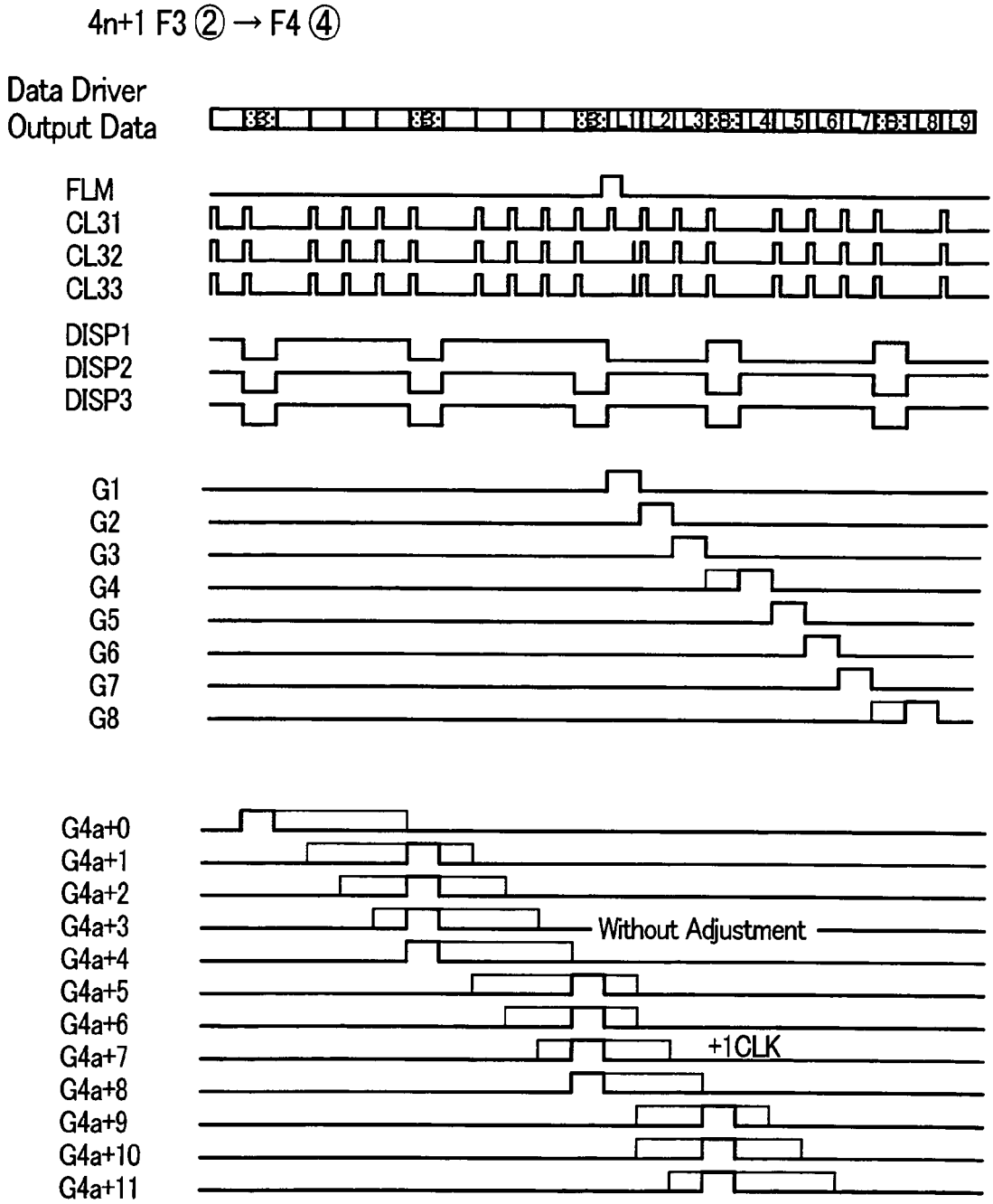
FIG. 47 is a view showing the driving waveforms of the liquid crystal display device in the fifth embodiment while the fourth frame is taking the place of the third frame, wherein the number of inputting horizontal periods is "a multiple of 4"+1.

Then, as shown in FIG. 47, at the changeover of the third frame and the fourth frame, 3 horizontal periods are present between writing of the final blanking signal B in the third frame and writing of the beginning blanking signal B in the fourth frame. In this manner, with respect to 3 horizontal periods, when the usual scanning clock CL3 is inputted to the scanning driver, the output timing is shifted by 3 lines and hence, 1 line in which the blanking signal is written twice appears. Accordingly, the scanning clock CL3 is short of 1 clock. Accordingly, the scanning clock CL3 is added in the beginning 1 horizontal period of the third frame by a shortage amount of 1 clock so as to output two pulses.

Figure 48:
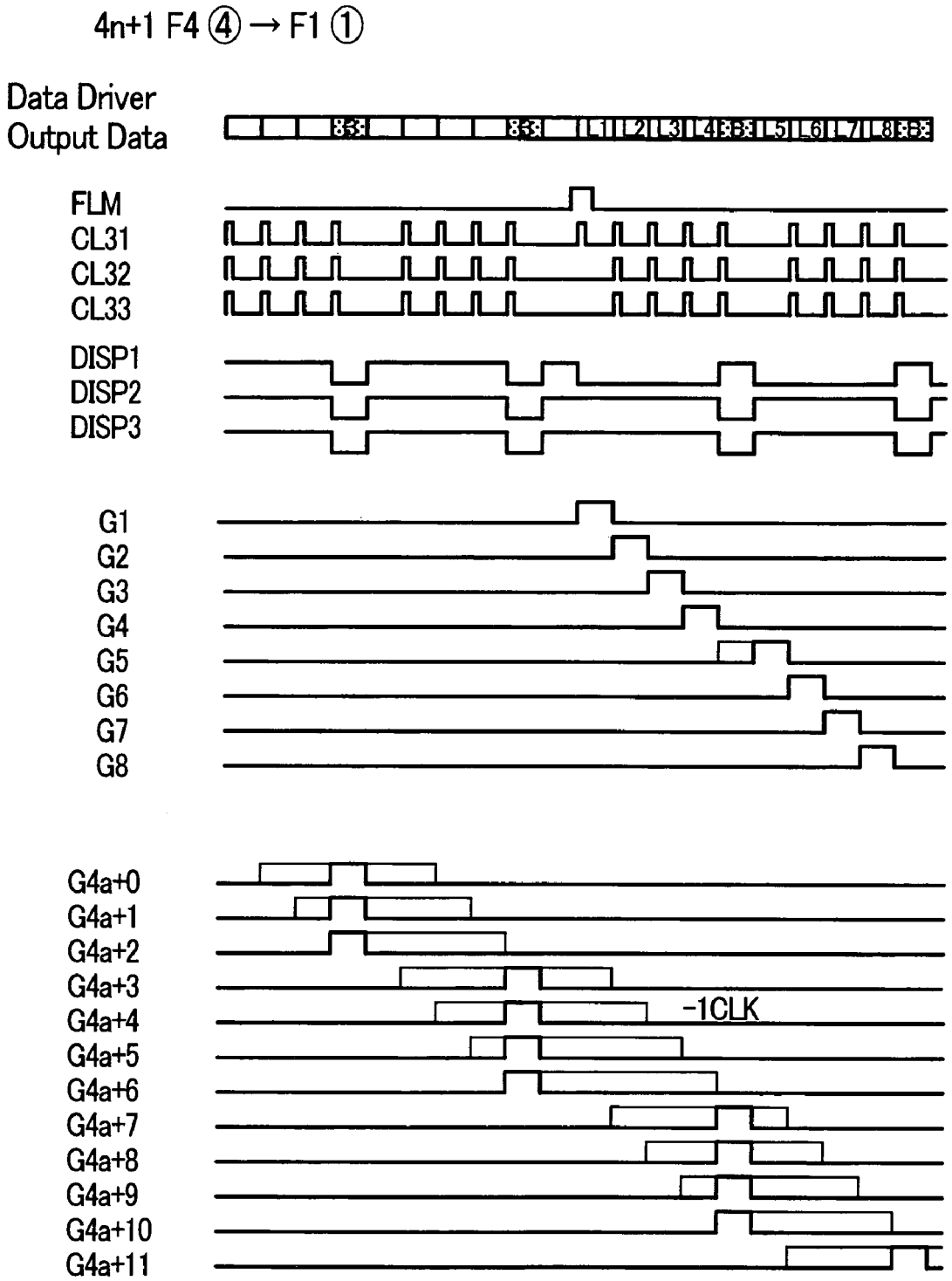
FIG. 48 is a view showing the driving waveforms of the liquid crystal display device in the fifth embodiment while the first frame is taking the place of the fourth frame, wherein the number of inputting horizontal periods is "a multiple of 4"+1.

Then, as shown in FIG. 48, at the changeover of the fourth frame and the first frame, 5 horizontal periods are present between writing of the final blanking signal B in the fourth frame and writing of the beginning blanking signal B in the first frame. In this manner, with respect to 5 horizontal periods, when the usual scanning clock CL3 is inputted to the scanning driver, the output timing is shifted by lines and hence, 1 line in which the blanking signal B is not written appears. Accordingly, the scanning clock CL3 includes 1 clock excessively. Accordingly, the scanning clock CL3 is stopped in the beginning of the horizontal period of the first frame.

Accordingly, writing of the blanking signal B is performed with respect to all lines by 1 time/1 frame so that the favorable display quality can be obtained. Further, to consider four frames in total as a result of adjustment, the scanning clock CL3 is added by 1 clock and is stopped by 1 clock and hence, the numbers of adjustments agree to each other. Accordingly, the ratio between the image data holding time and blanking signal B holding time agree to each other throughout 4 frames inclusive over the whole pixel array and hence, the brightness difference between upper and lower portions of the pixel array is eliminated whereby the image quality can be enhanced.

Further, under the premise of the above-mentioned conditions, a case in which the number of inputting horizontal periods is a multiple of 4+2 is explained.

In this case, writing of the blanking signal B is performed by making use of the retracing period for input 4 lines. That is, the output 5 line periods are generated based on the input 4 line periods. Here, the fractions are present when the number of inputting horizontal periods in 1 frame is a multiple of 4+2. To obviate this situation, the four frames is set as one unit and the fractions obtained from four frames are combined to further generate the output 2 line periods.

Figure 49:
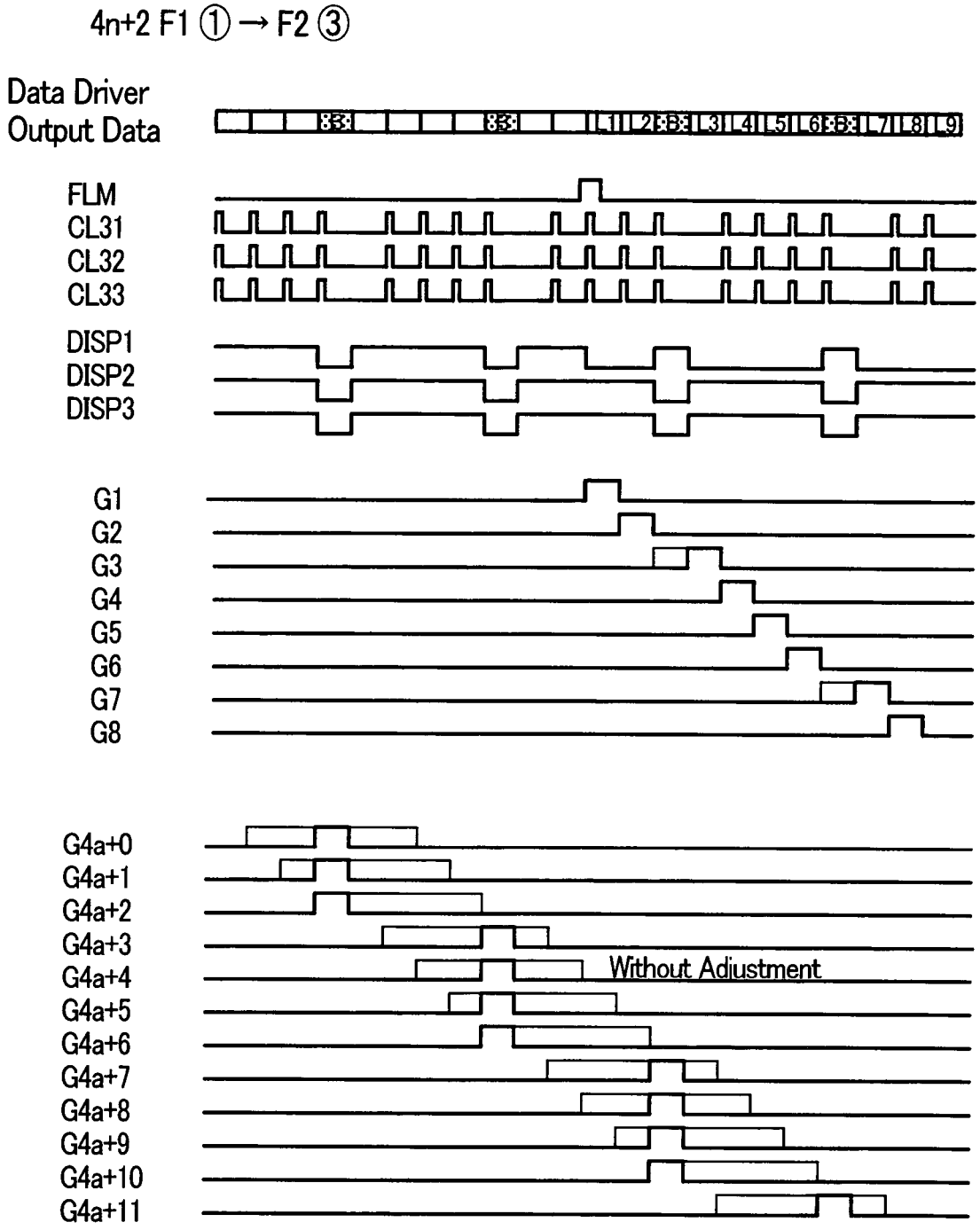
FIG. 49 is a view showing the driving waveforms of the liquid crystal display device in the fifth embodiment while the second frame is taking the place of the first frame, wherein the number of inputting horizontal periods is "a multiple of 4"+2.

As shown in FIG. 49, at the changeover of the first frame and the second frame, 4 horizontal periods are present between writing of the final blanking signal B in the first frame and writing of the beginning blanking signal B in the second frame. Accordingly, the adjustment of the number of pulses of the scanning clock CL3 is not performed.

Figure 50:
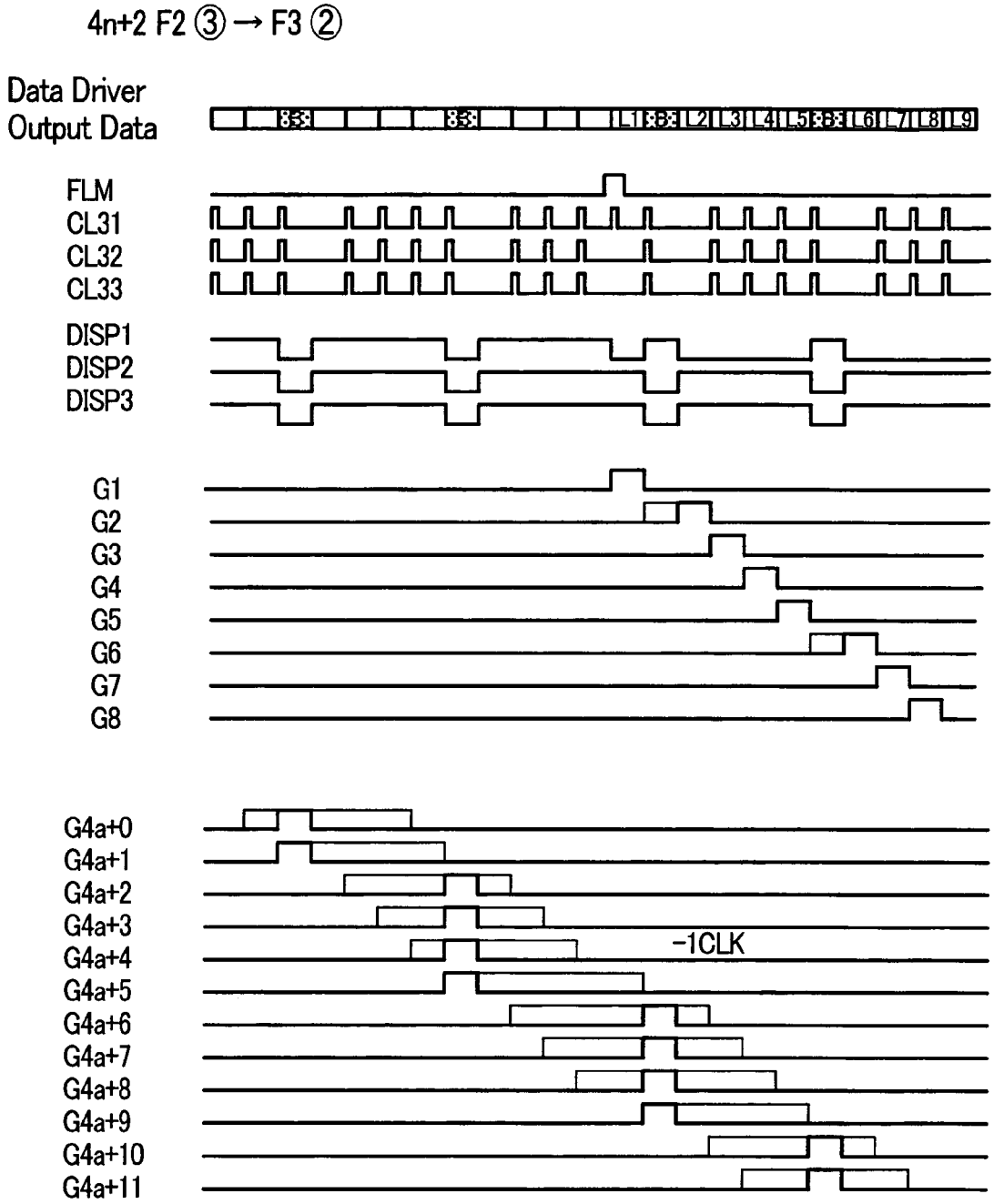
FIG. 50 is a view showing the driving waveforms of the liquid crystal display device in the fifth embodiment while the third frame is taking the place of the second frame, wherein the number of inputting horizontal periods is "a multiple of 4"+2.

Subsequently, as shown in FIG. 50, at the changeover of the second frame and the third frame, 5 horizontal periods are present between writing of the final blanking signal B in the second frame and writing of the beginning blanking signal B in the third frame. Accordingly, the adjustment of the number of pulses of the scanning clock CL3 is not performed. In this manner, with respect to 5 horizontal periods, when the usual scanning clock CL3 is inputted to the scanning driver, the output timing is shifted by 5 lines and hence, 1 line in which the blanking data is not written appears. Accordingly, the scanning clock CL3 includes 1 clock excessively. Accordingly, the scanning clock CL3 is stopped in the leading horizontal period the third frame.

Figure 51:
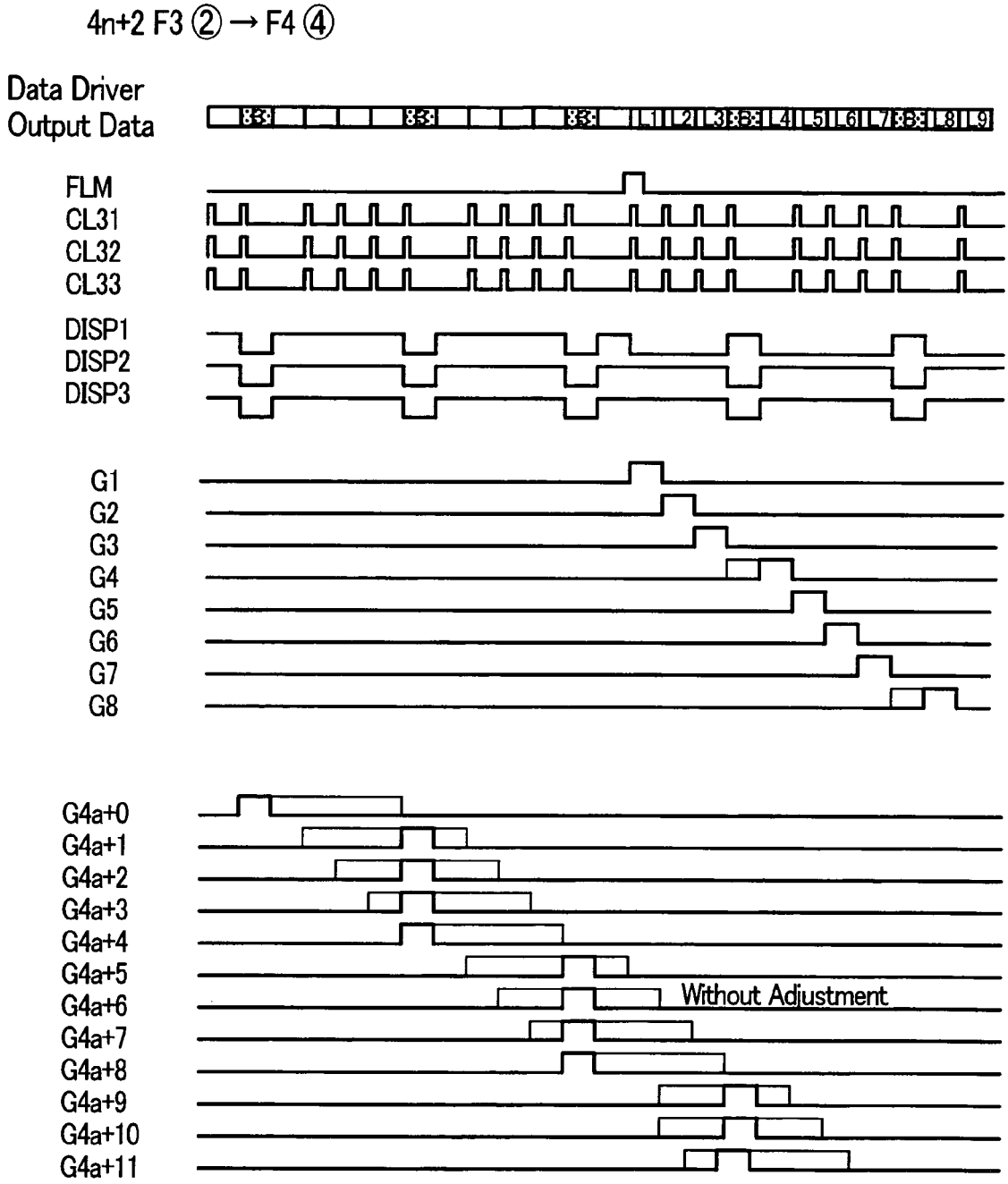
FIG. 51 is a view showing the driving waveforms of the liquid crystal display device in the fifth embodiment while the fourth frame is taking the place of the third frame, wherein the number of inputting horizontal periods is "a multiple of 4"+2.

Then, as shown in FIG. 51, at the changeover of the third frame and the fourth frame, 4 horizontal periods are present between writing of the final blanking signal B in the third frame and writing of the beginning blanking signal B in the fourth frame. Accordingly, the adjustment of the number of pulses of the scanning clock CL3 is not performed.

Figure 52:
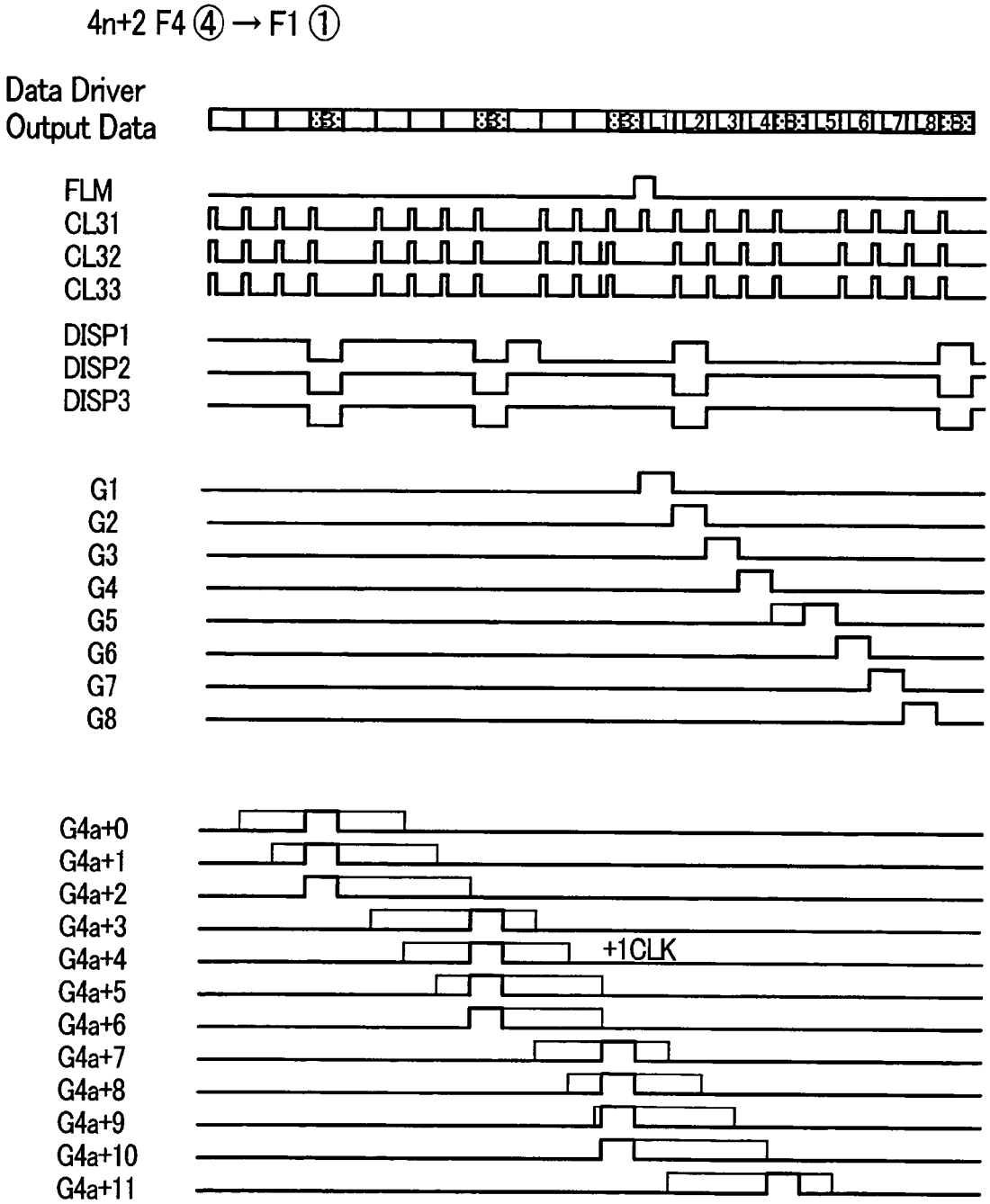
FIG. 52 is a view showing the driving waveforms of the liquid crystal display device in the fifth embodiment while the first frame is taking the place of the fourth frame, wherein the number of inputting horizontal periods is "a multiple of 4"+2.

Then, as shown in FIG. 52, at the changeover of the fourth frame and the first frame, 3 horizontal periods are present between writing of the final blanking signal B in the fourth frame and writing of the beginning blanking signal B in the first frame. In this manner, with respect to 3 horizontal periods, when the usual scanning clock CL3 is inputted to the scanning driver, the output timing is shifted only by 3 lines and hence, 1 line in which the blanking signal B is written twice appears. Accordingly, the scanning clock CL3 is short of 1 clock. Accordingly, the scanning clock CL3 is added in the beginning 1 horizontal period of the third frame by a shortage amount of 1 clock so as to output two pulses.

Accordingly, writing of the blanking signal B is performed with respect to all lines by 1 time/1 frame so that the favorable display quality can be obtained. Further, to consider four frames in total as a result of adjustment, the scanning clock CL3 is added by 1 clock and is stopped by 1 clock and hence, the numbers of adjustments agree to each other. Accordingly, the ratio between the image data holding time and blanking signal B holding time agree to each other throughout 4 frames inclusive over the whole pixel array and hence, the brightness difference between upper and lower portions of the pixel array is eliminated whereby the image quality can be enhanced.

Further, under the premise of the above-mentioned conditions, a case in which the number of inputting horizontal periods is a multiple of 4+3 is explained.

In this case, writing of the blanking signal B is performed by making use of the retracing period for input 4 lines. That is, the output 5 line periods are generated based on the input 4 line periods. Here, the fractions are present when the number of inputting horizontal periods in 1 frame is a multiple of 4+3. To obviate this situation, the four frames are set as one unit and the fractions obtained from four frames are combined to further generate the output 2 line periods.

Figure 53:
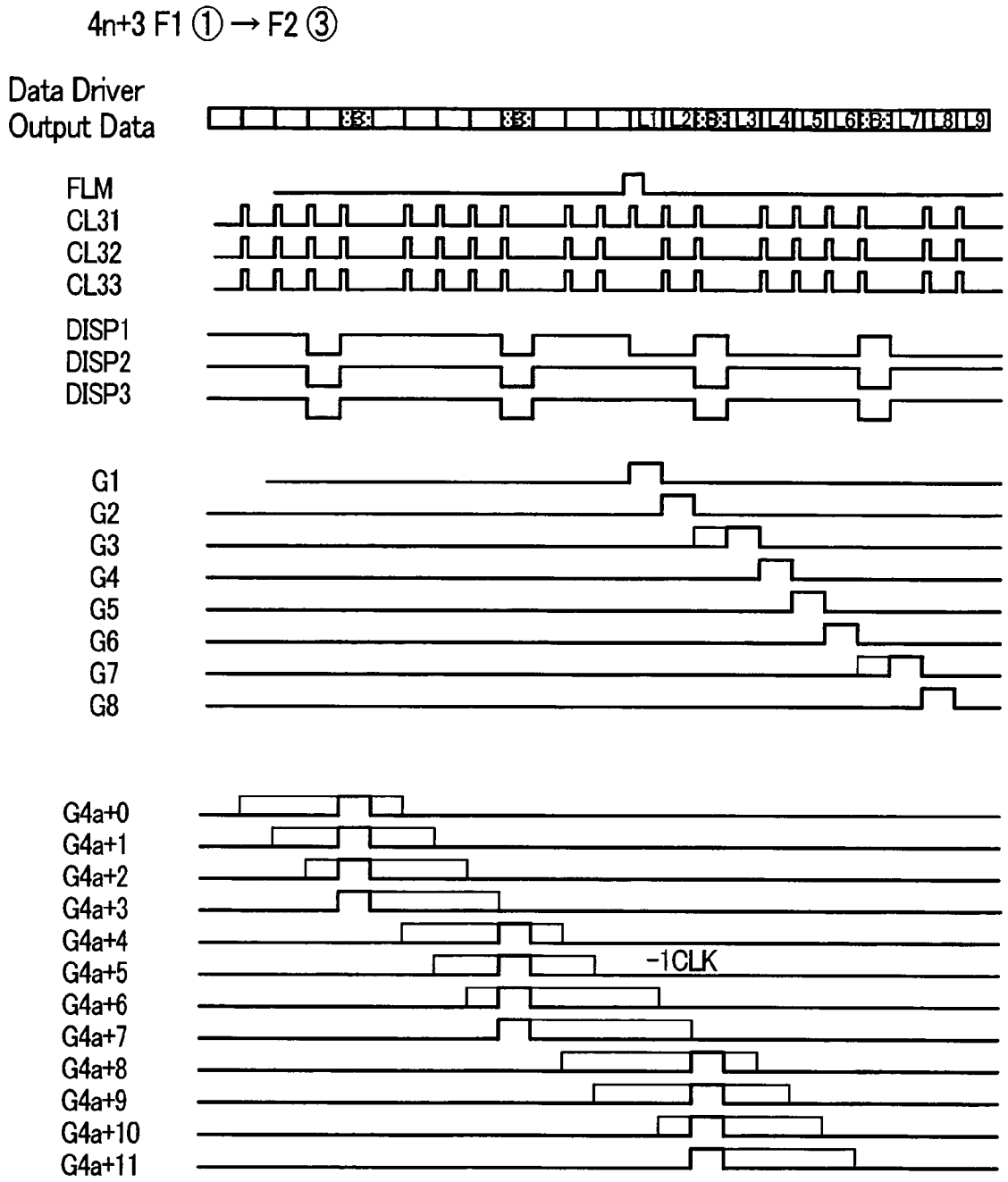
FIG. 53 is a view showing the driving waveforms of the liquid crystal display device in the fifth embodiment while the second frame is taking the place of the first frame, wherein the number of inputting horizontal periods is "a multiple of 4"+3.

As shown in FIG. 53, at the changeover of the first frame and the second frame, 5 horizontal periods are present between writing of the final blanking signal B in the first frame and writing of the beginning blanking signal B in the second frame. In this manner, with respect to 5 horizontal periods, when the usual scanning clock CL3 is inputted to the scanning driver, the output timing is shifted by 5 lines and hence, 1 line in which the blanking signal B is not written appears. Accordingly, the scanning clock CL3 includes 1 clock excessively. Accordingly, the scanning clock CL3 is stopped in the heading horizontal period of the second frame.

Figure 54:
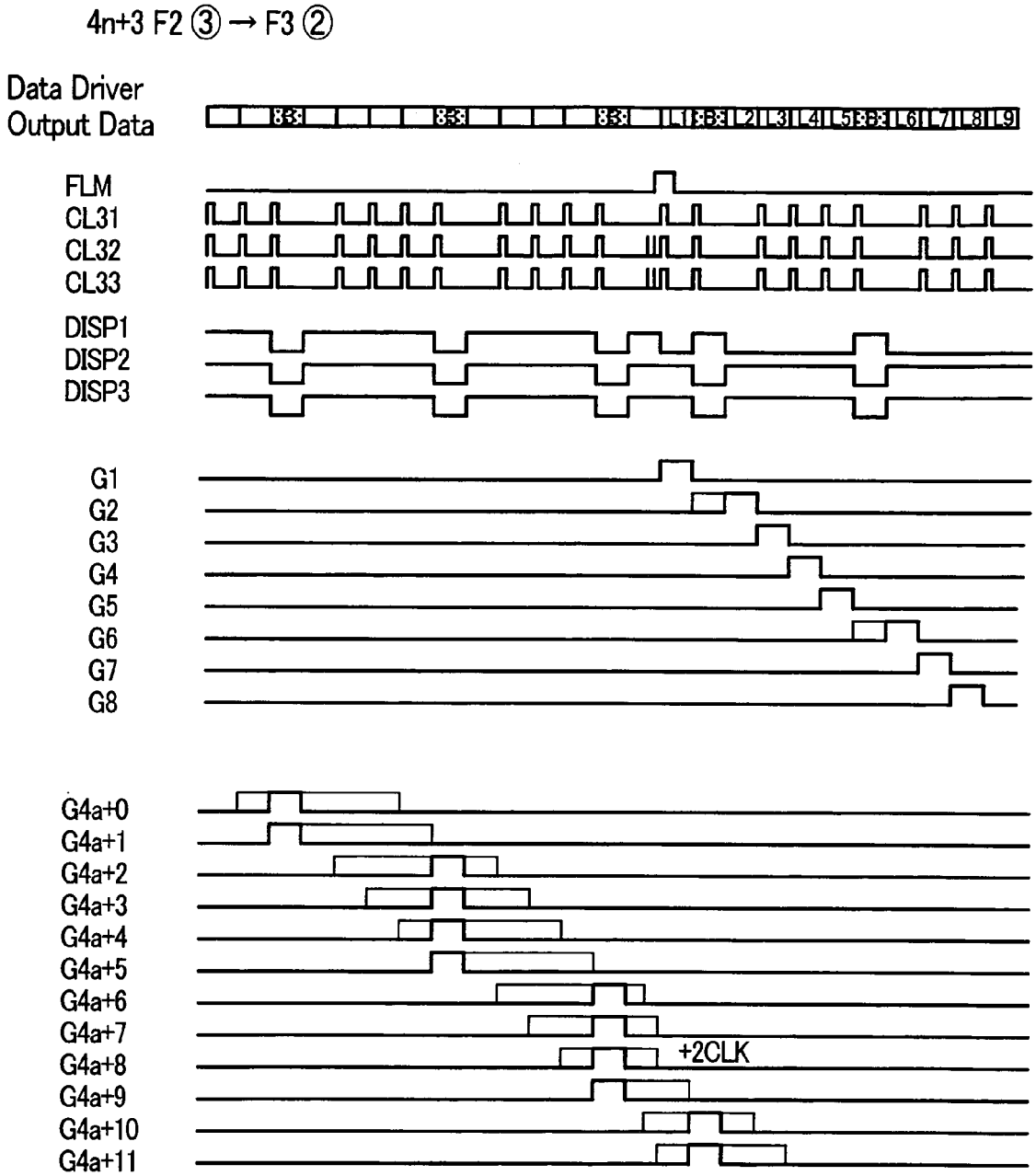
FIG. 54 is a view showing the driving waveforms of the liquid crystal display device in the fifth embodiment while the third frame is taking the place of the second frame, wherein the number of inputting horizontal periods is "a multiple of 4"+3.

Subsequently, as shown in FIG. 54, at the changeover of the second frame and the third frame, 2 horizontal periods are present between writing of the final blanking signal B in the second frame and writing of the beginning blanking signal B in the third frame. In this manner, with respect to 2 horizontal periods, when the usual scanning clock CL3 is inputted to the scanning driver, the output timing is shifted by 2 lines and hence, two lines in which the blanking signal B is written twice appears. Accordingly, the scanning clock CL3 is short of 2 clocks. Accordingly, the scanning clock CL3 is added in the beginning 1 horizontal period of the third frame by a shortage amount of 2 clocks so as to output three pulses.

Figure 55:
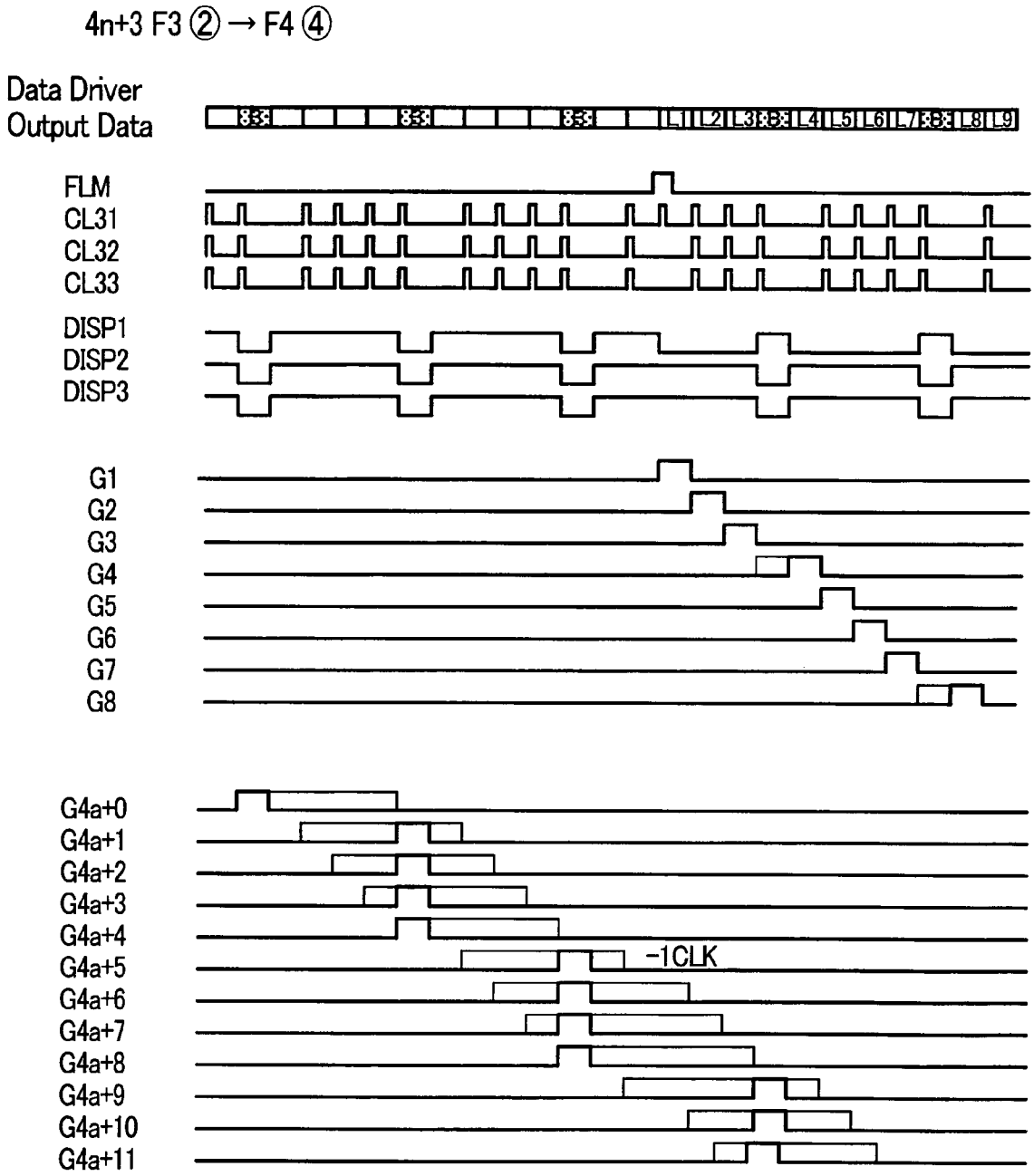
FIG. 55 is a view showing the driving waveforms of the liquid crystal display device in the fifth embodiment while the fourth frame is taking the place of the third frame, wherein the number of inputting horizontal periods is "a multiple of 4"+3.

Then, as shown in FIG. 55, at the changeover of the third frame and the fourth frame, 5 horizontal periods are present between writing of the final blanking signal B in the third frame and writing of the beginning blanking signal B in the fourth frame. In this manner, with respect to 5 horizontal periods, when the usual scanning clock CL3 is inputted to the scanning driver, the output timing is shifted by 5 lines and hence, 1 line in which the blanking signal B is not written appears. Accordingly, the scanning clock CL3 includes 1 clock excessively. Accordingly, the scanning clock CL3 is stopped in the beginning horizontal period of the second frame.

Figure 56:
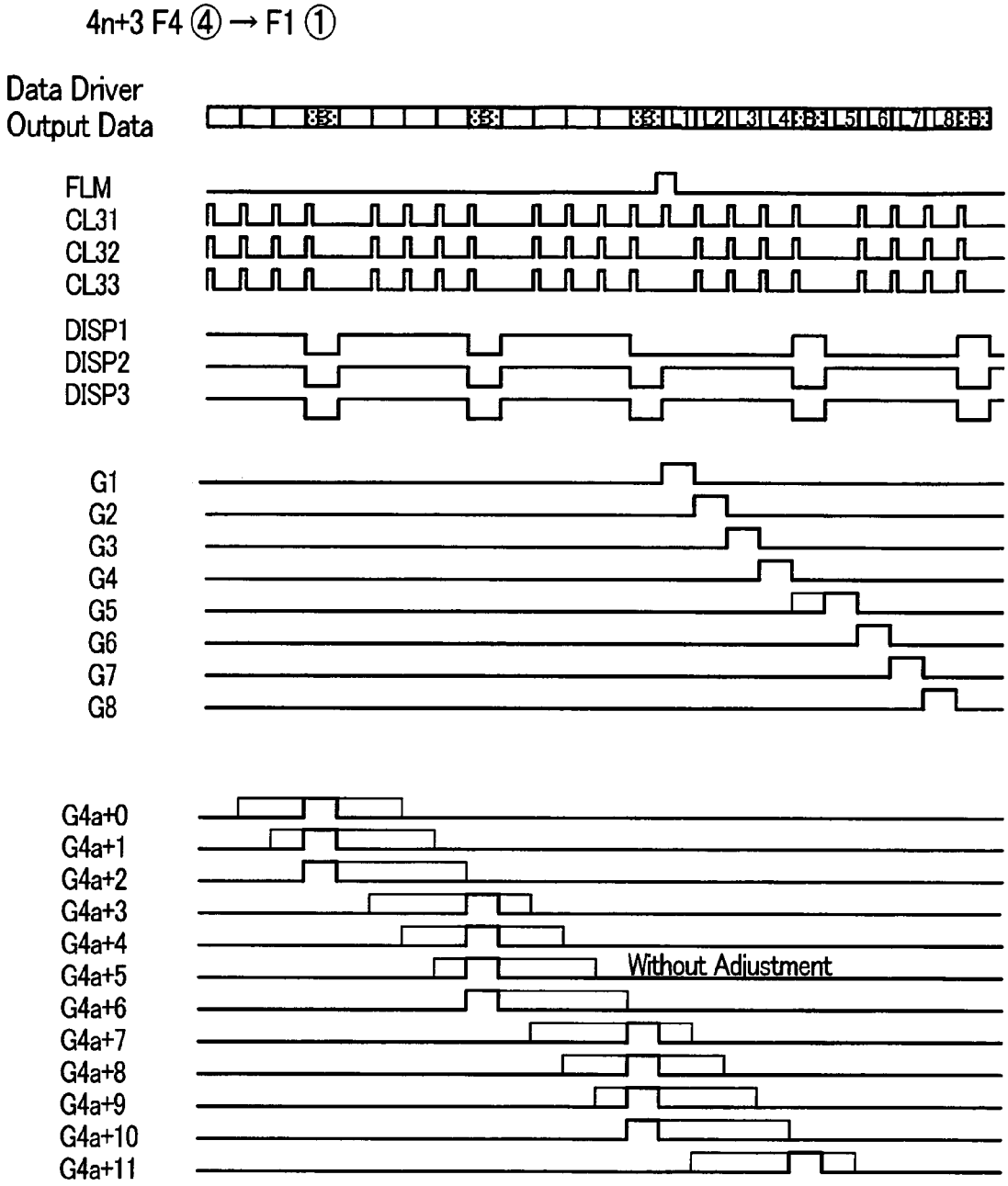
FIG. 56 is a view showing the driving waveforms of the liquid crystal display device in the fifth embodiment while the first frame is taking the place of the fourth frame, wherein the number of inputting horizontal periods is "a multiple of 4"+3.

Then, as shown in FIG. 56, at the changeover of the fourth frame and the first frame, 4 horizontal periods are present between writing of the final blanking signal B in the fourth frame and writing of the beginning blanking signal B in the first frame. Accordingly, the adjustment of the number of pulses of the scanning clock CL3 is not performed.

Accordingly, writing of the blanking signal B is performed with respect to all lines by 1 time/1 frame so that the favorable display quality can be obtained. Further, to consider four frames in total as a result of adjustment, the scanning clock CL3 is added by 2 clocks and is stopped by 2 clocks and hence, the numbers of adjustments agree to each other. Accordingly, the ratio between the image data holding time and blanking data B holding time agrees to each other throughout 4 frames inclusive over the whole pixel array and hence, the brightness difference between upper and lower portions of the pixel array is eliminated whereby the image quality can be enhanced.

The embodiment described in the fifth embodiment can be also directly applicable to the modification shown in the first embodiment. For example, the outputting number: M of display signals in the first step is not limited to 4 and the outputting number: M of blanking signals in the second step is not limited to 1.

As can be clearly understood from the foregoing explanation, according to the display device and the driving method thereof described in the fourth embodiment and the fifth embodiment of the present invention, it is possible to prevent the generation of the display flow of brightness line on the screen.

Further, the present invention can obtain the uniformity of black display in respective frames.

What is claimed is:

1. A display device comprising:

a plurality of gate lines;

at least one a data line; and a plurality of pixels connected to the plurality of gate lines and the at least one data line;

wherein the display device is configured to enable a first step of sequentially selecting N lines of the plurality of gate lines, and sequentially outputting N times display signals to the at least one data line, where N is a natural number of at least 2;

wherein the display device is configured to enable a second step of selecting Z lines of the plurality of gate lines at one time, and outputting one time a blanking signal, where Z is a natural number of at least 2;

wherein the Z lines are separate from the N lines, and the first step and second step are repeated; and wherein a display signal polarity of the blanking signal is different from a display signal polarity of a first outputted display signal of the beginning time of the N times of the next first step.

2. A display device according to claim 1, wherein the number N and the number Z are the same.

3. A display device according to claim 2, wherein the number N and the number Z are set to 4.

4. A display device according to claim 1, wherein the number N is set to 4.

5. A display device according to claim 1, wherein the display signal polarity of the blanking signal of the second step is the same as a display signal polarity of a last display signal of the N times of previous first step.

6. A display device according to claim 5, wherein the number N and the number Z are same.

7. A display device according to claim 6, wherein the number N and the number Z are set to 4.

8. A display device according to claim 5, wherein the Number N is set to 4.

9. A display device according to claim 1, wherein a gate line selected at a last time and receiving a last display signal of the N times in a first frame is different from a pixel receiving a last display signal of the N times in a second frame.

10. A display device comprising:

a plurality of gate lines;

at least one a data line; and a plurality of pixels connected to the plurality of gate lines and the at least one data line;

wherein the display device is configured to enable a first step of sequentially selecting N lines of the plurality of gate lines, and sequentially outputting N times display signals to the at least one data line, where N is a natural number of at least 2;

wherein the display device is configured to enable a second step of selecting Z lines of the plurality of gate lines at one time, and outputting one time a blanking signal, where Z is a natural number of at least 2;

wherein the display device comprises a normally black display portion;

wherein the Z lines are separate from the N lines, and the first step and second step are repeated; and wherein a display signal polarity of the blanking signal is different from a display signal polarity of a first outputted display signal of the beginning time of the N times of the next first step.

11. A display device according to claim 10, wherein the number N and the number Z are the same.

12. A display device according to claim 11, wherein the number N and the number Z are set to 4.

13. A display device according to claim 10, wherein the number N is set to 4.

14. A display device according to claim 10, wherein the display signal polarity of the blanking signal of the second step is the same as a display signal polarity of a last display signal of the N times of previous first step.

15. A display device according to claim 14, wherein the number N and the number Z are same.

16. A display device according to claim 15, wherein the number N and the number Z are set to 4.

17. A display device according to claim 14, wherein the Number N is set to 4.

18. A display device according to claim 10, wherein a gate line selected at a last time and receiving a last display signal of the N times in a first frame is different from a pixel receiving a last display signal of the N times in a second frame.

* * * * *